US011211715B2

(12) United States Patent
Kojima

(10) Patent No.: US 11,211,715 B2
(45) Date of Patent: Dec. 28, 2021

(54) ANTENNA APPARATUS AND MOBILE TERMINAL

(71) Applicant: Suguru Kojima, Kanagawa (JP)

(72) Inventor: Suguru Kojima, Kanagawa (JP)

(73) Assignee: Suguru Kojima, Kanagawa (JP)

( * ) Notice: Subject to any disclaimer, the term of this patent is extended or adjusted under 35 U.S.C. 154(b) by 0 days.

(21) Appl. No.: 16/664,963

(22) Filed: Oct. 28, 2019

(65) Prior Publication Data

US 2020/0059006 A1 Feb. 20, 2020

Related U.S. Application Data

(63) Continuation of application No. PCT/JP2017/017034, filed on Apr. 28, 2017.

(51) Int. Cl.
*H01Q 9/04* (2006.01)
*H01Q 19/00* (2006.01)
(Continued)

(52) U.S. Cl.
CPC ..... *H01Q 19/005* (2013.01); *H01Q 9/04* (2013.01); *H01Q 9/045* (2013.01);
(Continued)

(58) Field of Classification Search
CPC ..... H01Q 19/005; H01Q 9/045; H01Q 19/10; H01Q 9/42; H01Q 9/0407; H01Q 19/00; H01Q 9/04
(Continued)

(56) References Cited

U.S. PATENT DOCUMENTS 4,400,702 A * 8/1983 Tanaka ..... H01Q 9/16 343/790
5,777,585 A 7/1998 Tsuda
(Continued)

FOREIGN PATENT DOCUMENTS

CN 1653645 A 8/2005
CN 101821900 A 9/2010
(Continued)

OTHER PUBLICATIONS

Extended European Search Report for counterpart European Application No. 17907213.7, issued by the European Patent Office dated Apr. 17, 2020.
(Continued)

*Primary Examiner* — Hai V Tran

(57) ABSTRACT

An antenna apparatus having directivity includes an antenna portion having a power feeding portion, a plate-like first antenna element, and a second antenna element connected to a side of the first antenna element through the power feeding portion, the second antenna element having a width smaller than that of the first antenna element; and a plate-like parasitic element disposed opposite to the antenna portion. The parasitic element has a length that is approximately one-half or more of a wavelength of an operating frequency. The second antenna element has a length that is shorter than one-fourth of the wavelength of the operating frequency. The antenna portion and the parasitic element have a distance capable of being connected electromagnetically to each other.

18 Claims, 97 Drawing Sheets

(51) Int. Cl.
*H01Q 19/10* (2006.01)
*H01Q 9/42* (2006.01)

(52) U.S. Cl.
CPC ..... *H01Q 9/0407* (2013.01); *H01Q 9/42* (2013.01); *H01Q 19/00* (2013.01); *H01Q 19/10* (2013.01)

(58) Field of Classification Search
USPC ..... 343/833
See application file for complete search history.

(56) References Cited

U.S. PATENT DOCUMENTS

| | | | | |
|---|---|---|---|---|
| 5,914,693 | A * | 6/1999 | Takei | H01Q 13/16 343/700 MS |
| 6,211,830 | B1 * | 4/2001 | Monma | H01Q 1/242 343/702 |
| 6,486,836 | B1 * | 11/2002 | Hill | H01Q 1/243 343/702 |
| 6,600,456 | B2 * | 7/2003 | Gothard | H01Q 1/246 342/372 |
| 8,405,553 | B2 * | 3/2013 | Pintos | H01Q 21/24 343/700 MS |
| 2003/0169206 | A1 * | 9/2003 | Egawa | H01Q 19/10 343/702 |
| 2004/0227673 | A1 | 11/2004 | Iwai | |
| 2005/0104783 | A1 * | 5/2005 | Kojima | H01Q 9/42 343/702 |
| 2005/0239519 | A1 | 10/2005 | Saitou | |
| 2007/0285334 | A1 | 12/2007 | Tsutsumi | |
| 2009/0189815 | A1 * | 7/2009 | Hotta | H01Q 1/243 343/700 MS |
| 2010/0194659 | A1 | 8/2010 | Chakam | |
| 2010/0214175 | A1 | 8/2010 | Hui | |
| 2012/0194390 | A1 * | 8/2012 | Endo | H01Q 5/378 343/700 MS |
| 2012/0249393 | A1 * | 10/2012 | Hotta | H01Q 7/00 343/843 |
| 2013/0099980 | A1 * | 4/2013 | Hayashi | H01Q 9/42 343/700 MS |
| 2013/0241792 | A1 | 9/2013 | Ishikawa | |
| 2014/0320379 | A1 | 10/2014 | Hamabe | |

FOREIGN PATENT DOCUMENTS

| | | | |
|---|---|---|---|
| CN | 102104192 | A | 6/2011 |
| CN | 103326131 | A | 9/2013 |
| CN | 205828653 | U | 12/2016 |
| JP | H0750505 | A | 2/1995 |
| JP | 2001077611 | A | 3/2001 |
| JP | 2004032808 | A | 1/2004 |
| JP | 2005045646 | A | 2/2005 |
| JP | 4263961 | B2 | 5/2009 |
| JP | 2010154507 | A | 7/2010 |
| JP | 2011027703 | A | 2/2011 |
| WO | 0193372 | A1 | 12/2001 |

OTHER PUBLICATIONS

Office Action issued for counterpart Chinese Application No. 201780090078 9, issued by the Chinese Patent Office dated May 21, 2020.

International Search Report and (ISA/237) Written Opinion of the International Search Authority for International Patent Application No. PCT/JP2017/017034, mailed by the Japan Patent Office dated Jun. 27, 2017.

Office Action issued for counterpart Japanese Application No. 2019-515049, drafted by the Japan Patent Office dated Sep. 24, 2019.

Office Action issued for counterpart Chinese Application No. 201780090078.9, issued by the Chinese Patent Office dated Dec. 28, 2020.

Office Action issued for counterpart Taiwanese Application 107111789, issued by the Taiwan Intellectual Property Office dated Aug. 3, 2021.

* cited by examiner

ANTENNA APPARATUS AND MOBILE TERMINAL

BACKGROUND

1. Technical Field

The present invention relates to an antenna apparatus and a mobile terminal.

2. Related Art

Conventionally, an antenna apparatus is used in a mobile terminal having a call function or a data communication function. Since the mobile terminal may be used close to the human body, there is a concern about the influence of electromagnetic waves on the human body. As a safety index, a Specific Absorption Rate (SAR) that is the amount of absorbed power per unit mass is applied. For this reason, it is preferable that the antenna apparatus is able to reduce the SAR while improving the antenna gain. From the viewpoint of reducing the SAR, it is effective to make the antenna directivity in the opposite direction of the human body to reduce the electromagnetic waves radiated to the human body side. As a solution to this issue, there is known an apparatus in which a plate-like parasitic element is provided opposing an excitation element, and the parasitic element operates as a reflector and a bandwidth widening element by electromagnetic coupling of the excitation element and the parasitic element (for example, refer to PTL 1).

PTL 1: Japanese Patent No. 4263961

SUMMARY

Recently, new communication services such as IoT (Internet of Things) are being implemented. Since this antenna apparatus may be attached to a human body or a metal object, there is a concern that the performance of the antenna may be degraded due to influence from an attachment portion such as the human body or metal object. In order to reduce the influence from the attachment portion also, the method of making the antenna directivity in the opposite direction of the attachment portion to reduce electromagnetic waves radiated to the attachment portion side is effective.

It is preferable that the antenna apparatus has a structure that can be further reduced in size. For example, it is desirable for wearable terminals that can be worn and carried to be reduced in size from the viewpoint of mobility and design. Therefore, it is preferable that the antenna apparatus used for the wearable terminal can be reduced in size.

An antenna apparatus having directivity according to a first embodiment of the present invention includes an antenna portion having a power feeding portion, a plate-like first antenna element, and a second antenna element connected to a side of the first antenna element through the power feeding portion, the second antenna element having a width smaller than that of the first antenna element; and a plate-like parasitic element disposed opposite to the antenna portion. The parasitic element has a length that is approximately one-half or more of a wavelength of an operating frequency. The second antenna element has a length that is shorter than one-fourth of the wavelength of the operating frequency. The antenna portion and the parasitic element have a distance capable of being connected electromagnetically to each other. The antenna apparatus has a resonance frequency which is controlled by adjusting a length and/or the width of the first antenna element. In addition, the antenna apparatus has an input impedance which is controlled by adjusting the length of the second antenna element.

A mobile terminal according to an embodiment of the present invention includes the antenna apparatus of the first embodiment.

The summary clause does not necessarily describe all necessary features of the embodiments of the present invention. The present invention may also be a sub-combination of the features described above.

DESCRIPTION OF EXEMPLARY EMBODIMENTS

Figure 1:
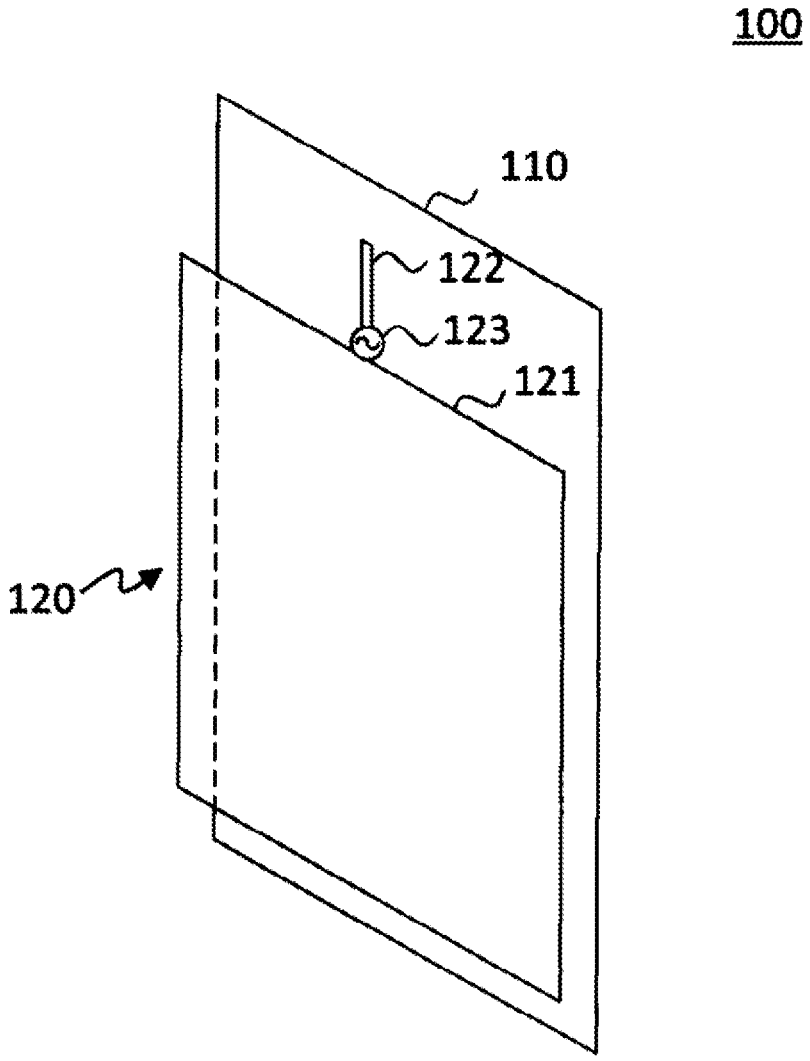
FIG. 1 is a perspective diagram showing an outline of an antenna apparatus 100 according to an embodiment of the present invention.

While the present invention will be described below through embodiments of the invention, the embodiments below shall not limit the invention according to the scope of the claims. In addition, not all the combinations of characteristics described in the embodiments are essential for the solution of the invention. It is noted that unless otherwise specified, components and the like denoted by the same reference numerals in the drawings have the same configuration and function. For this reason, description of the components shown in the drawings may be omitted.

FIG. 1 is a perspective diagram showing an outline of an antenna apparatus 100 according to an embodiment of the present invention. The antenna apparatus 100 includes an antenna portion 120 and a parasitic element 110. The antenna portion 120 may be a deformed dipole antenna that is a so-called dipole antenna in which the shapes of the two antenna elements are deformed. In addition, the antenna portion 120 may be a monopole antenna in which one of the antenna elements functions as an electrical ground.

The parasitic element 110 is a plate-like conductor and is disposed opposing the antenna portion 120. That is, at least one part of the antenna portion 120 is disposed at a position that overlaps with the parasitic element 110. In the present example, the antenna portion 120 is disposed at a position where the entire antenna portion 120 overlaps with the parasitic element 110. As an example, the parasitic element 110 is a copper plate.

The parasitic element 110 is disposed having a specific distance from the antenna portion 120. The distance is set such that the parasitic element 110 and the antenna portion 120 can be electromagnetically coupled.

The parasitic element 110 has a length that is approximately one-half or more of a wavelength $\lambda$ of an operating frequency that is used by the antenna apparatus 100. The parasitic element 110 may have a length that is approximately one-half of the wavelength when reducing the size of the antenna apparatus, but also may have a longer length. The parasitic element 110 may be a metallic body of an object to which the antenna apparatus 100 is attached. For example, when attaching to an automobile, the parasitic element 110 may be a metallic body that is a part of the body of the automobile. In addition, the shape is not limited and may be a rectangle or a circle. When the antenna apparatus 100 uses the operating frequency of a specific range, the wavelength $\lambda$ of the operating frequency indicates the wavelength of the central frequency of the specific range. In addition, when the transmission frequency and reception frequency of the antenna apparatus 100 are different, the wavelength $\lambda$ of the operating frequency is the wavelength of the intermediate frequency of the transmission frequency and the reception frequency.

In the present description, the wavelength of the operating frequency may be simply referred to as the wavelength $\lambda$. The operating frequency is, for example, 2 GHz. In addition, approximately one-half of the wavelength $\lambda$ may indicate $\lambda/2$ or an extent that is slightly longer than $\lambda/2$. In addition, approximately one-half of the wavelength $\lambda$ may indicate a length within a range that allows for the parasitic element 110 to be electromagnetically coupled with the antenna portion 120 and function as a reflector at the operating frequency. For example, approximately one-half of the wavelength $\lambda$ is a range of 1 time or more to 1.3 times or less of $\lambda/2$. In addition, when prescribing the length or width of parts using the wavelength $\lambda$, the wavelength $\lambda$ may be a value multiplied by the shortening coefficient of wavelength that is determined according to the relative dielectric constant of the parts.

Due to the parasitic element 110 functioning as a reflector, the antenna apparatus 100 has directivity toward an opposite side of the parasitic element 110. For this reason, in a mobile terminal, by disposing the parasitic element 110 on a human body side, it is possible to reduce the SAR. It is noted that by disposing the entire antenna portion 120 at a position overlapping with the parasitic element 110, it is possible to strengthen the directivity toward the opposite side of the parasitic element 110.

The antenna portion 120 has a first antenna element 121, a second antenna element 122, and a power feeding portion 123. The first antenna element 121 is a plate-like conductor. It is noted that plate-like indicates a shape wherein the length and width are substantially greater than the thickness. As an example, plate-like may be a shape wherein the length and width are twice or more than the thickness.

It is noted that the length of the first antenna element 121 is shorter than the length of the parasitic element 110. The length of the first antenna element 121 may be greater than one-fourth of the wavelength λ.

The second antenna element 122 is a conductor having a width that is smaller than that of the first antenna element 121. The second antenna element 122 may be plate-like or may not be plate-like. In the present example, the second antenna element 122 is filament-like. Filament-like indicates a shape wherein the width and thickness are substantially smaller than the length. As an example, filament-like may be a shape wherein each of the width and thickness is half or less of the length. The second antenna element 122 may be formed by the same material as the first antenna element 121 or may be formed by different material. For example, the first antenna element 121 and the second antenna element 122 may be copper foil formed on a specific dielectric substrate.

The power feeding portion 123 is provided between the first antenna element 121 and the second antenna element 122 and is electrically connected with the first antenna element 121 and the second antenna element 122. The power feeding portion 123 is connected with the antenna elements via matching circuits or the like (not shown) that adjust the input impedance of the antenna.

The length, width, distance, and the like of the first antenna element 121, the second antenna element 122, and the parasitic element 110 are set such that the parasitic element 110 functions as a reflector and the frequency characteristic of the antenna apparatus 100 is wide band. For example, the lengths of the parasitic element 110 and the antenna portion 120 are determined such that they resonate at a specific operating frequency.

It is noted that the length of the second antenna element 122 is shorter than one-fourth of the wavelength λ. Even if the length of the second antenna element 122 is shortened, by adjusting the length, width, and the like of the first antenna element 121, it is possible to electromagnetically couple the antenna portion 120 and the parasitic element 110 and to widen the bandwidth of the antenna apparatus 100. The length of the second antenna element 122 may be one-tenth or less of the wavelength λ and may be one-twentieth or less. It is noted that a lower limit of the length of the second antenna element 122 may be about one-fiftieth of the wavelength λ and may be about one-hundredth.

By shortening the second antenna element 122, the antenna apparatus 100 can be reduced in size. Generally, the length of a second antenna element in a dipole antenna or monopole antenna is about one-fourth of the wavelength λ. In the configuration shown in FIG. 1, if the length of the second antenna element 122 is set to about λ/4 under the condition that it does not protrude from the range opposing the parasitic element 110, it is necessary that the second antenna element 122 is an inverted L-shape and that the second antenna element 122 extends in the width direction of the antenna apparatus 100. In this case, it is difficult to make the width of the antenna apparatus 100 smaller than approximately λ/4.

On the other hand, by shortening the second antenna element 122, it is possible to dispose the second antenna element 122 within the range opposing the parasitic element 110 without extending the second antenna element 122 in the width direction. For example, as shown in FIG. 1, even if the second antenna element 122 extends only in the length direction of the antenna apparatus 100, it is possible to dispose the second antenna element 122 within the range opposing the parasitic element 110. For this reason, it is possible to make the width of the antenna apparatus 100 significantly smaller than λ/4.

In addition, the power feeding portion 123 is connected to any side of the first antenna element 121. In the present example, the power feeding portion 123 is connected to a short side of the first antenna element 121. The power feeding portion 123 is preferably connected near the center of the side of the first antenna element 121. As a result, the current distribution in the width direction of the first antenna element 121 is cancelled out, and thus it is possible to reduce unnecessary cross polarization components in the antenna apparatus 100 and to improve communication quality. In addition, by reducing the cross polarization components, it is possible to improve the FB ratio (front-to-back ratio) of the antenna apparatus 100 and to reduce the SAR. In addition, by reducing the cross polarization components, it is possible to reduce frequency dependence of the radiation pattern.

First Example

Figure 2:
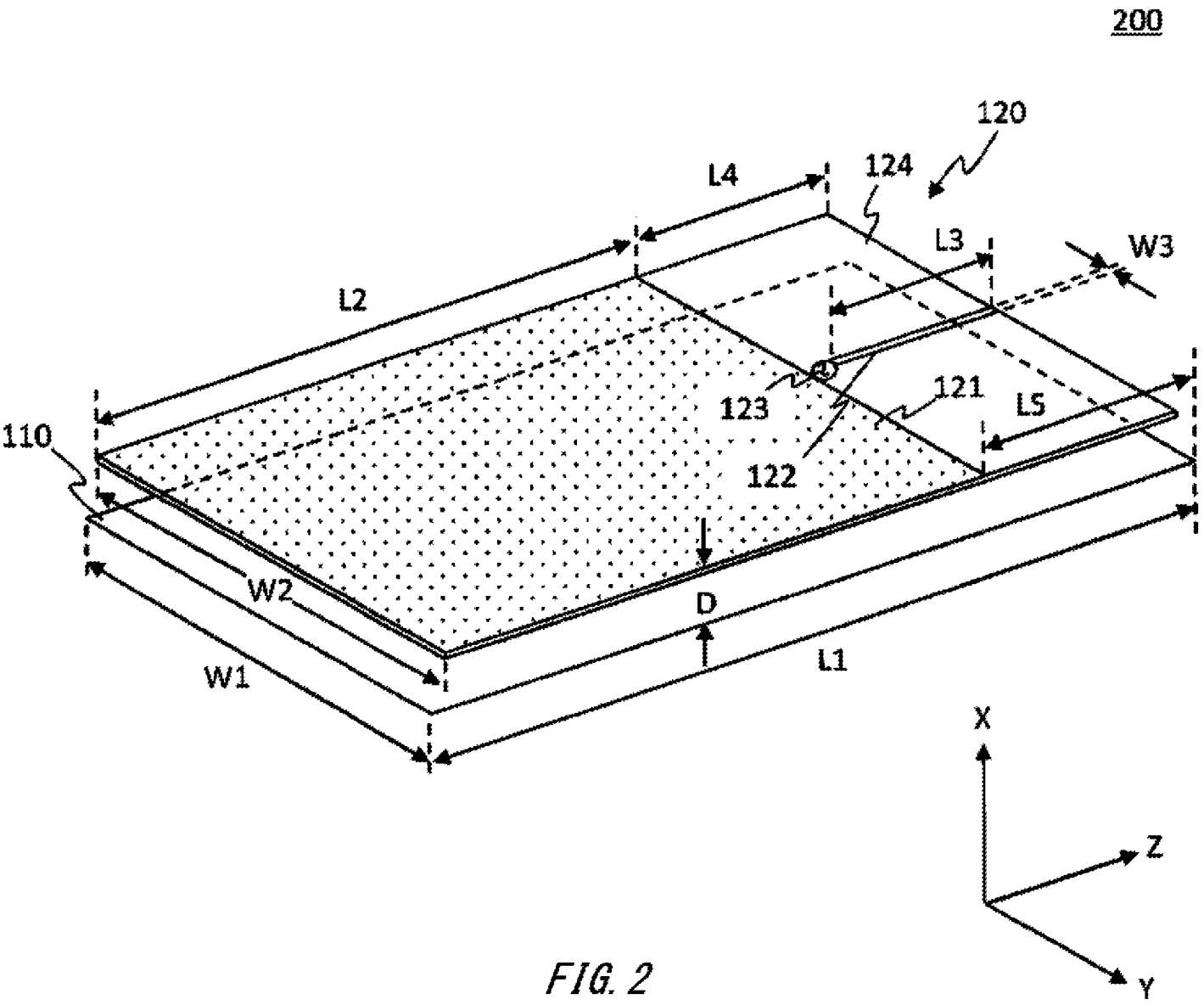
FIG. 2 is a perspective diagram showing an outline of an antenna apparatus 200 according to the first example.

FIG. 2 is a perspective diagram showing an outline of an antenna apparatus 200 according to the first example. The antenna apparatus 200 includes a dielectric substrate 124 in addition to the configuration of the antenna apparatus 100. It is noted that the Y-axis shown in FIG. 2 corresponds to the width direction of the components, the Z-axis corresponds to the length direction, and the X-axis corresponds to the thickness direction. In addition, the long side direction of the first antenna element 121 corresponds to the Z-axis, and the short side direction corresponds to the Y-axis.

The antenna portion 120 is formed on the front surface of the dielectric substrate 124. In addition, the parasitic element 110 is disposed on the back surface side of the dielectric substrate 124. The parasitic element 110 may be provided distanced from the back surface of the dielectric substrate 124 (that is, the surface of the opposite side of the surface on which the antenna portion 120 is provided) and may be provided on the back surface. When the parasitic element 110 is provided on the back surface of the dielectric substrate 124, the thickness of the dielectric substrate 124 is equivalent to a distance D between the antenna portion 120 and the parasitic element 110. It is noted that as the thickness of the dielectric substrate 124 is increased, the element length can be shortened by the wavelength shortening effect. However, the weight of the dielectric substrate 124 increases according to the thickness. The thickness of the dielectric substrate 124 may be determined in consideration of such a trade-off. In the first example to the fifth example, the thickness of the dielectric substrate is 0.5 mm.

In addition, the dielectric substrate 124 may be a multilayer circuit board formed of glass epoxy resin or the like. The dielectric substrate 124 may contain bubbles inside. The multilayer circuit board is provided with an electrical circuit such as a radio circuit of the antenna apparatus 200 or the mobile terminal. Any layer of the multilayer circuit board may be provided with a ground layer covering almost the entire surface. However, in the multilayer circuit board, the electrical circuit including the ground layer or the like is not disposed in the region overlapping with the region in which the second antenna element 122 is disposed. In the antenna apparatus 200, the ground layer may be used as the first antenna element 121. In this case, the first antenna element 121 functions as the ground of the antenna portion 120. Therefore, the antenna portion 120 operates as a monopole antenna in which the first antenna element 121 is the ground and power is fed from the power feeding portion 123 to the second antenna element 122. However, since the antenna current also flows to the first antenna element 121 that is the ground, the same function as when the antenna portion 120 is a dipole antenna is achieved. According to the present example, since the antenna apparatus 200 and the electrical circuit can be integrated, it is possible to reduce the size, thickness, and weight of the mobile terminal.

In addition, the length of the parasitic element 110 is L1, the length of the first antenna element 121 is L2, the length of the second antenna element 122 is L3, the sum of the lengths of the power feeding portion 123 and the second antenna element 122 is L4, the distance on the Y-axis between the end portion of the first antenna element 121 and the end portion of the parasitic element 110 is L5, the width of the parasitic element 110 is W1, the width of the first antenna element 121 is W2, the width of the second antenna element 122 is W3, and the distance between the first antenna element 121 and the parasitic element 110 is D. The second antenna element 122 extends in the Z-axis direction from the center of a specific side of the first antenna element 121. The lengths and the like of the parts of the antenna apparatus 200 are set such that they resonate at a frequency of 2 GHz. It is noted that the wavelength corresponding to the frequency of 2 GHz is 150 mm.

In the present example, L1=85 mm (0.57λ), L2=60 mm (0.4λ), L3=20 mm (0.13λ), L4=21 mm (0.14λ), L5=23 mm (0.15λ), W1=W2=50 mm (0.33λ), W3=1 mm (0.007λ), and D=5 mm (0.03λ). In addition, the relative dielectric constant of the dielectric substrate 124 is 4.4, and the thickness is 0.5 mm (0.003λ). In addition, the first antenna element 121 and the second antenna element 122 are copper foil, and the thicknesses are negligibly small. The first antenna element 121 and the second antenna element 122 have a distance of about 1 mm, and the power feeding portion 123 is disposed therebetween. It is noted that no impedance matching circuit is used.

Figure 3A:
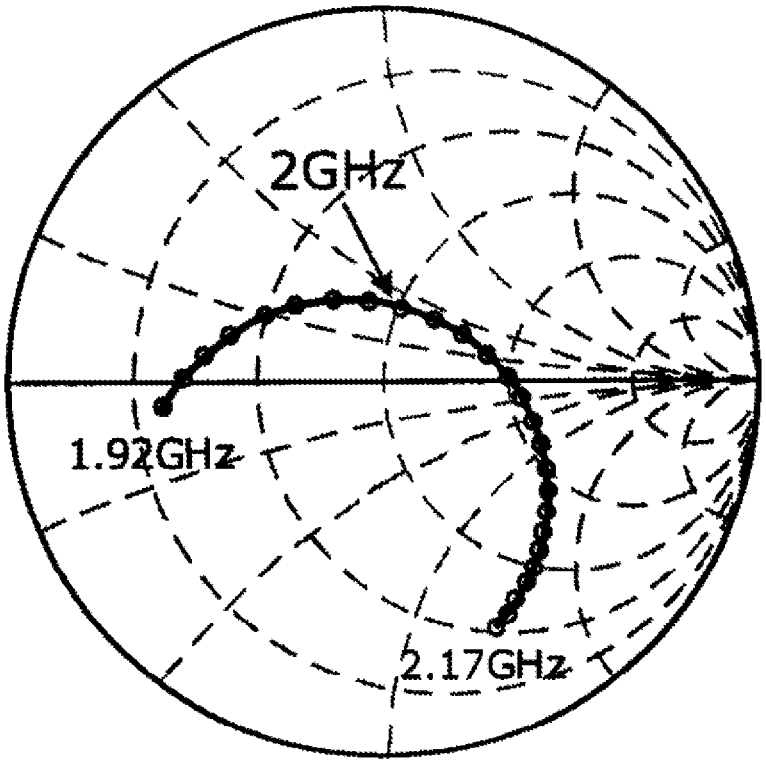
FIG. 3A is a Smith chart showing an input impedance characteristic of the antenna apparatus 200.
Figure 3B:
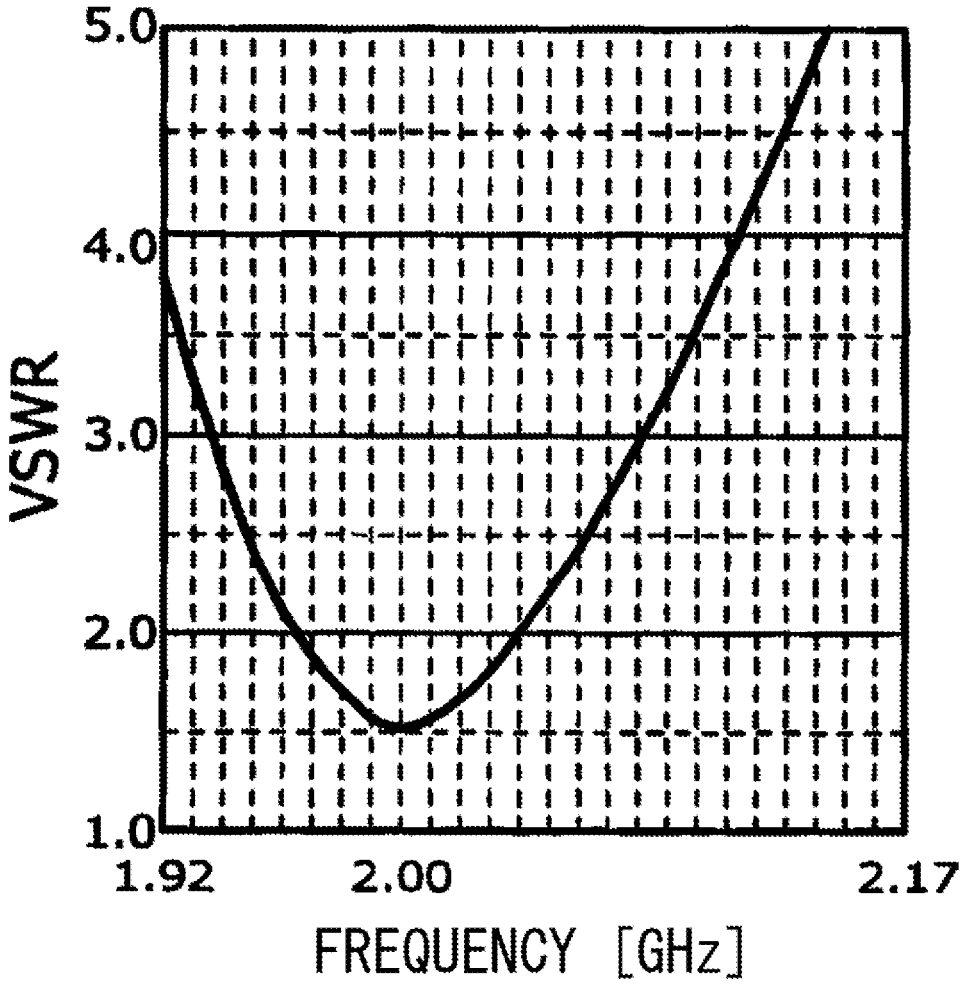
FIG. 3B is a diagram showing the VSWR (voltage standing wave ratio) characteristic of the antenna apparatus 200.
Figure 3C:
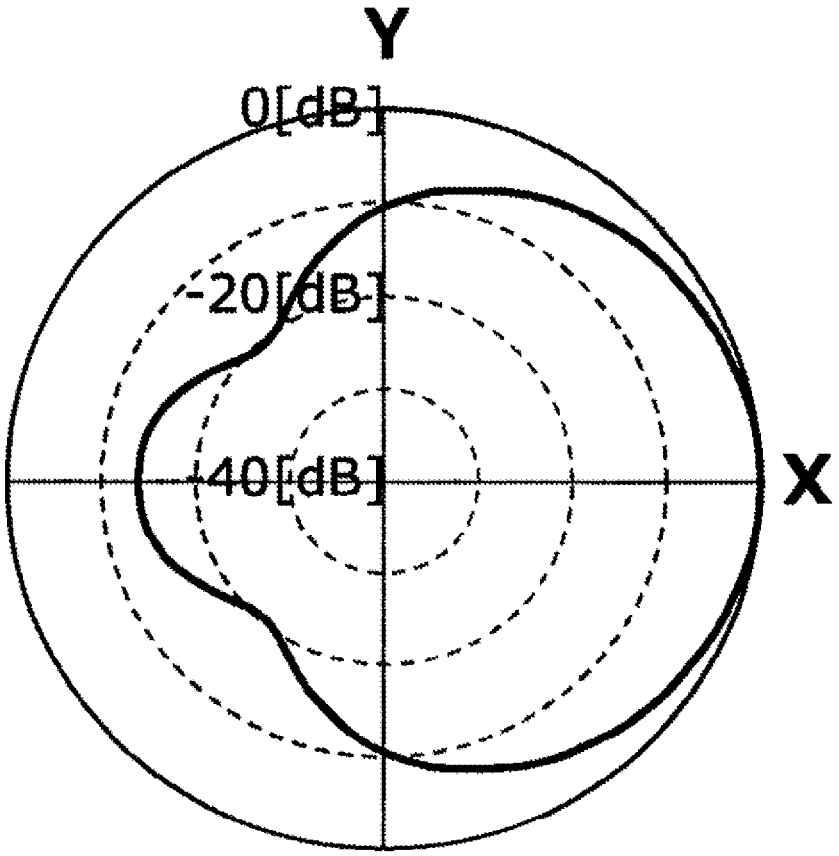
FIG. 3C is a diagram showing a radiation pattern on the XY plane of the antenna apparatus 200.

FIG. 3A is a Smith chart showing an input impedance characteristic of the antenna apparatus 200. FIG. 3B is a diagram showing a VSWR (voltage standing wave ratio) characteristic of the antenna apparatus 200. FIG. 3C is a diagram showing a radiation pattern on the XY plane of the antenna apparatus 200 at a frequency of 2 GHz. The radiation pattern in FIG. 3C is normalized with the maximum value.

As shown in FIG. 3A and FIG. 3B, by the structure shown in FIG. 2, the antenna portion 120 and the parasitic element 110 are electromagnetically coupled and resonate at a center frequency of 2 GHz. In addition, since the parasitic element 110 operates as a reflector, as shown in FIG. 3C, it is possible to make the radiation pattern intensity on the parasitic element 110 side (X-axis negative side) smaller than the radiation pattern intensity on the X-axis positive side. For this reason, the SAR can be reduced.

In this way, according to the present example, the antenna portion 120 resonates at a specific frequency due to its electromagnetic coupling with the parasitic element 110. In addition, the parasitic element 110 can function as a reflector.

Figure 4:
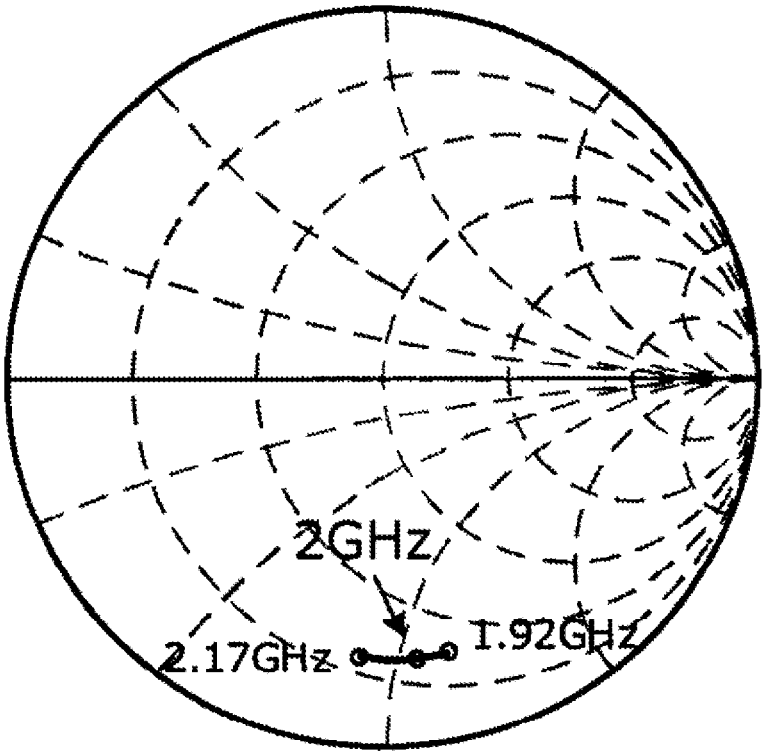
FIG. 4 is a Smith chart showing an input impedance characteristic of the antenna portion 120 alone from which the parasitic element 110 has been removed from the antenna apparatus 200.

FIG. 4 is a Smith chart showing an input impedance characteristic of the antenna portion 120 alone from which the parasitic element 110 has been removed in the antenna apparatus 200. In the present example, the antenna portion 120 is not electromagnetically coupled with the parasitic element 110 and does not resonate at a center frequency of 2 GHz.

Second Example

Figure 5:
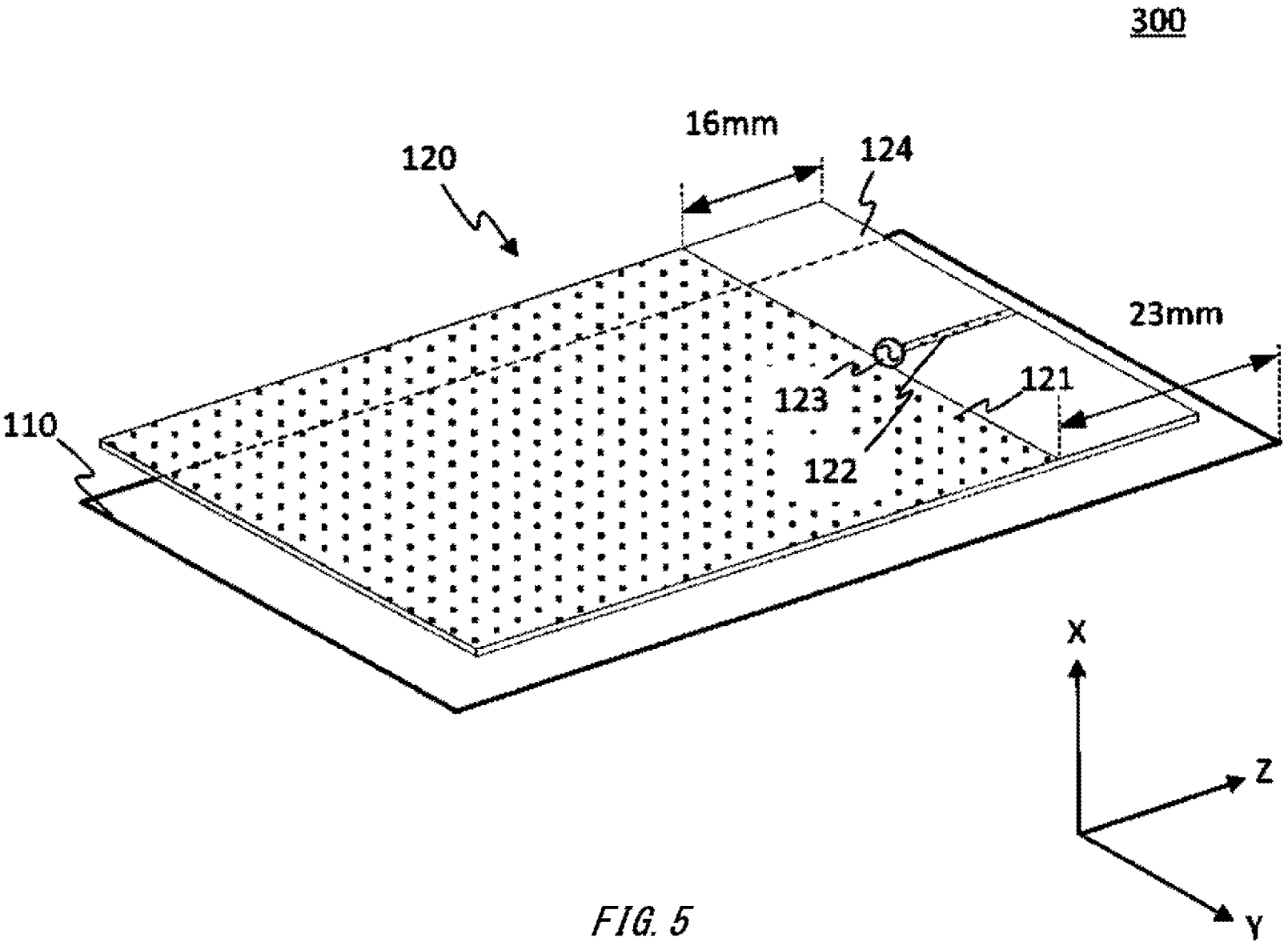
FIG. 5 is a perspective diagram showing an outline of an antenna apparatus 300 according to the second example.

FIG. 5 is a perspective diagram showing an outline of an antenna apparatus 300 according to the second example. The antenna apparatus 300 has the same structure as the antenna apparatus 200 except that L4=16 mm (that is, the length L3 of the second antenna element 122=15 mm (0.1λ)). In the antenna apparatus 300, the end portion of the second antenna element 122 is disposed 7 mm more inward than the end portion of the parasitic element 110 in the Z-axis direction.

Third Example

Figure 6:
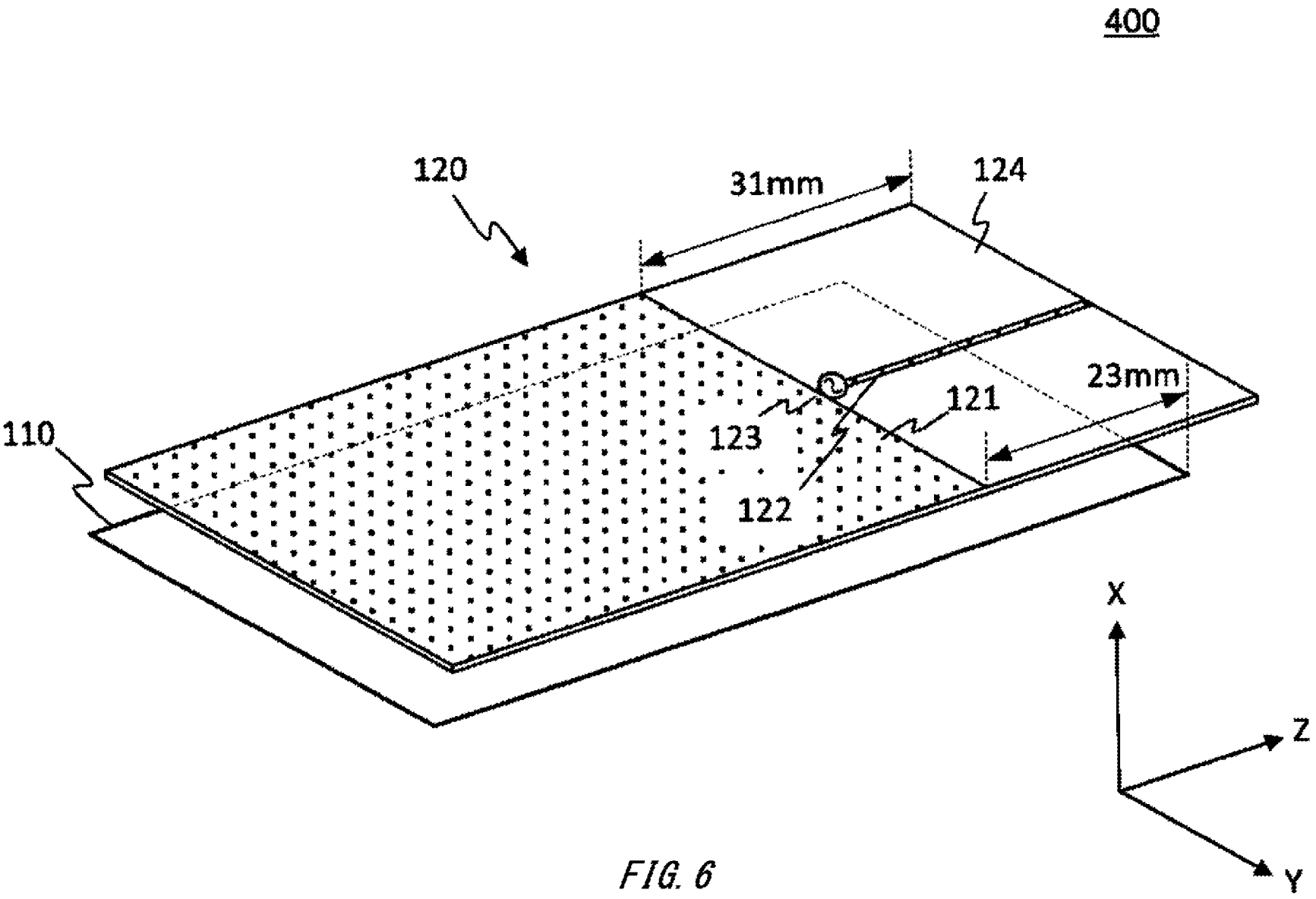
FIG. 6 is a perspective diagram showing an outline of an antenna apparatus 400 according to the third example.

FIG. 6 is a perspective diagram showing an outline of an antenna apparatus 400 according to the third example. The antenna apparatus 400 has the same structure as the antenna apparatus 300 except that L4=31 mm (that is, the length L3 of the second antenna element 122=30 mm (0.2λ)). In the antenna apparatus 400, the end portion of the second antenna element 122 is disposed 8 mm more outward than the end portion of the parasitic element 110 in the Z-axis direction.

Figure 7A:
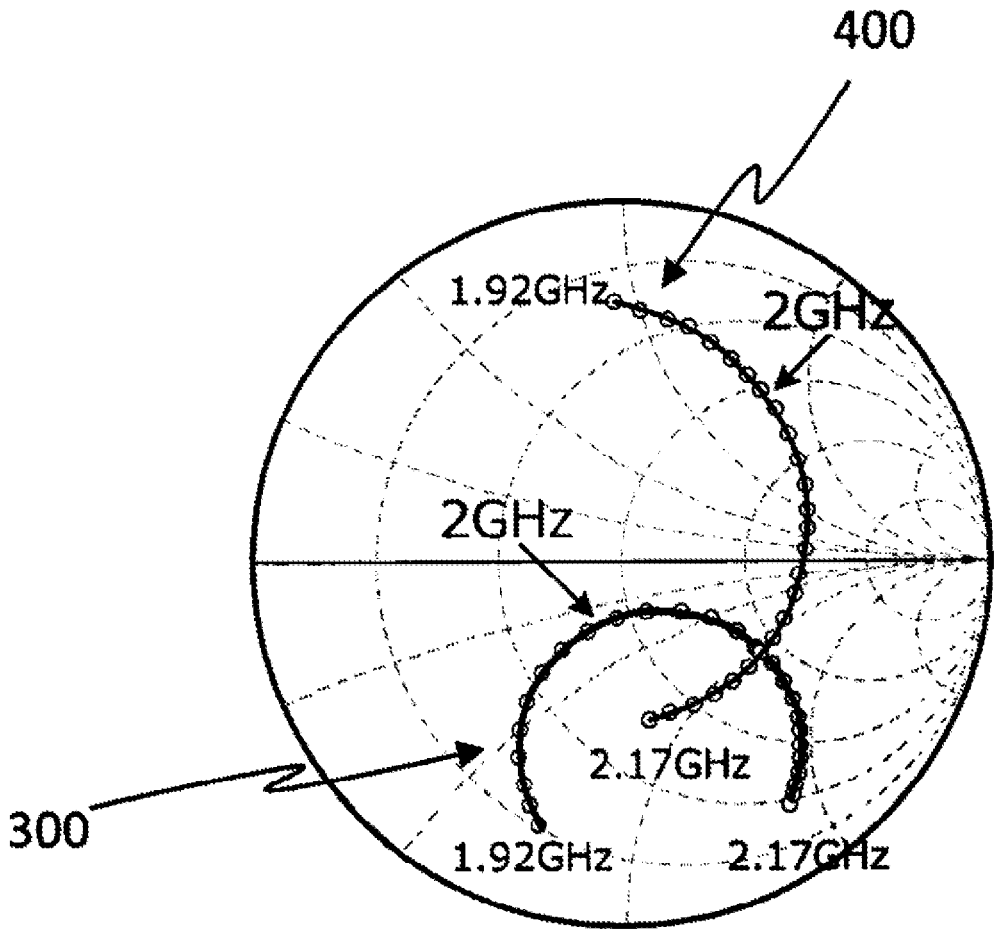
FIG. 7A is a Smith chart showing input impedance characteristics of the antenna apparatus 300 and the antenna apparatus 400.

FIG. 7A is a Smith chart showing input impedance characteristics of the antenna apparatus 300 and the antenna apparatus 400. When the impedance is further matched at a frequency of 2 GHz, a series inductor may be loaded as a matching circuit for the antenna apparatus 300, and a series capacitor may be loaded as a matching circuit for the antenna apparatus 400.

Figure 7B:
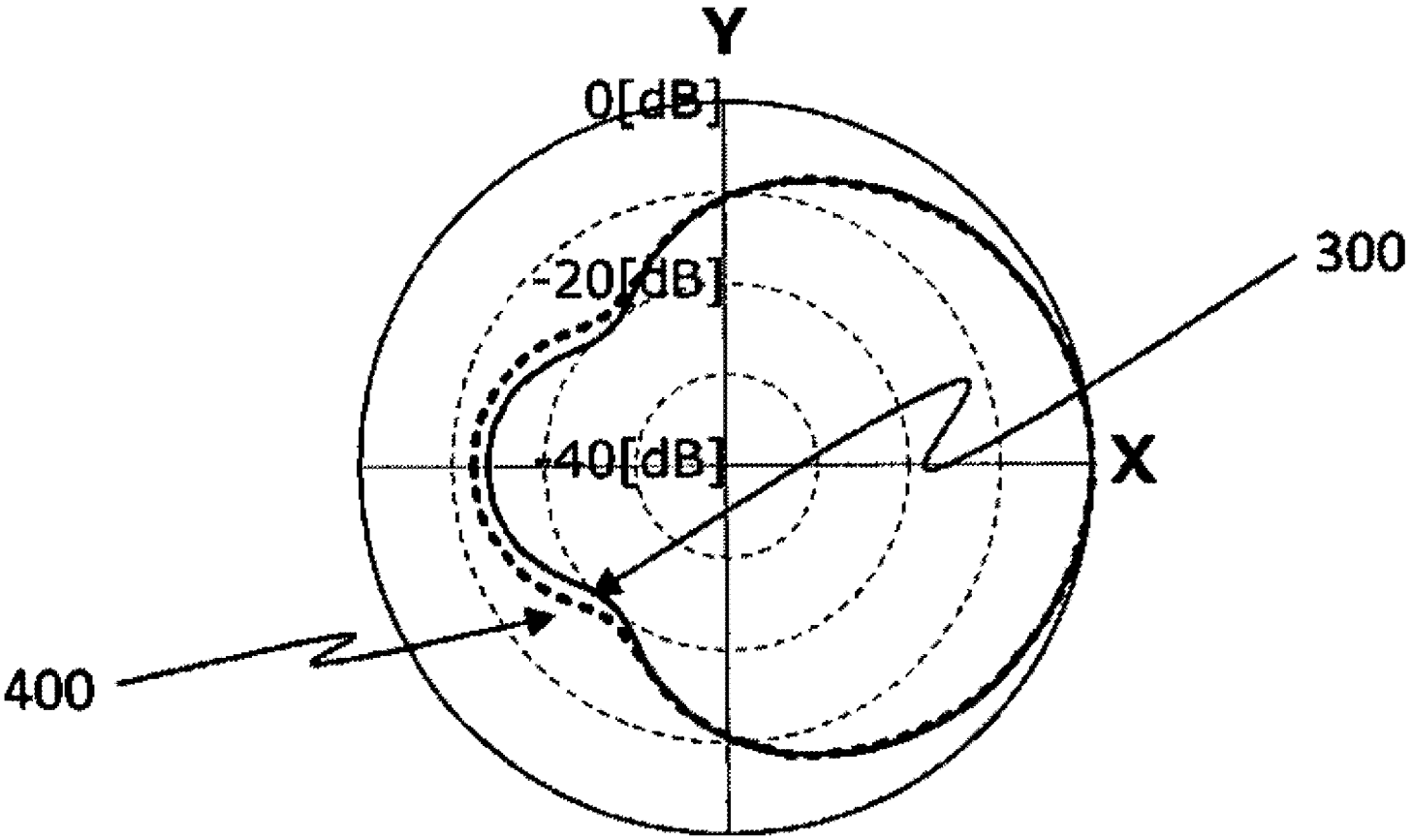
FIG. 7B is a diagram showing radiation patterns on the XY plane of the antenna apparatus 300 and the antenna apparatus 400.

FIG. 7B is a diagram showing radiation patterns on the XY plane of the antenna apparatus 300 and the antenna apparatus 400 at a frequency of 2 GHz. The radiation patterns in FIG. 7B are normalized with the maximum value of each radiation pattern. The antenna apparatus 300 in which the length of the second antenna element 122 is shortened is smaller in size than the antenna apparatus 400, and it is possible to improve the FB ratio as shown in FIG. 7B.

Figure 8:
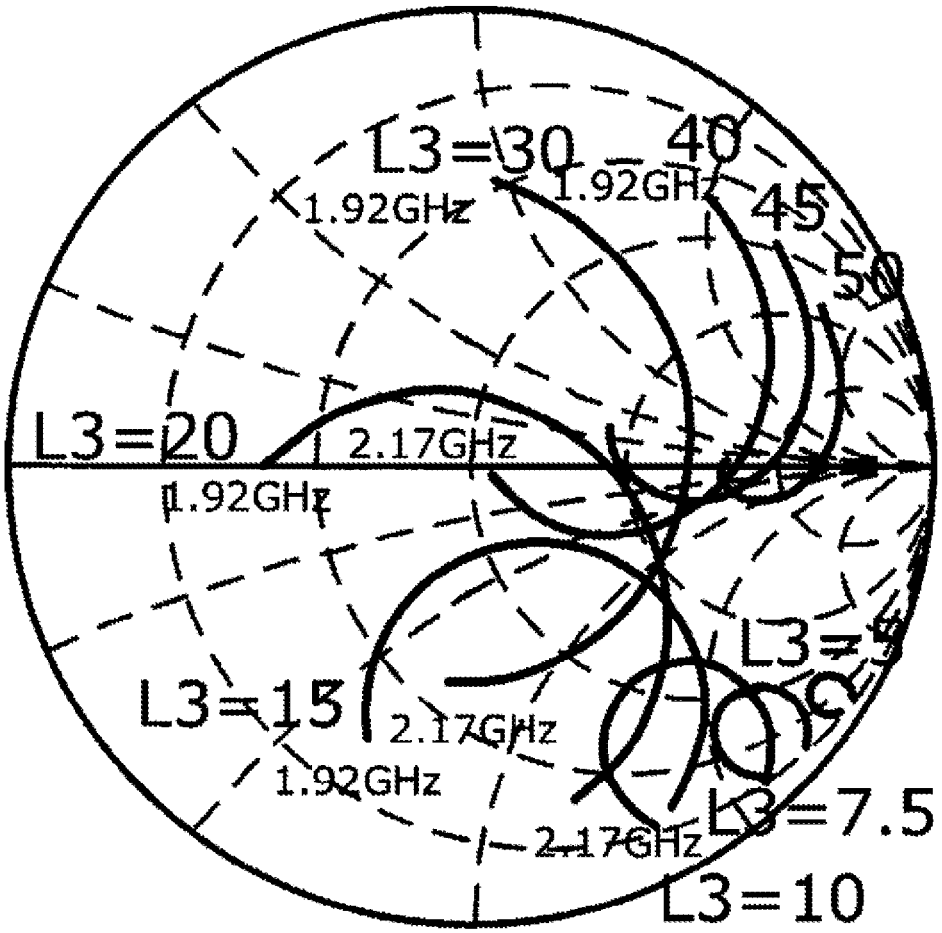
FIG. 8 is a Smith chart showing input impedance characteristics of when the length L3 of the second antenna element 122 is changed in the antenna apparatus 200 shown in FIG. 2.

FIG. 8 is a Smith chart showing input impedance characteristics of when the length L3 of the second antenna element 122 is changed in the antenna apparatus 200 shown in FIG. 2. In the present example, input impedance characteristics at frequencies ranging from 1.92 GHz to 2.17 GHz are shown. In addition, L3 was changed to 50 mm, 45 mm, 40 mm, 30 mm, 20 mm, 15 mm, 10 mm, 7.5 mm, and 5 mm.

As shown in FIG. 8, by changing the length L3 of the second antenna element 122, it can be seen that knot-like kinks appear in the locus of the input impedance characteristics. Generally, the length of a second antenna element in a dipole antenna or a monopole antenna is about λ/4 (37.5 mm), but in this case, the input impedance characteristic is formed in the top-right region of the Smith chart.

On the other hand, when the length L3 of the second antenna element 122 is gradually reduced from λ/4, it was found that the kinks became smaller and the bandwidth could be widened. In the antenna apparatus 200, by making the length L3 of the second antenna element 122 smaller than λ/4, it is possible to reduce the size of the antenna apparatus 200 and widen the bandwidth. The length L3 of the second antenna element 122 may be 15 mm (0.1λ) or less, and may be 7.5 mm (0.05λ) or less. The lower limit of the length L3 of the second antenna element 122 may be about 5 mm (0.03λ), and may be smaller than 5 mm.

In addition, the shapes of the kinks may be further adjusted by the distance D between the parasitic element 110 and the antenna portion 120, the width W2 of the first antenna element 121, the length L2 of the first antenna element 121 and the like.

Figure 9:
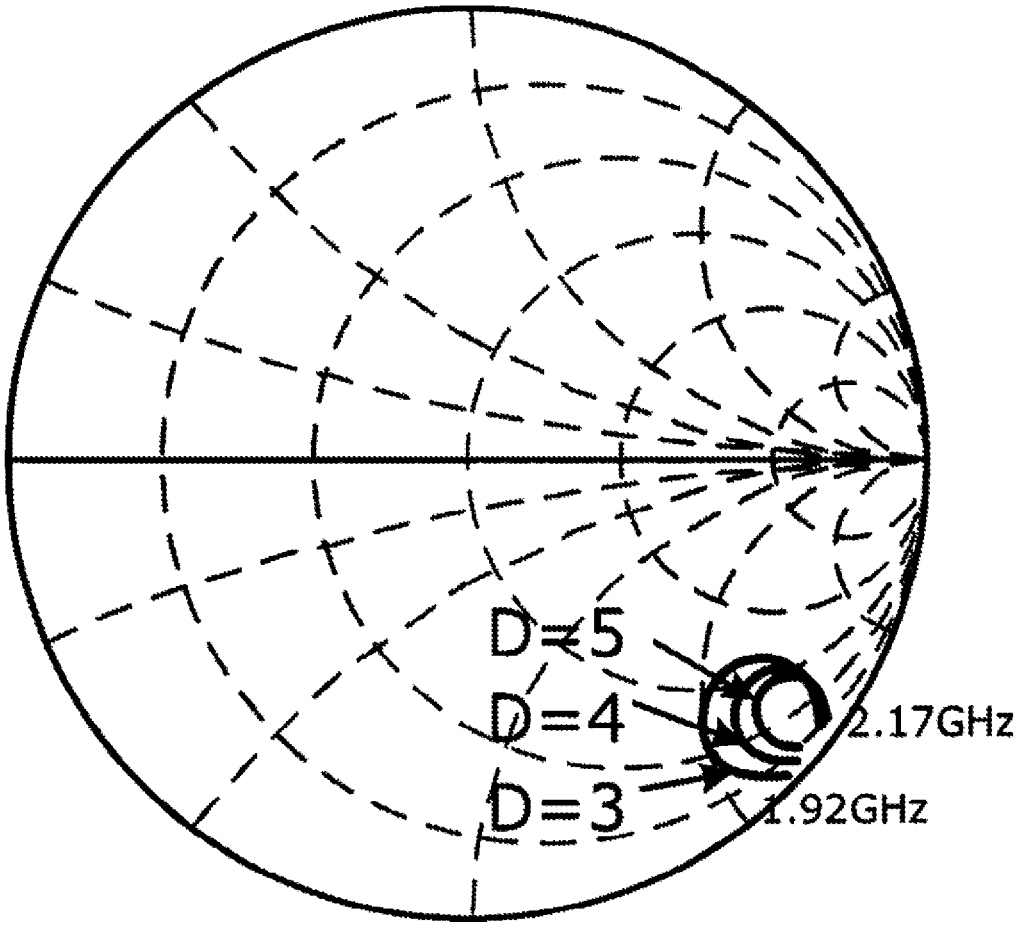
FIG. 9 is a Smith chart showing input impedance characteristics of the antenna apparatus 200 when the distance D between the parasitic element 110 and the antenna portion 120 is changed.

FIG. 9 is a Smith chart showing input impedance characteristics of the antenna apparatus 200 when the distance D between the parasitic element 110 and the antenna portion 120 is changed. In the present example, D is changed to 5 mm, 4 mm, and 3 mm. It is noted that L1=85 mm, L2=60.5 mm, L3=6.5 mm, L4=7.5 mm, W1=W2=50 mm, and W3=1 mm. In addition, the antenna portion 120 is disposed in the center of the parasitic element 110 in the Z-axis direction.

As shown in FIG. 9, as distance D becomes smaller, that is, as the degree of coupling between the antenna portion 120 and the parasitic element 110 increases, the kinks become larger.

Figure 10:
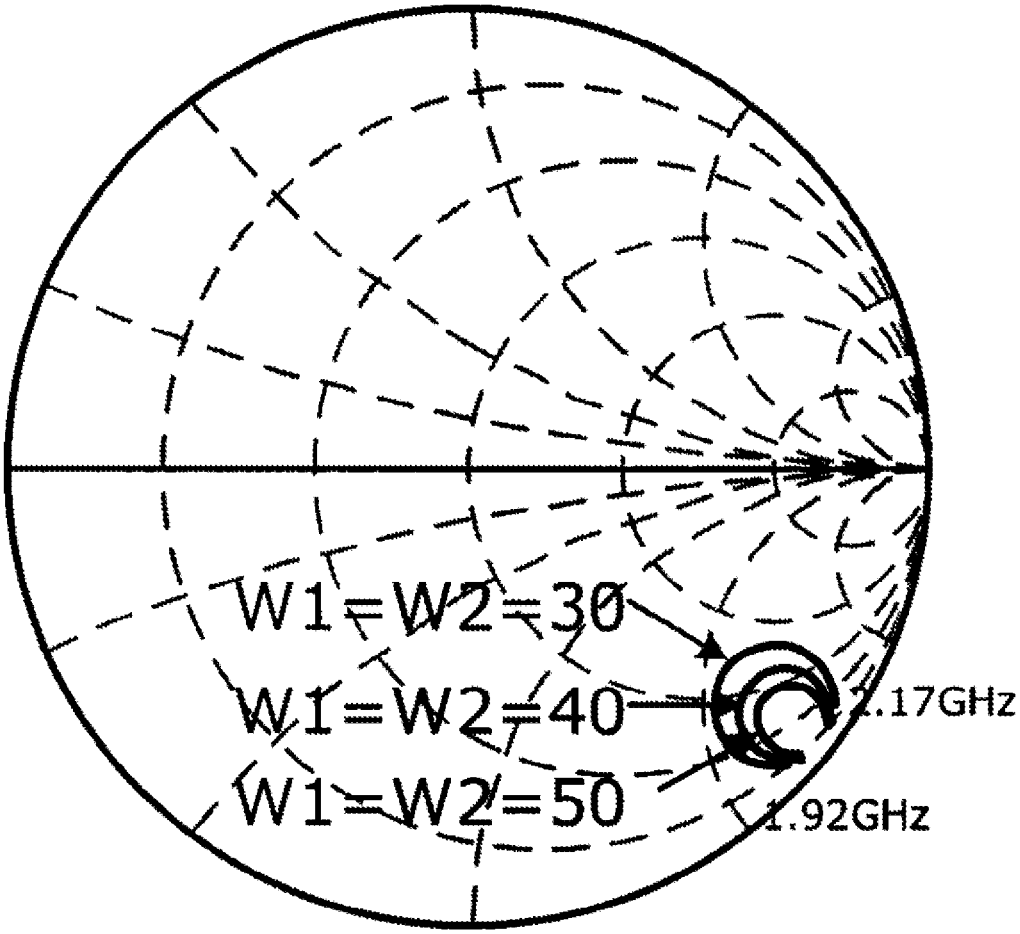
FIG. 10 is a Smith chart showing input impedance characteristics of the antenna apparatus 200 when the width W1 of the parasitic element 110 and the width W2 of the first antenna element 121 are changed.

FIG. 10 is a Smith chart showing input impedance characteristics of the antenna apparatus 200 when the width W1 of the parasitic element 110 and the width W2 of the first antenna element 121 are changed. In the present example, W1=W2 was changed to 30 mm, 40 mm, and 50 mm. It is noted that L1=85 mm, L2=60.5 mm, L3=6.5 mm, L4=7.5 mm, W3=1 mm, and D=5 mm. In addition, the antenna portion 120 is disposed in the center of the parasitic element 110 in the Z-axis direction.

As shown in FIG. 10, as the W1 and W2 increase, the kinks become smaller. That is, as the W1 and W2 increase, the more it is possible to widen the bandwidth. However, even if W1 and W2 are reduced, the kinks do not become very large. In addition, as shown in FIG. 9, by increasing the distance D between the parasitic element 110 and the antenna portion 120, it is possible to compensate for the narrowing of bandwidth due to the reduction of the W1 and W2. Therefore, even if the W1 and W2 are reduced and the antenna apparatus 200 is reduced in size, it is possible to maintain the wide bandwidth of the antenna apparatus 200.

Figure 11:
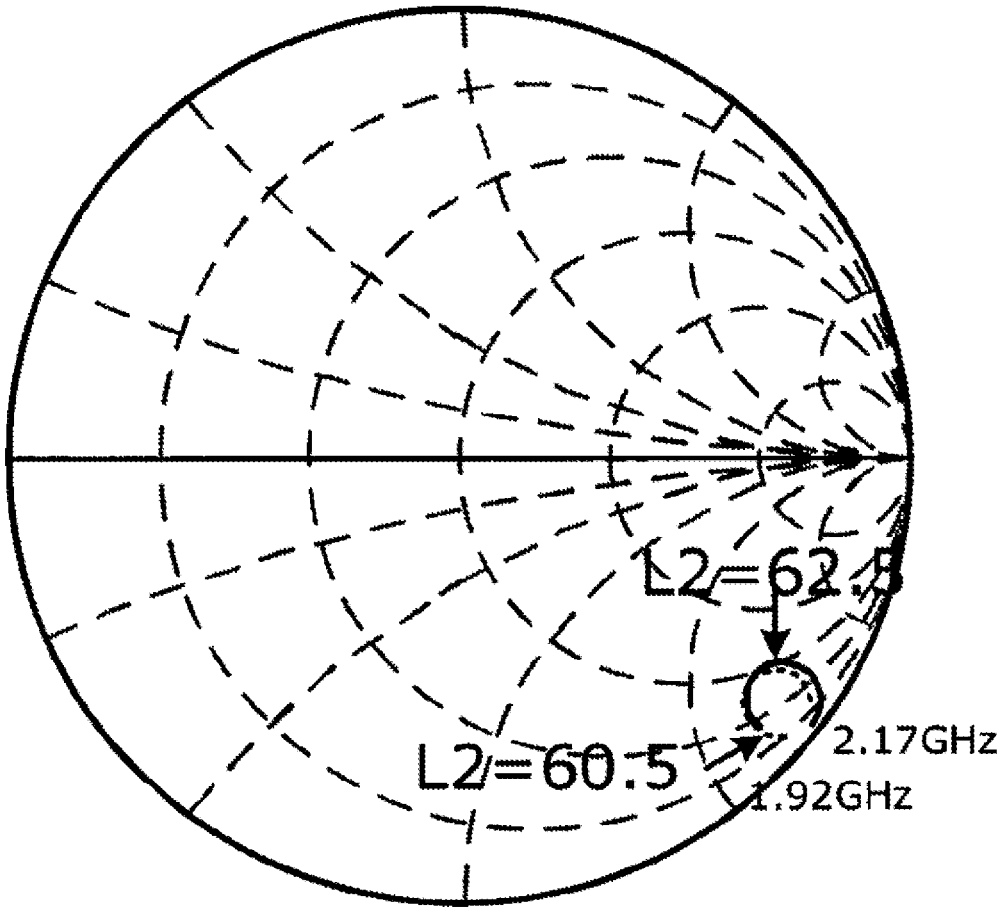
FIG. 11 is a Smith chart showing input impedance characteristics of the antenna apparatus 200 when the length L2 of the first antenna element 121 is changed.

FIG. 11 is a Smith chart showing input impedance characteristics of the antenna apparatus 200 when the length L2 of the first antenna element 121 is changed. In the present example, L2 is changed to 62.5 mm and 60.5 mm. In FIG. 11, the solid line shows an input impedance characteristic when L2=62.5 mm, and the dotted line shows an input impedance characteristic when L2=60.5 mm. It is noted that L1=85 mm, L3=6.5 mm, L4=7.5 mm, W1=W2=50 mm, W3=1 mm, and D=5 mm. In addition, the antenna portion 120 is disposed in the center of the parasitic element 110 in the Z-axis direction.

As shown in FIG. 11, when the L2 is changed, the kink rotates. That is, the resonance frequency of the antenna apparatus 200 changes. In this way, it is possible to adjust the input impedance characteristics of the antenna apparatus 200 by the distance D between the parasitic element 110 and the antenna portion 120, the width W2 of the first antenna element 121, the length L2 of the first antenna element 121, and the like. In addition, by using a matching circuit, it is possible to move the position of the kink near the center of the Smith chart and match the impedance.

Figure 12:
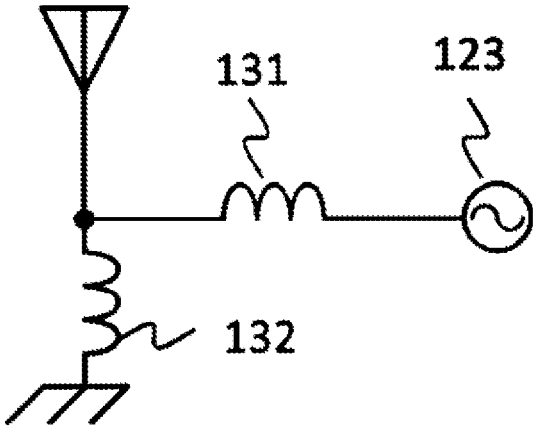
FIG. 12 is a diagram showing an example of a matching circuit.

FIG. 12 is a diagram showing an example of a matching circuit. The matching is obtained by, for example, causing the first antenna element 121 to function as the ground of the antenna portion 120 and loading a series inductor 131 and a parallel inductor 132 between the second antenna element 122 and the power feeding portion 123. The inductors may be chip parts and may be configured by a pattern on a substrate such as a meander or a pattern coil.

Figure 13A:
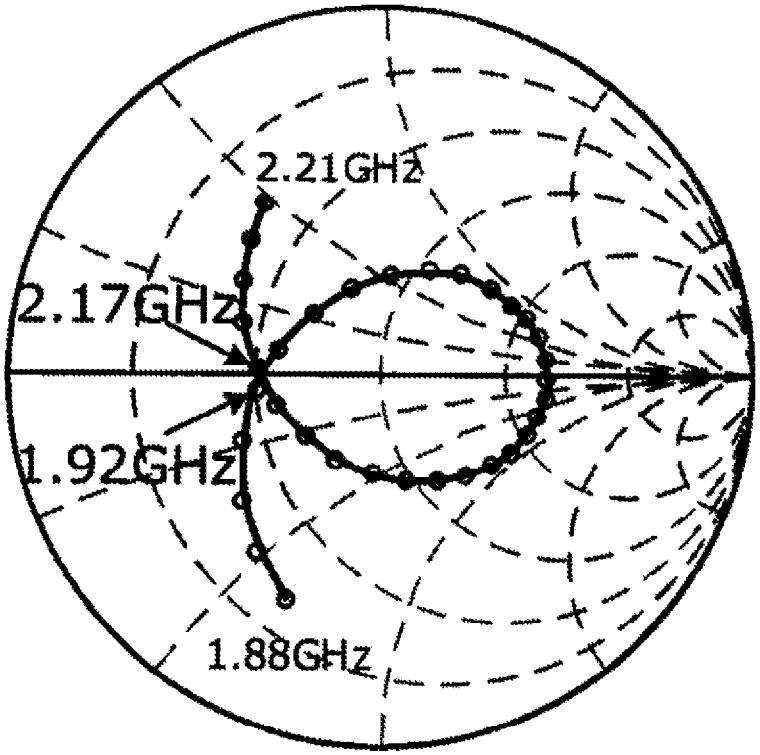
FIG. 13A is a Smith chart showing an input impedance characteristic of the antenna apparatus 200.
Figure 13B:
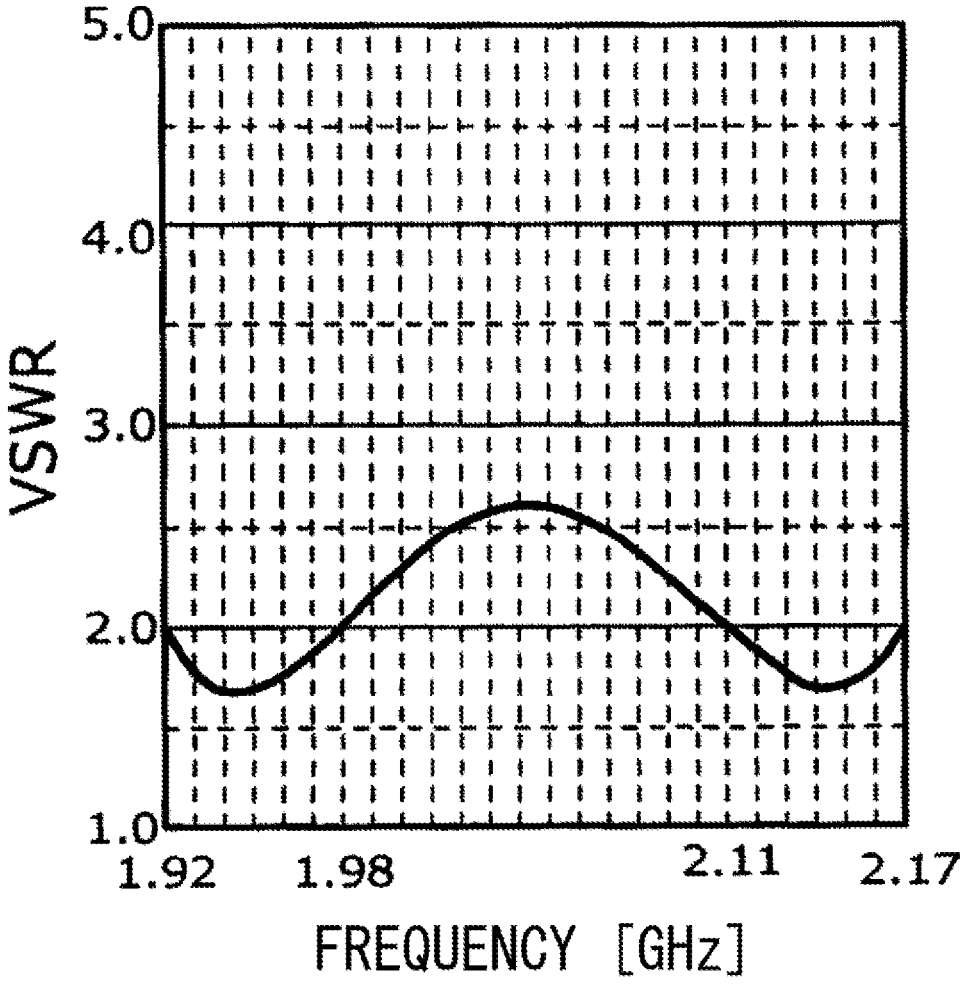
FIG. 13B is a diagram showing a VSWR characteristic of the antenna apparatus 200.
Figure 13C:
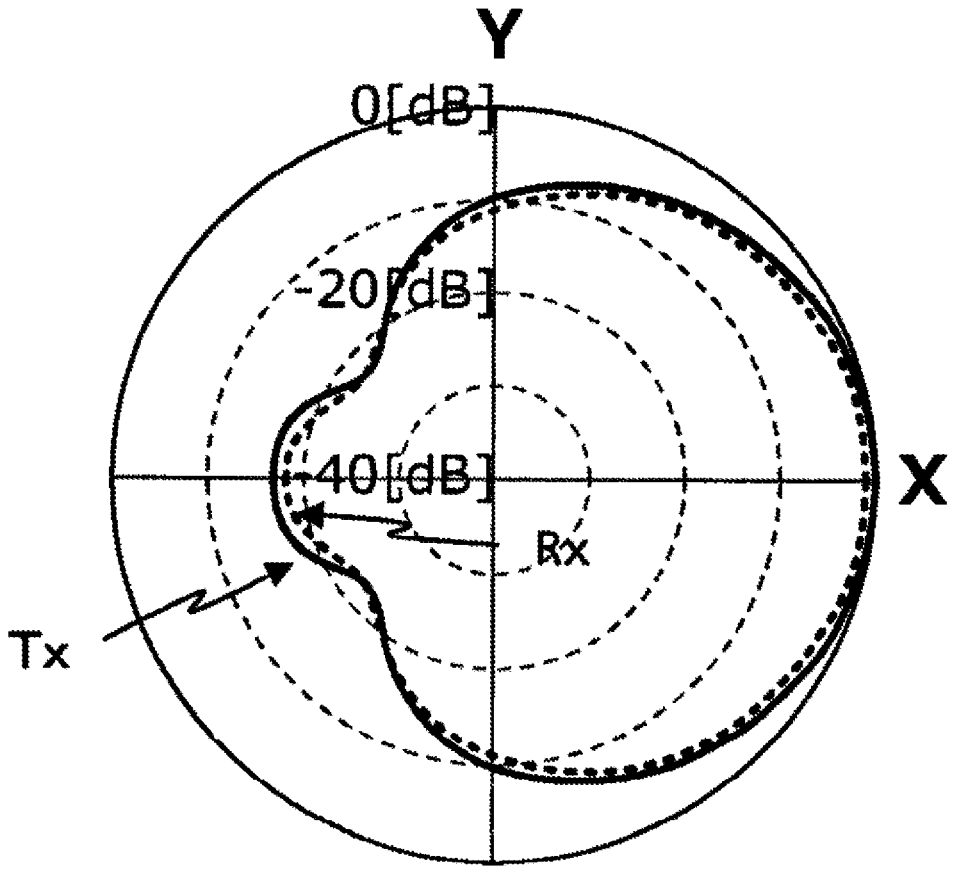
FIG. 13C is a diagram showing radiation patterns on the XY plane of the antenna apparatus 200.

FIG. 13A is a Smith chart showing an input impedance characteristic of the antenna apparatus 200. FIG. 13B is a diagram showing a VSWR characteristic of the antenna apparatus 200. FIG. 13C is a diagram showing radiation patterns on the XY plane of the antenna apparatus 200.

In the example shown in FIG. 13A, FIG. 13B, and FIG. 13C, the method shown in FIG. 8 to FIG. 12 was used to tune the antenna apparatus 200 to UMTS (Universal Mobile Telecommunications System) Band1 (Tx: 1.92-1.98 GHz, Rx: 2.11-2.17 GHz) standardized by the 3GPP (Third Generation Partnership Project). It is noted that L1=85 mm, L2=60.6 mm, L3=6.5 mm, L4=7.5 mm, W1=W2=50 mm, W3=1 mm, D=5 mm, the inductance of the series inductor 131 is 17.3 nH, and the inductance of the parallel inductor 132 is 22 nH. It is noted that the solid line in FIG. 13C is the radiation pattern at a center frequency of 1.95 GHz for transmission (Tx), and the dotted line is the radiation pattern at a center frequency of 2.14 GHz for reception (Rx). However, they are normalized with the maximum values at the frequency of 1.95 GHz.

As shown in FIG. 13A and FIG. 13B, the antenna apparatus 200 resonates at the UMTS Band1. In addition, as shown in FIG. 13C, the radiation patterns of the transmission (Tx) and reception (Rx) of the antenna apparatus 200 are the same. That is, the radiation pattern of the antenna apparatus 200 does not depend on the operating frequency.

In this way, according to the antenna apparatus 200, it is possible to widen the bandwidth while reducing the length L3 of the second antenna element 122 to reduce the size of the apparatus. In addition, since the FB ratio is large, the SAR can be reduced.

Fourth Example

Figure 14:
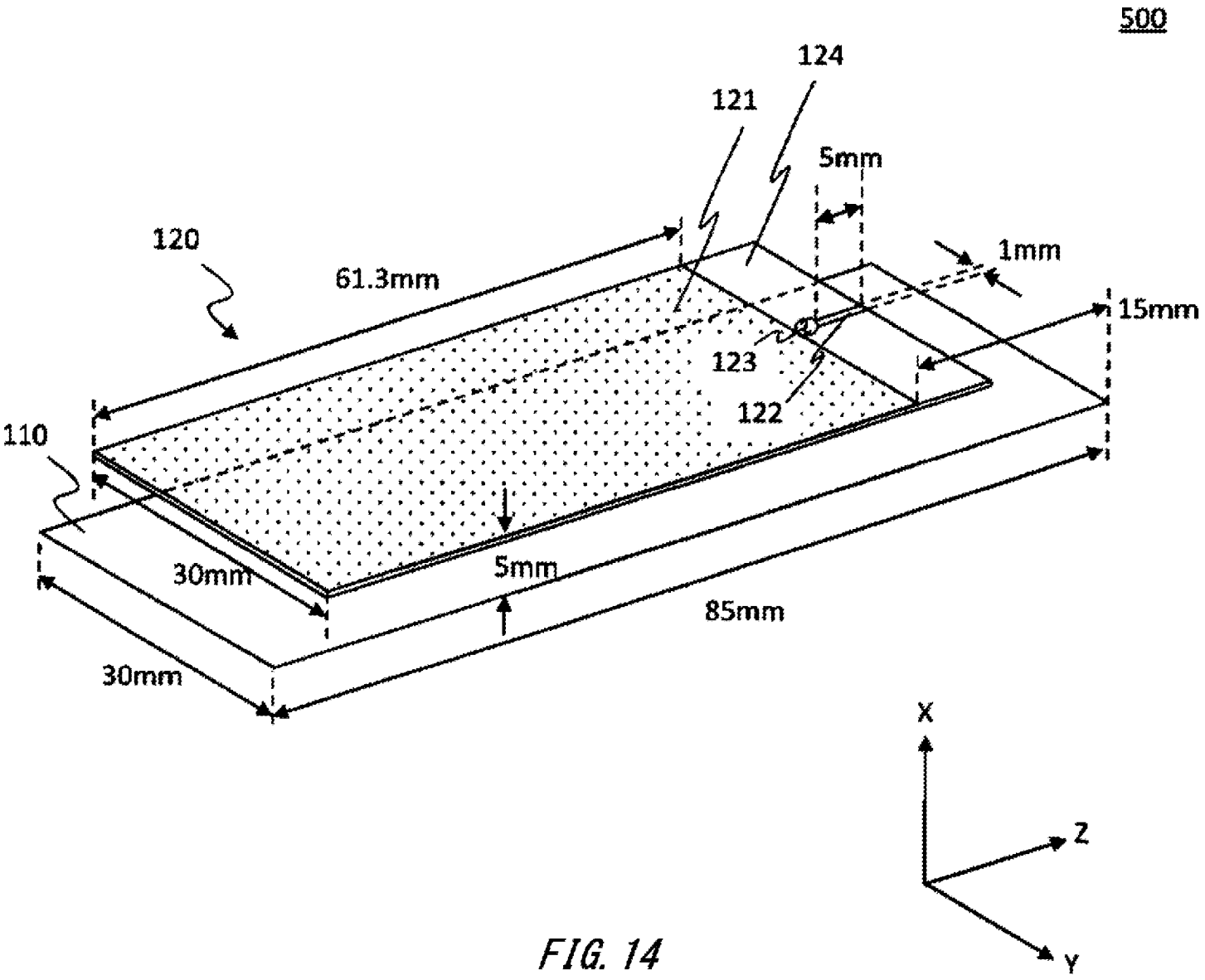
FIG. 14 is a perspective diagram showing an outline of an antenna apparatus 500 according to the fourth example.

FIG. 14 is a perspective diagram showing an outline of an antenna apparatus 500 according to the fourth example. In the antenna apparatus 500 of the present example, the width W1 of the parasitic element 110 and the width W2 of the first antenna element 121 are smaller than in the antenna apparatuses according to the first to third examples. Specifically, W1=W2=30 mm (0.2λ). In addition, L1=85 mm, L2=61.3 mm, L3=5 mm, L4=6 mm, L5=15 mm, W3=1 mm, and D=5 mm. In addition, the inductance of the series inductor 131 is 18.5 nH, and the inductance of the parallel inductor 132 is 47 nH.

Figure 15A:
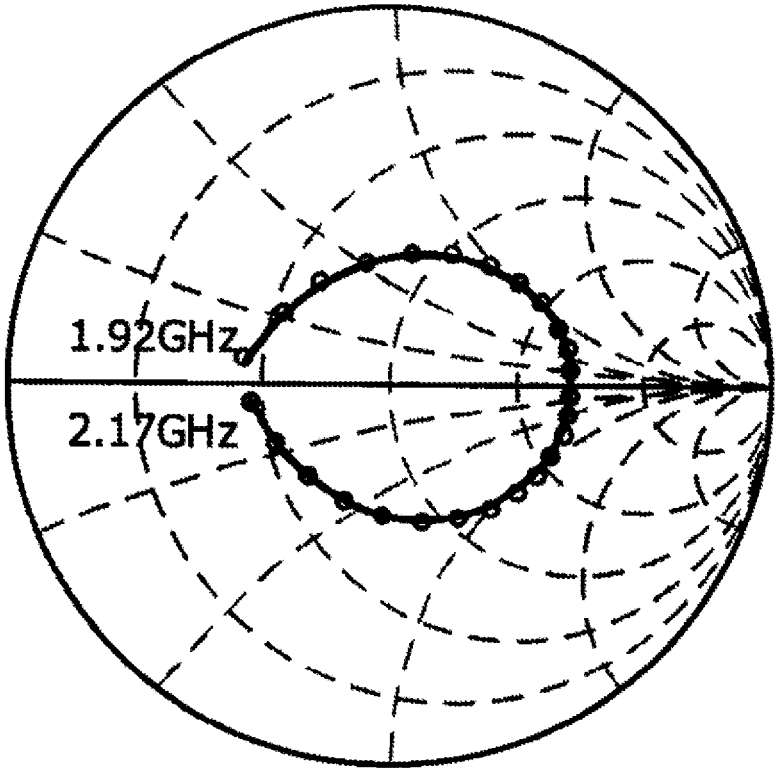
FIG. 15A is a Smith chart showing an input impedance characteristic of the antenna apparatus 500.
Figure 15B:
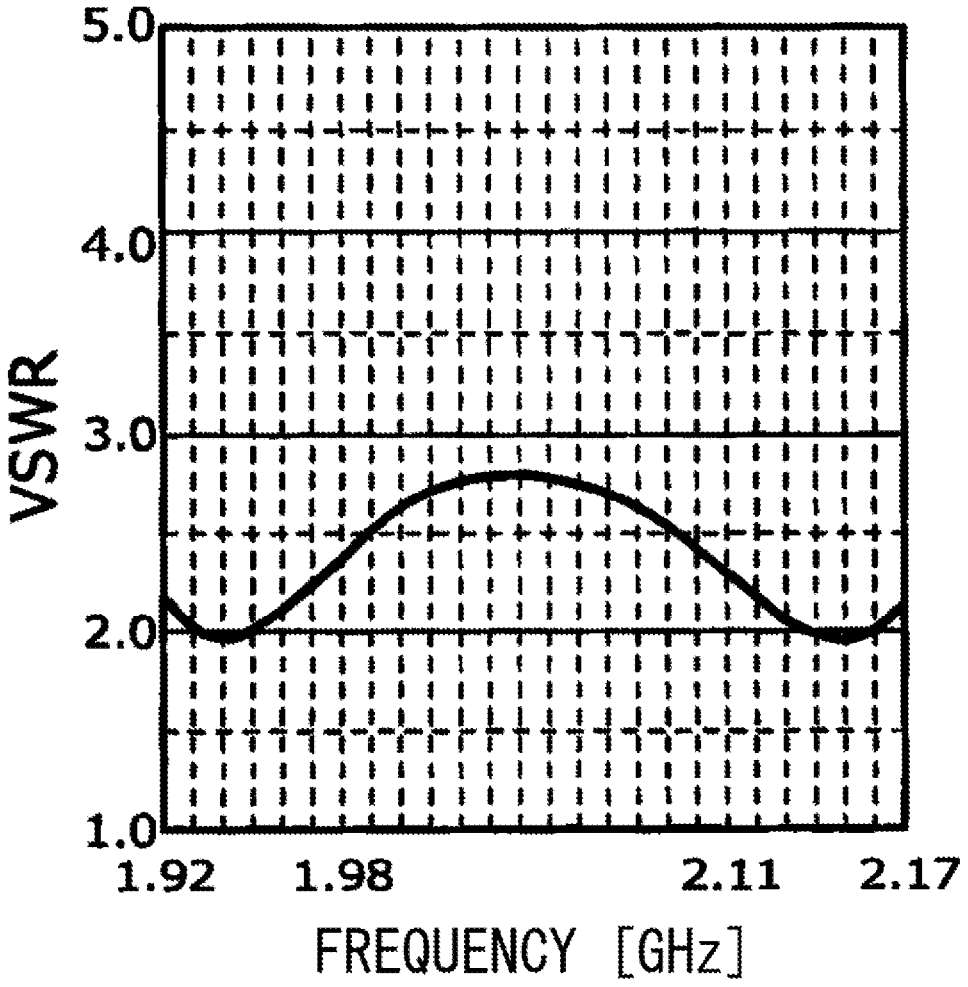
FIG. 15B is a diagram showing a VSWR characteristic of the antenna apparatus 500.
Figure 15C:
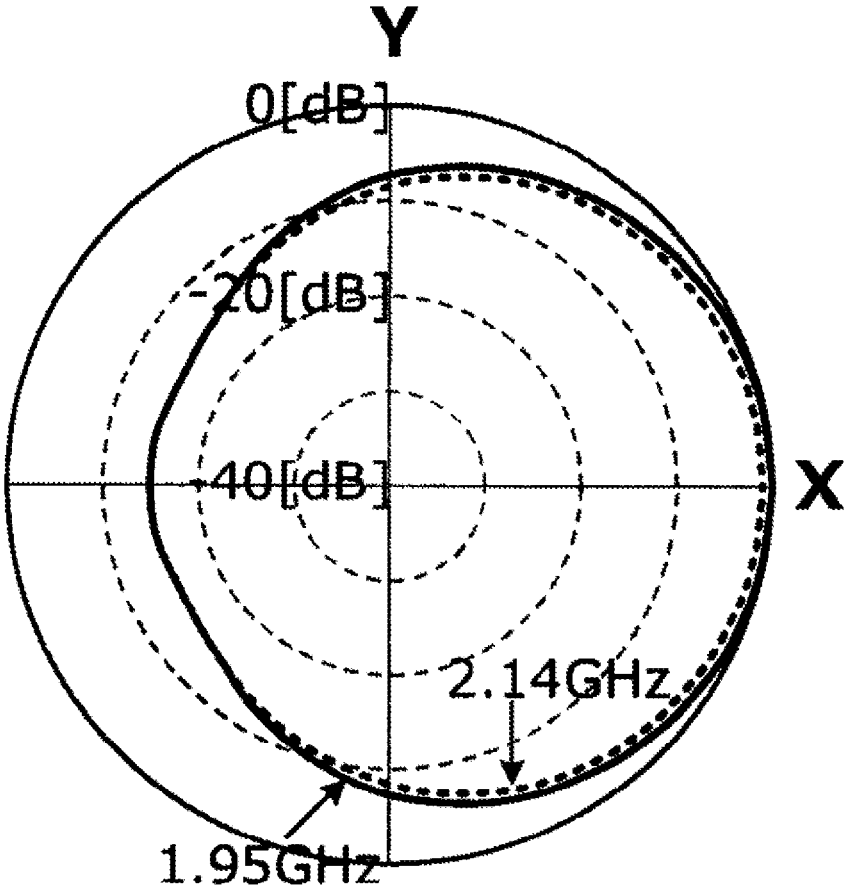
FIG. 15C is a diagram showing radiation patterns on the XY plane of the antenna apparatus 500.

FIG. 15A is a Smith chart showing an input impedance characteristic of the antenna apparatus 500. FIG. 15B is a diagram showing a VSWR characteristic of the antenna apparatus 500. FIG. 15C is a diagram showing radiation patterns on the XY plane of the antenna apparatus 500. In FIG. 15C, the solid line is the radiation pattern at a center frequency of 1.95 GHz for transmission (Tx), and the dotted line is the radiation pattern at a center frequency of 2.14 GHz for reception (Rx). However, they are normalized with the maximum values at the frequency of 1.95 GHz.

As shown in FIG. 15A and FIG. 15B, the antenna apparatus 500 resonates at the UMTS Band1. In addition, although the VSWR characteristic is slightly degraded (narrow-banded) in comparison to the antenna apparatus 200 shown in FIG. 13A and FIG. 13B, there is almost no influence. In addition, as shown in FIG. 9, by widening the distance D between the antenna portion 120 and the parasitic element 110, it is possible to compensate for the degradation of the VSWR characteristic. Therefore, according to the antenna apparatus 500, it is possible to widen the bandwidth while reducing the size of the apparatus.

Comparative Example

Figure 16:
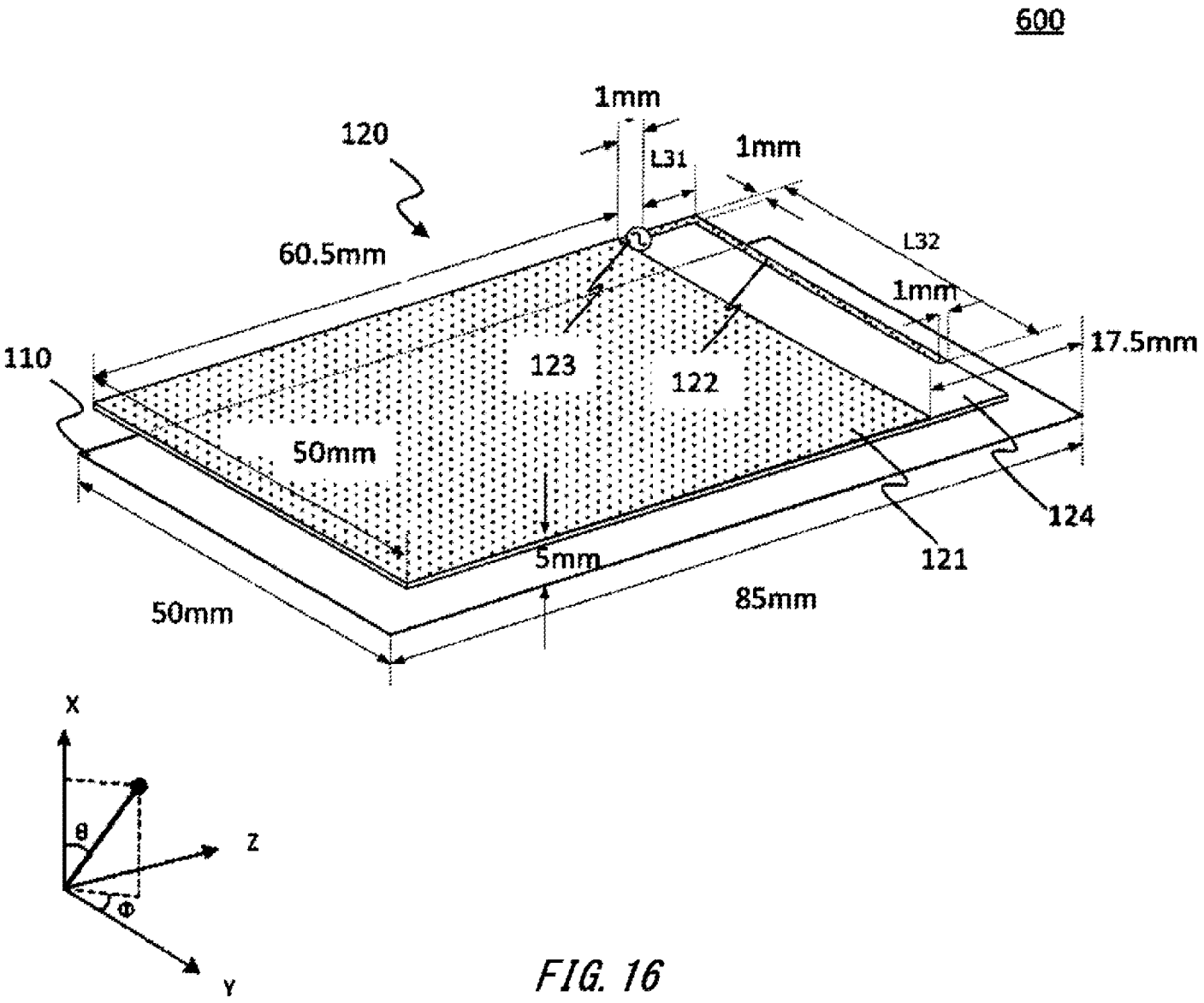
FIG. 16 is a perspective diagram showing an outline of an antenna apparatus 600 according to the comparative example.

FIG. 16 is a perspective diagram showing an outline of an antenna apparatus 600 according to the comparative example. The antenna apparatus 600 includes the antenna portion 120 and the parasitic element 110. However, the second antenna element 122 has an inverted L-shape, and the length L31+L32 is greater than one-fourth of the wavelength λ. The width of the antenna apparatus 600 requires at least the length L32, so it is difficult to reduce the size of the antenna apparatus 600.

In addition, the power feeding portion 123 is connected to the end portion of a specific side of the first antenna element 121. The second antenna element 122, after extending from the power feeding portion 123 in the Z-axis direction, extends in the Y-axis direction. In such a shape, since a current component is generated in the width direction, the cross polarization component of the antenna apparatus 600 increases.

In the present example, L1=85 mm, L2=60.5 mm, L31=9.5 mm, L32=41 mm, L4=10.5 mm, L5=17.5 mm, W1=W2=50 mm, W3=1 mm, and D=5 mm. In addition, as a matching circuit, a 5.5 pF capacitor is loaded in series. It is noted that the antenna apparatus 600 corresponds to the antenna apparatus according to PTL 1.

Figure 17A:
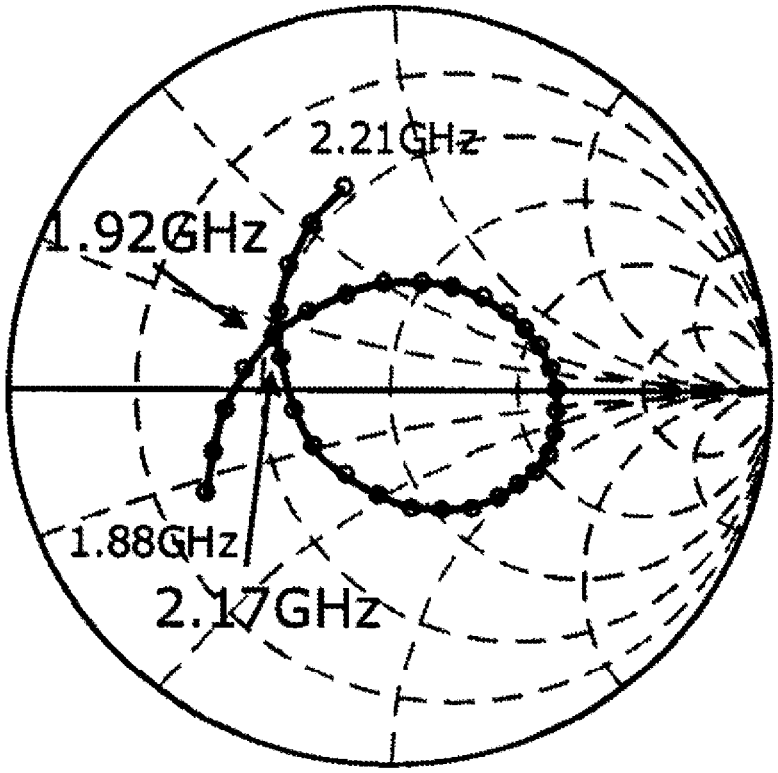
FIG. 17A is a Smith chart showing an input impedance characteristic of the antenna apparatus 600.
Figure 17B:
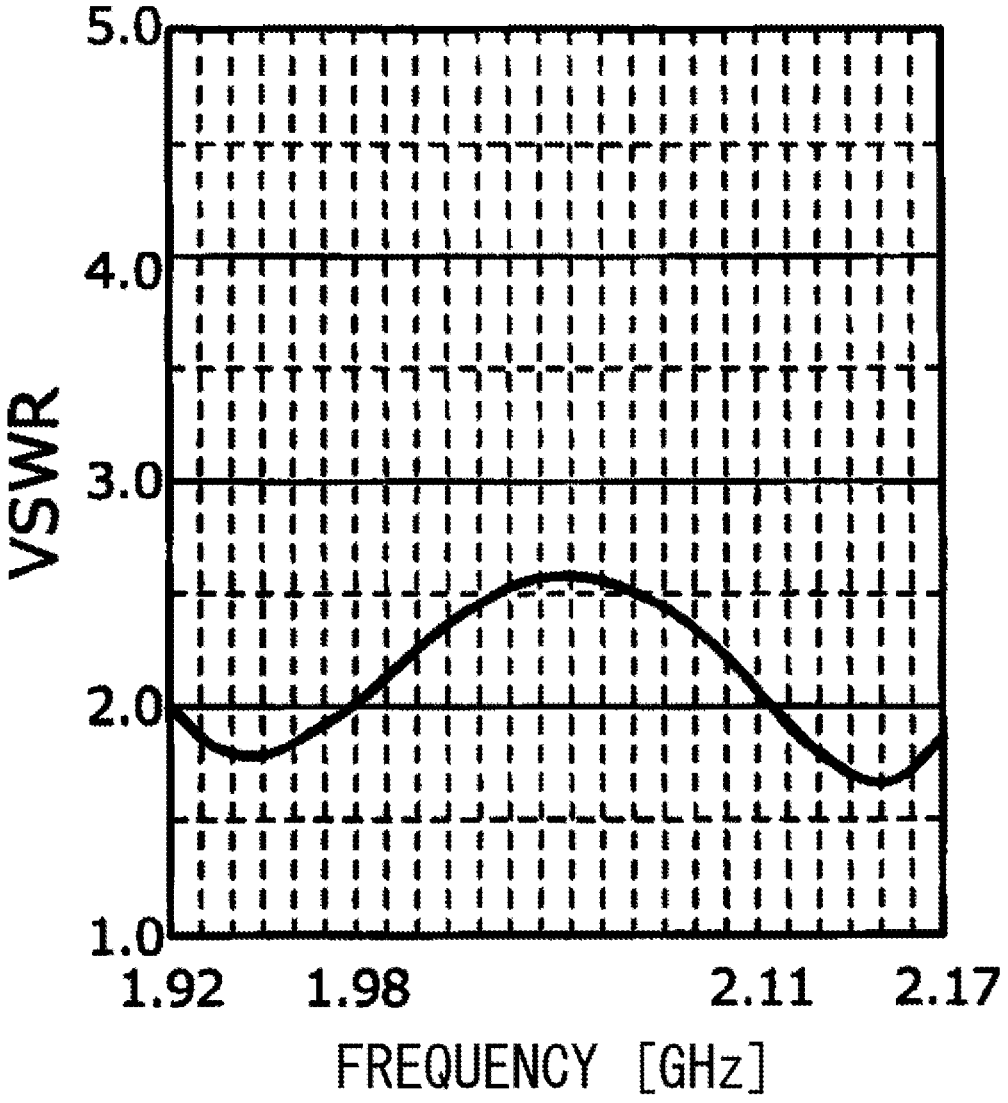
FIG. 17B is a diagram showing a VSWR characteristic of the antenna apparatus 600.

FIG. 17A is a Smith chart showing an input impedance characteristic of the antenna apparatus 600. FIG. 17B is a diagram showing a VSWR characteristic of the antenna apparatus 600. In the antenna apparatus 600, the bandwidth can be widened, but as described above, it is difficult to reduce the size.

Figure 17C:
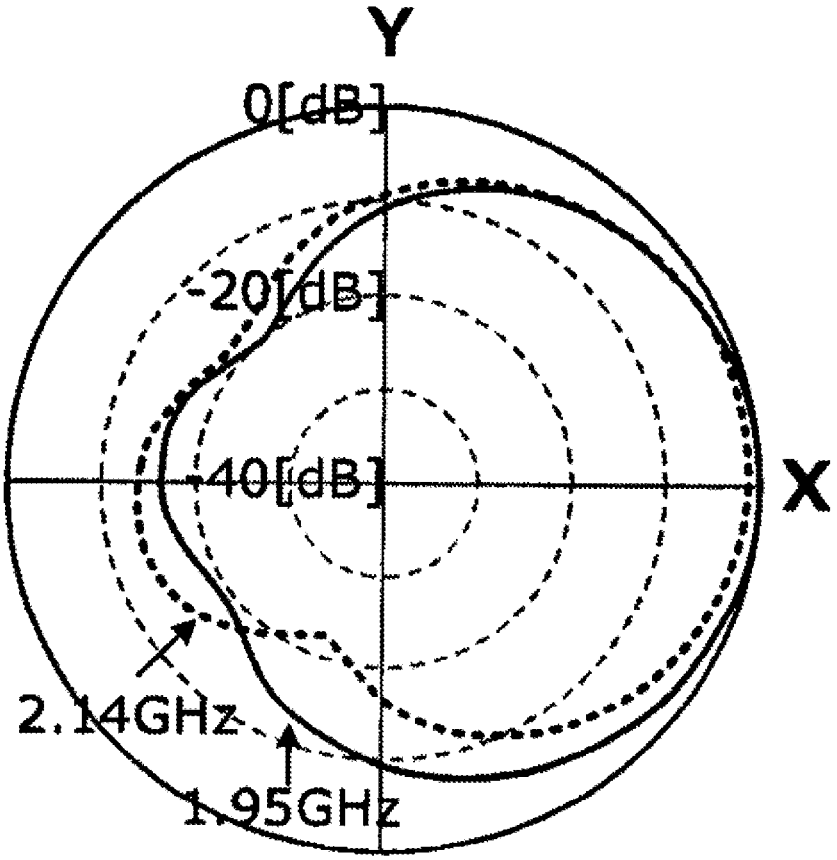
FIG. 17C is a diagram showing radiation patterns on the XY plane of the antenna apparatus 600.

FIG. 17C is a diagram showing radiation patterns on the XY plane of the antenna apparatus 600. However, the solid line is the radiation pattern at a frequency of 1.95 GHz, and the dotted line is the radiation pattern at a frequency of 2.14 GHz. Each radiation pattern is normalized with the maximum value at a frequency of 1.95 GHz.

In the antenna apparatus 600, since the cross polarization component increases, the radiation pattern changes greatly according to the frequency. For this reason, the radiation pattern of the antenna apparatus 600 changes between a frequency of 1.95 GHz and a frequency of 2.14 GHz.

Figure 17D:
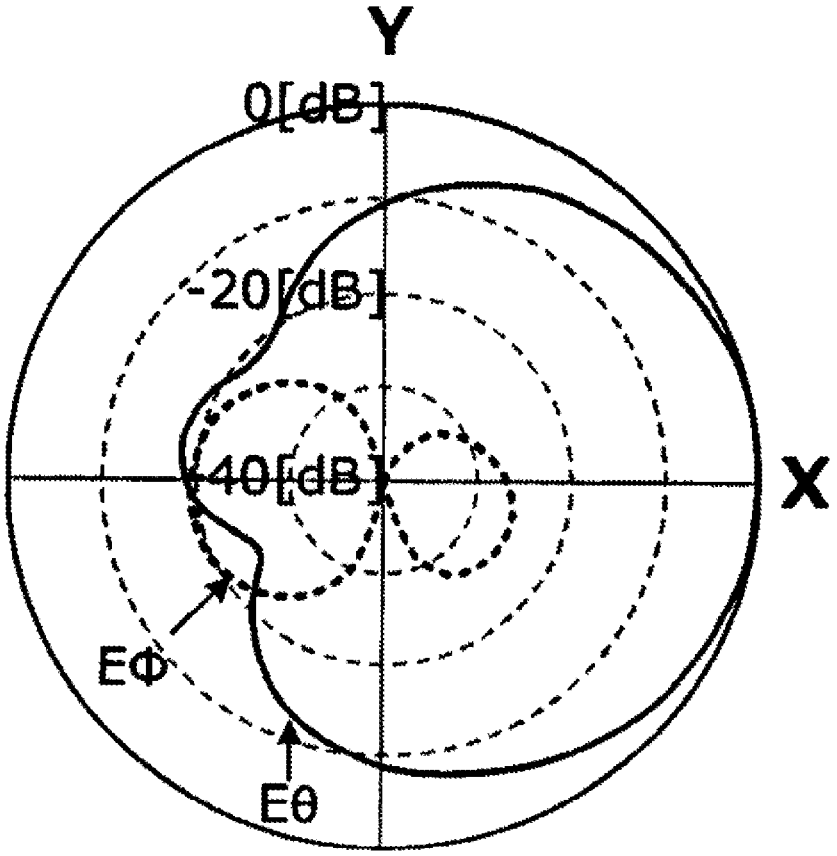
FIG. 17D is a diagram showing radiation patterns on the XY plane of the antenna apparatus 600.
Figure 17E:
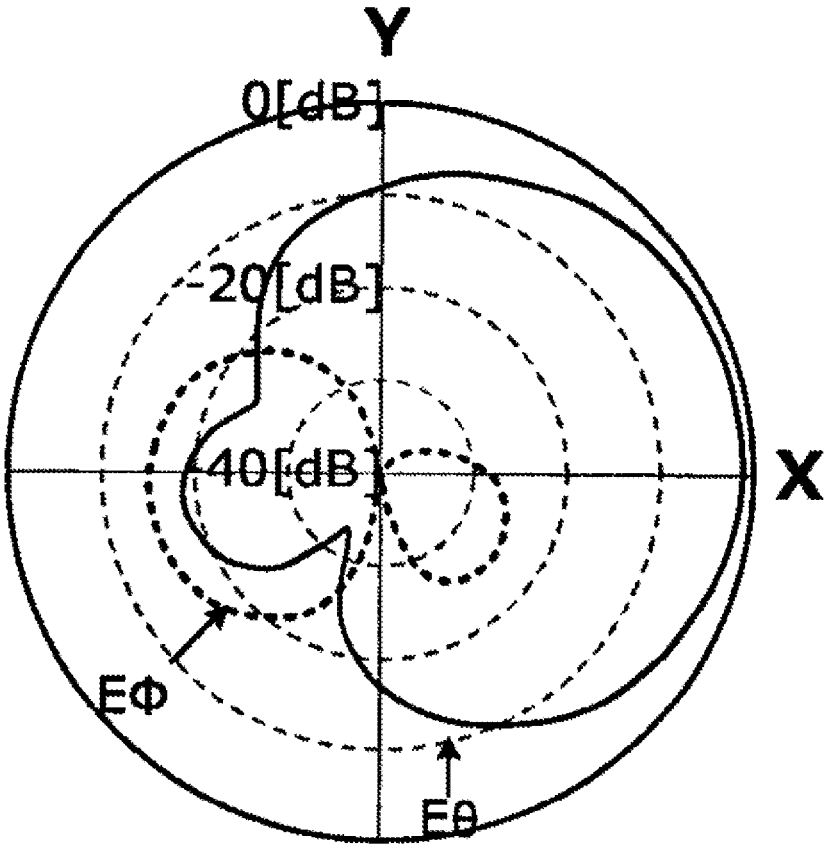
FIG. 17E is a diagram showing radiation patterns on the XY plane of the antenna apparatus 600 at a frequency different from that in FIG. 17D.

FIG. 17D is a diagram showing radiation patterns on the XY plane of the antenna apparatus 600 at a frequency of 1.95 GHz. FIG. 17E is a diagram showing radiation patterns on the XY plane of the antenna apparatus 600 at a frequency of 2.14 GHz. However, the solid line shows the main polarization component (Eθ), and the dotted line shows the cross polarization component (EΦ). Each radiation pattern is normalized with the maximum value at a frequency of 1.95 GHz.

As shown in FIG. 17D and FIG. 17E, in the antenna apparatus 600, not only the main polarization component, but also an unnecessary cross polarized component is generated. On the other hand, according to the antenna apparatuses 100 to 500, the cross polarization component is not generated. For this reason, it is possible to improve the communication quality. In addition, since the FB ratio is also improved as shown in FIG. 13C, it is possible to reduce the SAR.

It is noted that when the radiation pattern shown in FIG. 13C is compared with the radiation pattern shown in FIG. 17C, it can be seen that the FB ratio is better improved in the antenna apparatus 200 according to FIG. 13C than that in the antenna apparatus 600 according to FIG. 17C. Specifically, the ratio is improved by 2 dB at a frequency of 1.95 GHz and improved by 5 dB at a frequency of 2.14 GHz. This leads to improved antenna characteristics and reduced SAR when attached to a human body. Furthermore, the antenna apparatus 200 according to FIG. 13C has substantially the same radiation patterns at a frequency of 1.95 GHz and a frequency of 2.14 GHz, and the radiation pattern does not depend on the frequency.

Figure 18:
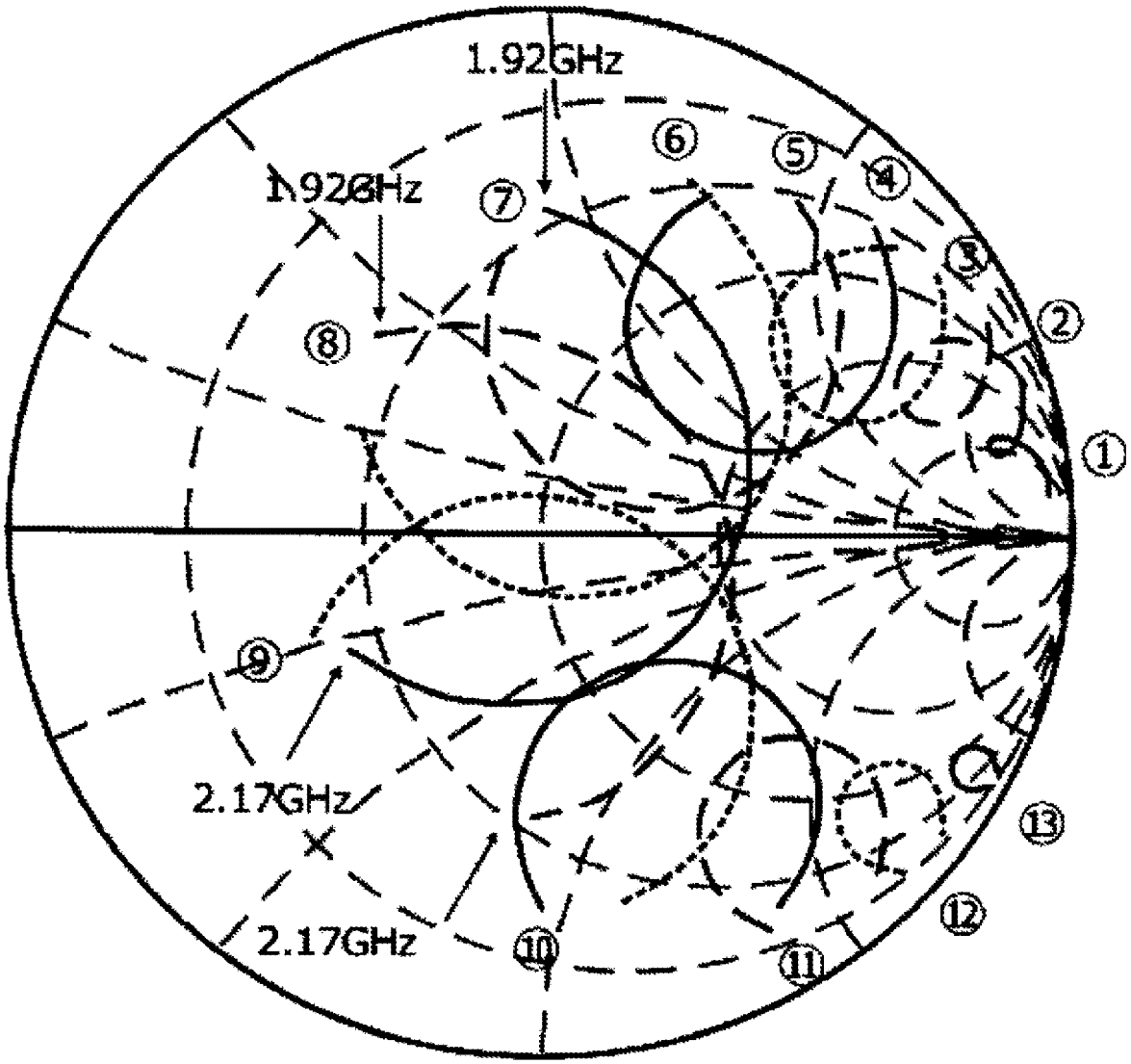
FIG. 18 is a Smith chart showing input impedance characteristics when, in the antenna apparatus 600, lengths L31 and L32 of the second antenna element 122 are changed.

FIG. 18 is a Smith chart showing input impedance characteristics when, in the antenna apparatus 600, lengths L31 and L32 of the second antenna element 122 were changed. In FIGS. 18, L31 and L32 were changed as described below. It is noted that "n-th" below corresponds to the input impedance characteristic shown by the circled number n in FIG. 18. $1^{st}$ L31: 9.5 mm L32: 50 mm $2^{nd}$ L31: 9.5 mm L32: 45 mm
$3^{rd}$ L31: 9.5 mm L32: 40 mm
$4^{th}$ L31: 9.5 mm L32: 35 mm
$5^{th}$ L31: 9.5 mm L32: 30 mm
$6^{th}$ L31: 9.5 mm L32: 25 mm
$7^{th}$ L31: 9.5 mm L32: 20 mm
$8^{th}$ L31: 9.5 mm L32: 15 mm
$9^{th}$ L31: 9.5 mm L32: 10 mm
$10^{th}$ L31: 9.5 mm L32: 5 mm
$11^{th}$ L31: 9.5 mm L32: 1 mm
$12^{th}$ L31: 7.0 mm L32: 1 mm
$13^{th}$ L31: 4.5 mm L32: 1 mm In the antenna apparatus 600, since L31: 9.5 mm and L32: 41 mm, a kink-shaped input impedance characteristic is generated at a position between the $2^{nd}$ and $3^{rd}$ input impedance characteristics in FIG. 18. Then, a matching circuit is used to match the impedance. In this case, the width of the antenna apparatus 600 requires at least the length L32. Therefore, it is difficult to reduce the size of the antenna apparatus 600.

On the other hand, as shown in FIG. 18, even if the lengths L31+L32 of the second antenna element 122 are shortened, it was found that the locus of the impedance characteristics became kink-shaped in the bottom-right region of the Smith chart. Then, as shown in FIG. 9 to FIG. 11, by adjusting the length L2 of the first antenna element 121 and the like, it is possible to form a kink having the desired shape. For this reason, the bandwidth can be widened while shortening the second antenna element 122 to reduce the size of the antenna apparatus. As an example, a method for matching the impedance in the antenna apparatus 600 corresponding to the $12^{th}$ input impedance characteristic in FIG. 18 will be described.

Figure 19:
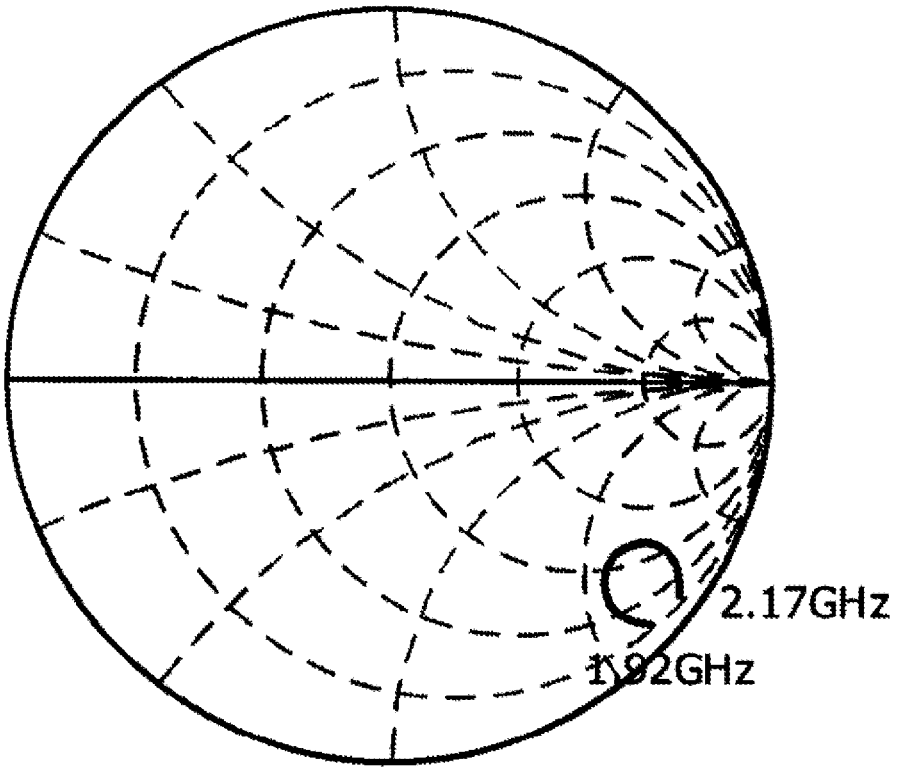
FIG. 19 is a diagram showing the $12^{th}$ input impedance characteristic in FIG. 18.

FIG. 19 is a diagram showing the $12^{th}$ input impedance characteristic in FIG. 18. A 14.2 nH series inductor 131 and a 35 nH parallel inductor 132 are loaded in the antenna apparatus 600. Furthermore, the length of the first antenna element 121 is adjusted to 61 mm.

Figure 20:
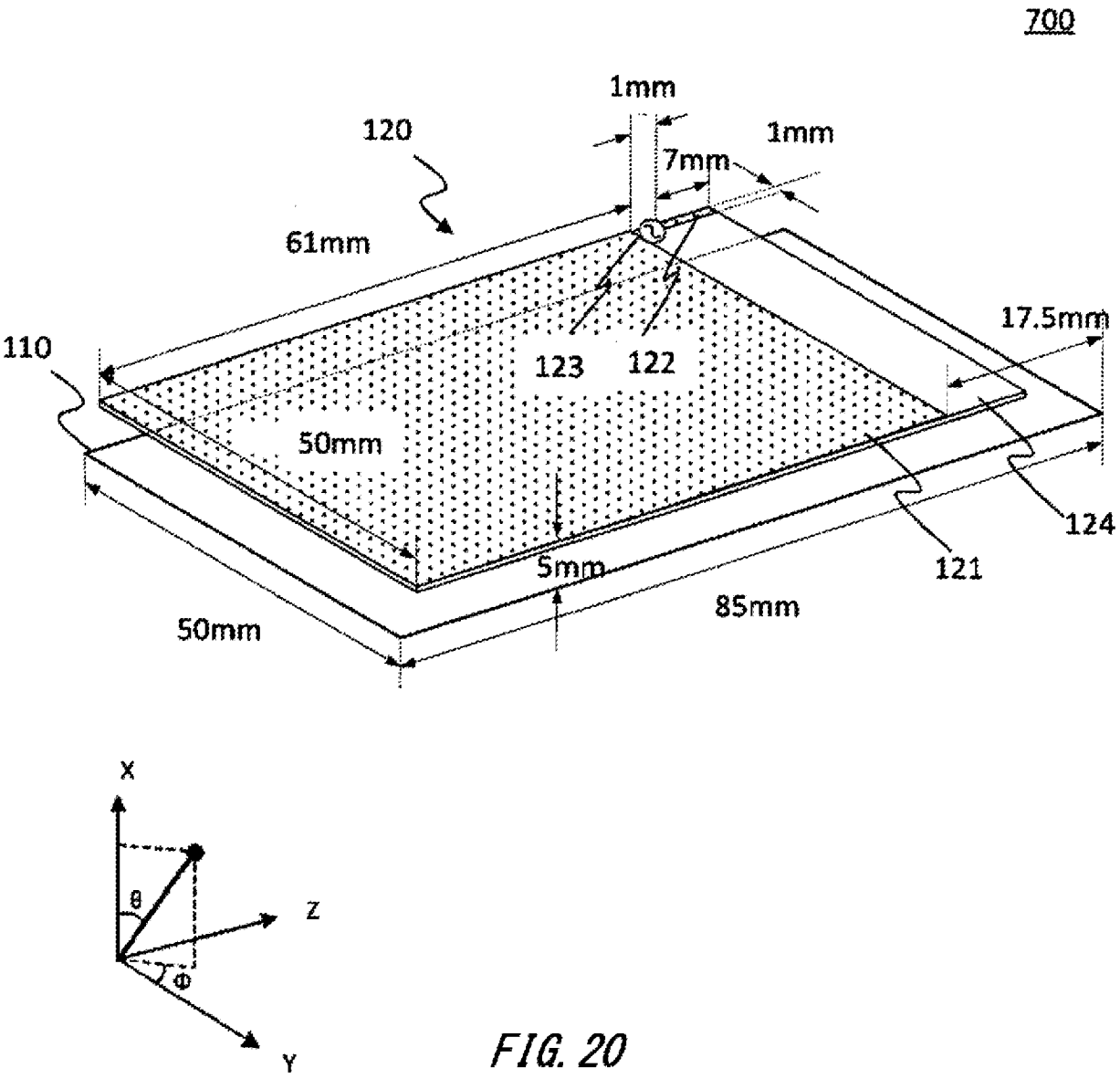
FIG. 20 is a perspective diagram showing an outline of an antenna apparatus 700 that has been adjusted.
Figure 21A:
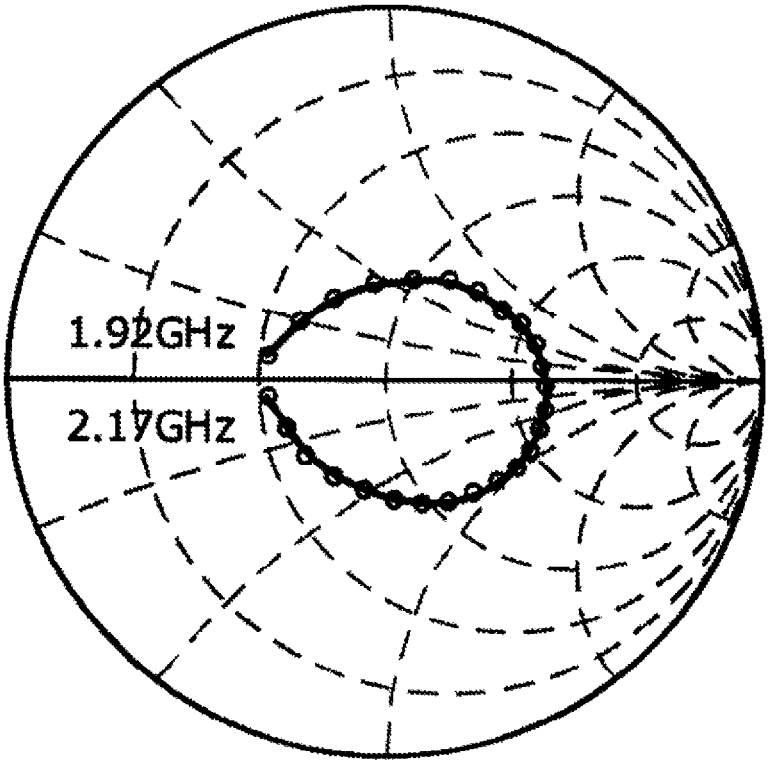
FIG. 21A is a Smith chart showing an input impedance characteristic of the antenna apparatus 700.
Figure 21B:
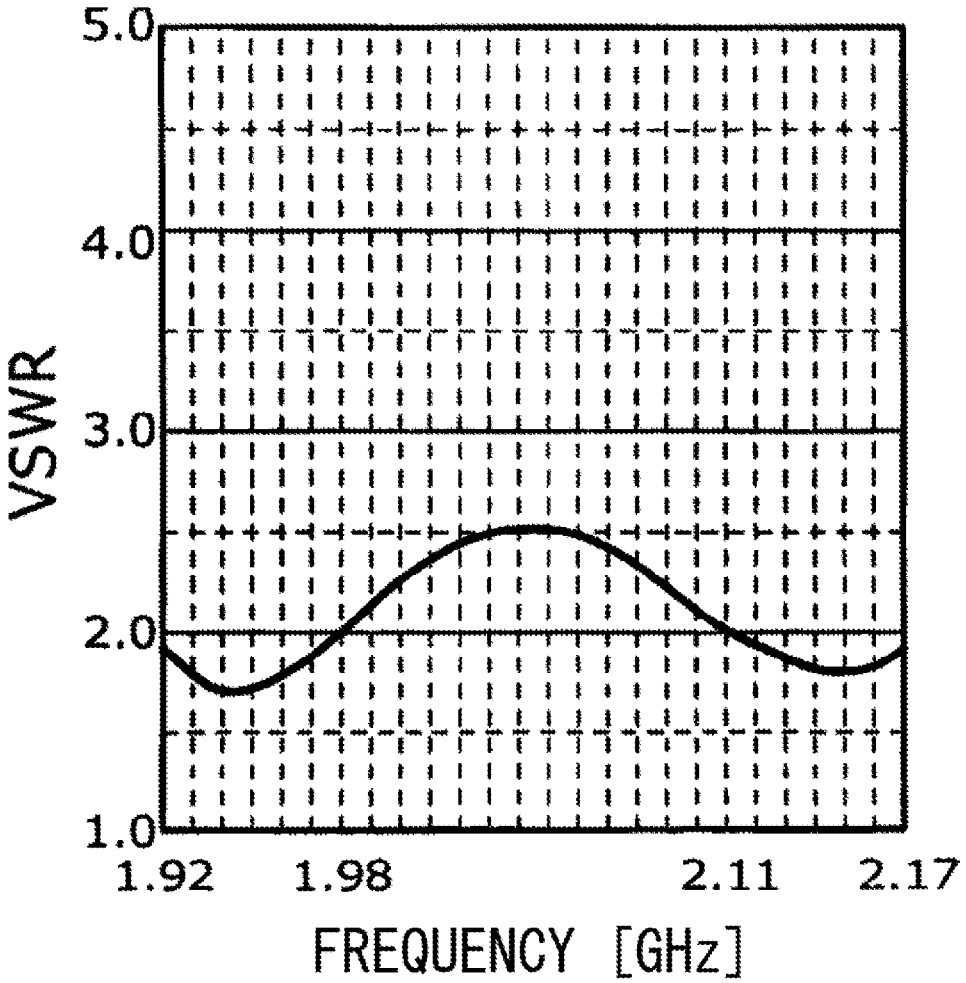
FIG. 21B is a diagram showing a VSWR characteristic of the antenna apparatus 700.
Figure 21C:
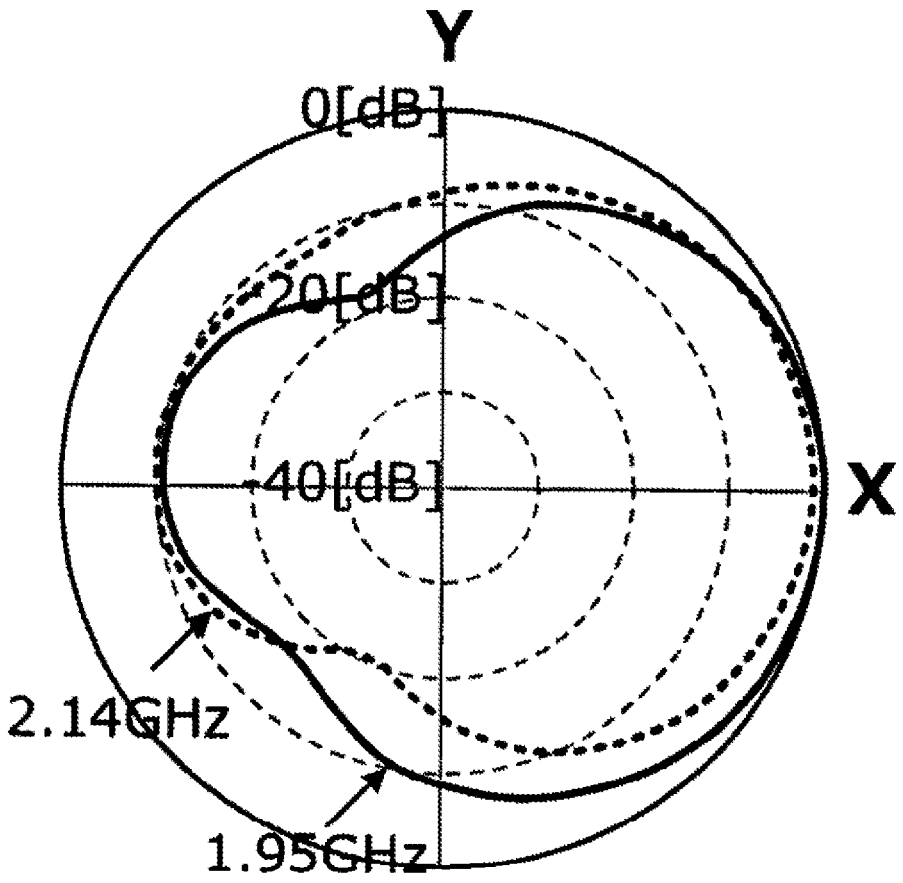
FIG. 21C is a diagram showing radiation patterns on the XY plane of the antenna apparatus 700.

FIG. 20 is a perspective diagram showing an outline of an antenna apparatus 700 that has been adjusted as described above. FIG. 21A is a Smith chart showing an input impedance characteristic of the antenna apparatus 700. FIG. 21B is a diagram showing a VSWR characteristic of the antenna apparatus 700. FIG. 21C is a diagram showing radiation patterns on the XY plane of the antenna apparatus 700. The solid line in FIG. 21C shows the radiation pattern at a frequency of 1.95 GHz, and the dotted line shows the radiation pattern at a frequency of 2.14 GHz. As shown in FIG. 21A and FIG. 21B, it can be seen that the antenna apparatus 700 can be widened in bandwidth according to the adjustments described above. However, as shown in FIG. 21C, since cross-polarized waves due to the width direction current component are radiated, the radiation pattern changes according to the frequency. Next, the positions of the second antenna element 122 and the power feeding portion 123 are adjusted.

Figure 22:
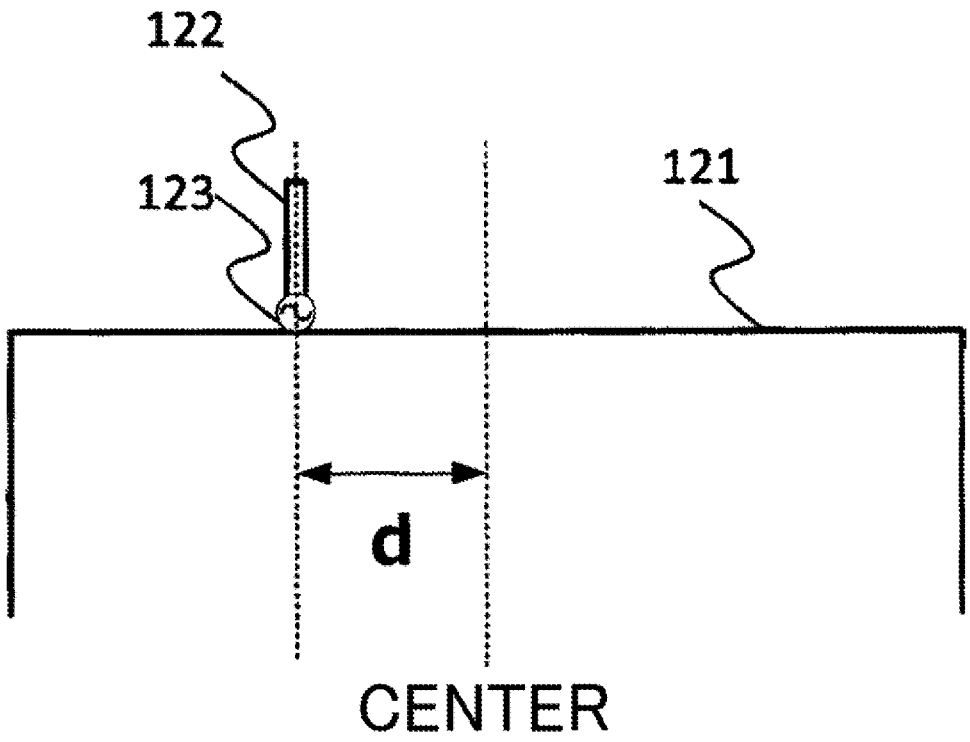
FIG. 22 is a schematic diagram showing the positions, on a specific side of the first antenna element 121, of the power feeding portion 123 and the second antenna element 122.

FIG. 22 is a schematic diagram showing the positions, on a specific side of the first antenna element 121, of the power feeding portion 123 and the second antenna element 122. The distance from the center of the side of the first antenna element 121 to the center of the power feeding portion 123 is defined as d. By changing d to 0 mm, 5 mm, 12 mm, and 24.5 mm, the radiation pattern at a frequency of 1.95 GHz of the main polarization component and the cross polarization component of the antenna apparatus was obtained. It is noted that the length of the side of the first antenna element 121 is 50 mm. In addition, the element width of the power feeding portion 123 is 1 mm. Therefore, when d=24.5 mm, the power feeding portion 123 is connected with an end portion of the side of the first antenna element 121. In addition, when d=0 mm, the power feeding portion 123 is connected with the center of the side of the first antenna element 121. FIG. 23A to FIG. 23D are diagrams showing radiation patterns on the XY plane at a frequency of 1.95 GHz. However, the solid line shows the main polarization component (Eθ), and the dotted line shows the cross polarization component (EΦ). Each radiation pattern is normalized with the maximum value of the main polarization component (Eθ).

Figure 23A:
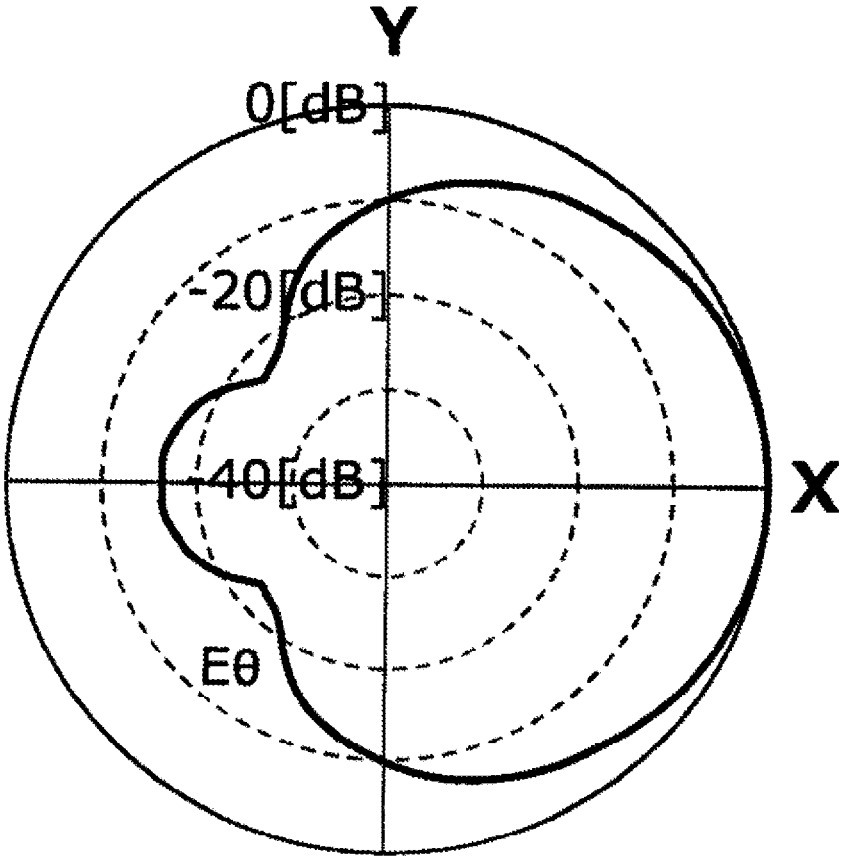
FIG. 23A is a diagram showing a radiation pattern when d=0 mm.

FIG. 23A is a diagram showing a radiation pattern when d=0 mm. In this case, since the second antenna element 122 is connected with the center of the side of the first antenna element 121, the cross polarization component (EΦ) is not generated.

Figure 23B:
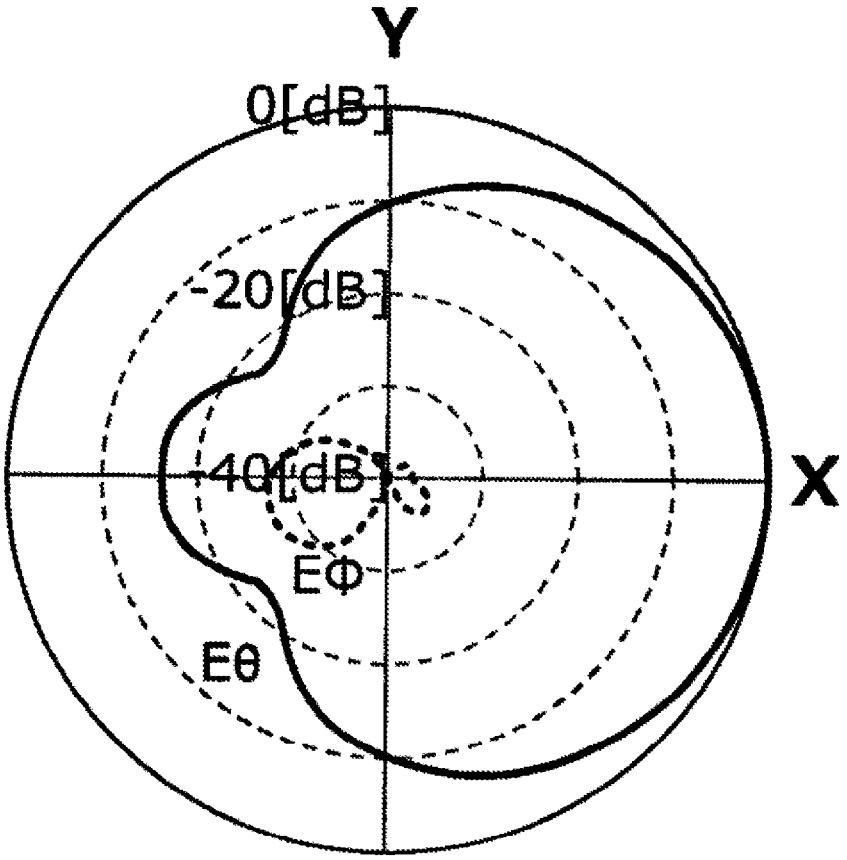
FIG. 23B is a diagram showing radiation patterns when d=5 mm (d=0.03λ).
Figure 23C:
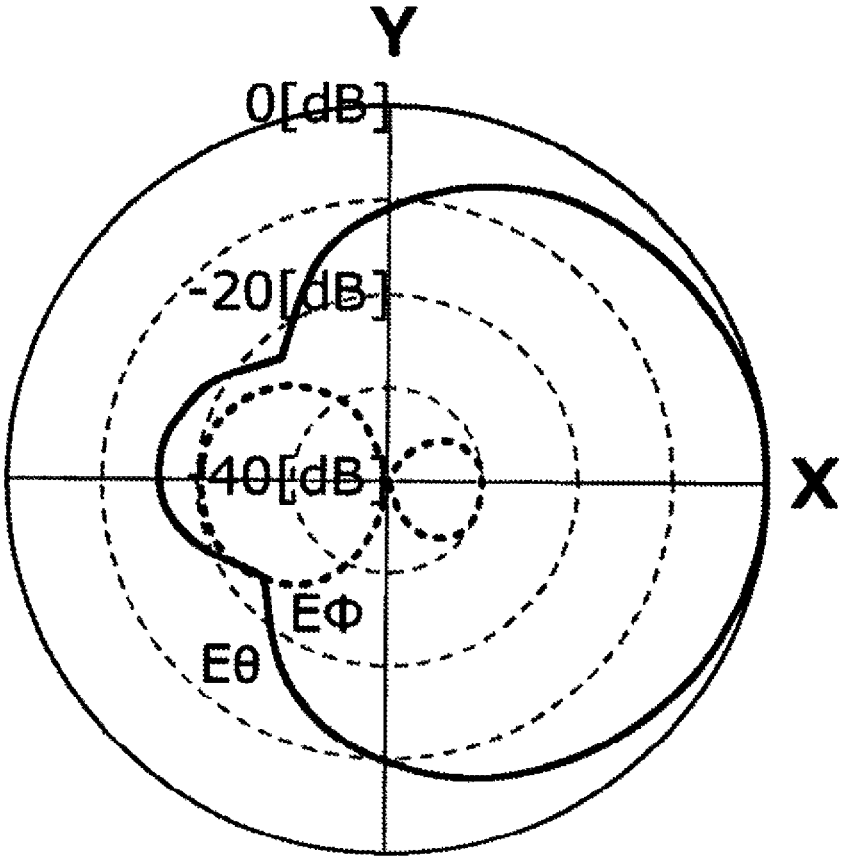
FIG. 23C is a diagram showing radiation patterns when d=12 mm (d=0.08λ).
Figure 23D:
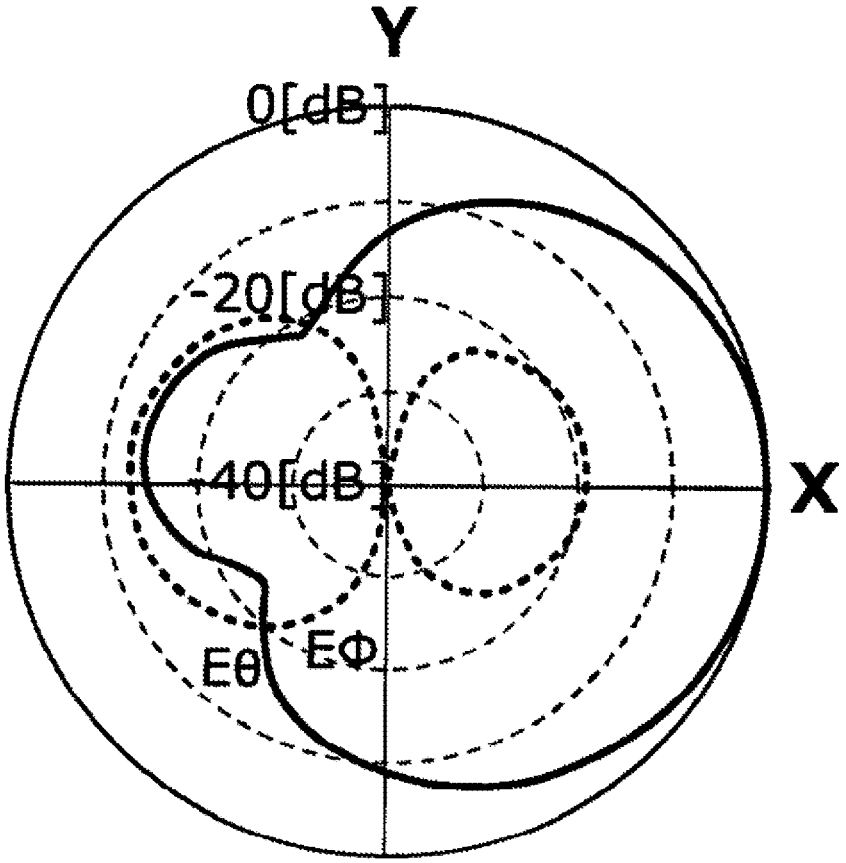
FIG. 23D is a diagram showing radiation patterns when d=24.5 mm.

FIG. 23B is a diagram showing radiation patterns when d=5 mm (d=0.03λ). In this case, the cross polarization component (EΦ) is slightly generated. FIG. 23C is a diagram showing radiation patterns when d=12 mm (d=0.08λ). In this case, the cross polarization component (EΦ) is further increased. FIG. 23D is a diagram showing radiation patterns when d=24.5 mm. In this case, the cross polarization component (EΦ) is further increased, and in some directions, is greater than the main polarization component (Eθ).

As shown in FIG. 23A to FIG. 23D, if d is 12 mm (0.08λ) or less, the cross polarization component (EΦ) with respect to the main polarization component (Eθ) is suppressed to −20 dB or less. For this reason, the characteristics of the antenna apparatus are not very degraded. It is preferable that the power feeding portion 123 and the second antenna element 122 are connected via the power feeding portion 123 to the side of the first antenna element 121 at a position where the distance d from the center of the side is 0.08 times or less of the wavelength k of the operating frequency.

In addition, the power feeding portion 123 and the second antenna element 122 may be connected via the power feeding portion 123 to the side of the first antenna element 121 at a position that is closer to the center of the side than the end portion of the side. For example, in the example above, the range may be 0 mm≤d≤12 mm.

In addition, the distance d is more preferably 5 mm (0.03λ) or less. As a result, it is possible to further suppress the cross polarization component. In addition, the distance d is most preferably 0 mm. As a result, it is possible to remove the cross polarization component.

Figure 24:
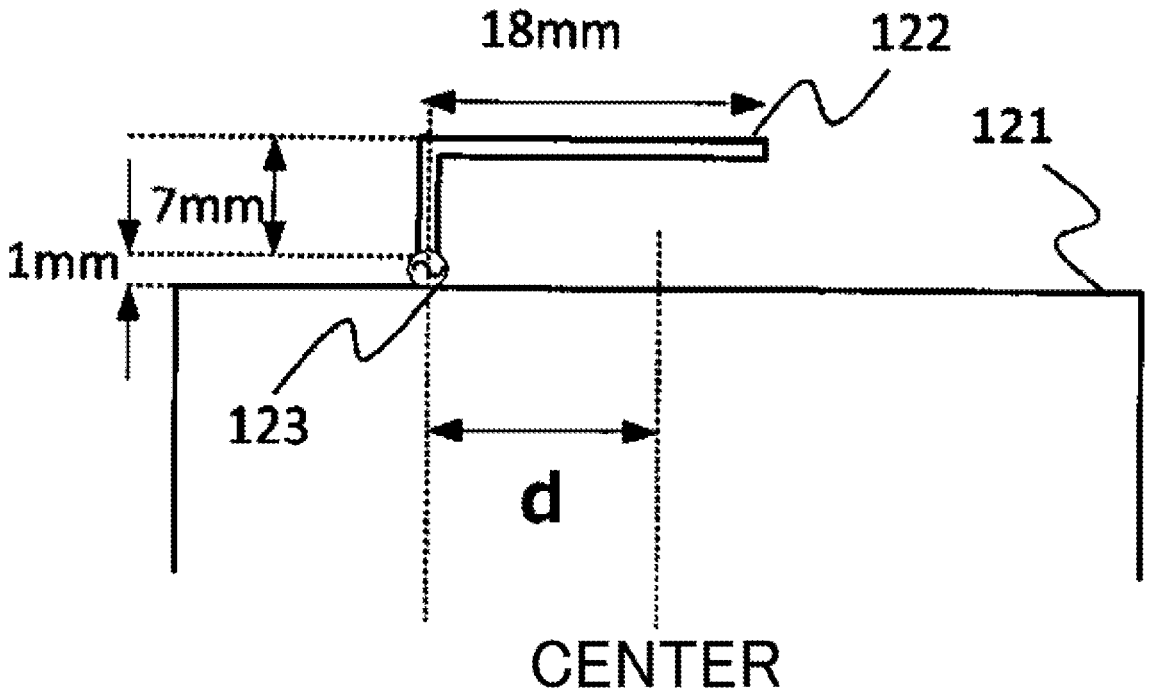
FIG. 24 is a schematic diagram showing the positions, on the specific side of the first antenna element 121, of the power feeding portion 123 and the second antenna element 122.

FIG. 24 is a schematic diagram showing the positions, on the specific side of the first antenna element 121, of the power feeding portion 123 and the second antenna element 122. However, the second antenna element 122 of the present example has an inverted L-shape. In addition, the length L31 of the part of the second antenna element 122 extending in the Z-axis direction is 7 mm, and the length L32 of the part of the second antenna element 122 extending in the Y-axis direction is 18 mm.

Figure 25A:
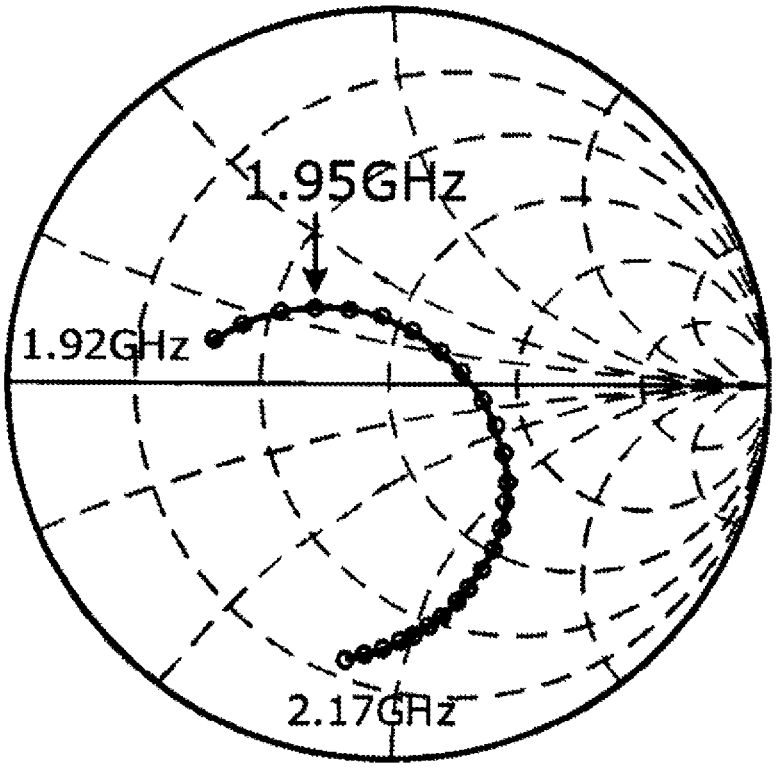
FIG. 25A is a Smith chart showing an input impedance characteristic of the antenna apparatus when d=12 mm in the example shown in FIG. 24.
Figure 25B:
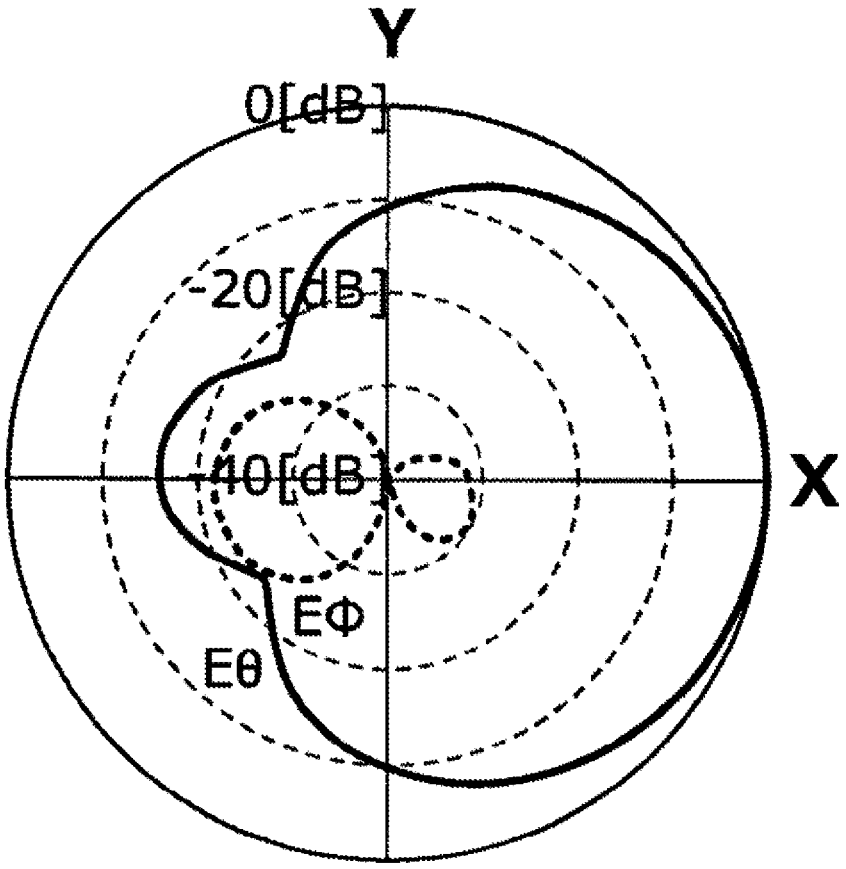
FIG. 25B is a diagram showing radiation patterns of the antenna apparatus when d=12 mm in the example shown in FIG. 24.

FIG. 25A is a Smith chart showing an input impedance characteristic of the antenna apparatus when d=12 mm in the example shown in FIG. 24. FIG. 25B is a diagram showing radiation patterns on the XY plane of the antenna apparatus at a frequency of 1.95 GHz when d=12 mm in the example shown in FIG. 24. However, the solid line shows the main polarization component (Eθ), and the dotted line shows the cross polarization component (EΦ). The radiation patterns are normalized with the maximum value of the main polarization component (Eθ).

As shown in FIG. 25A, resonance was confirmed in the present example also at a frequency of 1.95 GHz. In addition, as shown in FIG. 25B, it was confirmed in the present example also that the cross polarization component (EΦ) with respect to the main polarization component (Eθ) was suppressed to −20 dB or less. That is, by setting the distance d to 12 mm or less, it was confirmed that the cross polarization component was sufficiently suppressed regardless of the shape of the second antenna element 122.

Fifth Example

Figure 26:
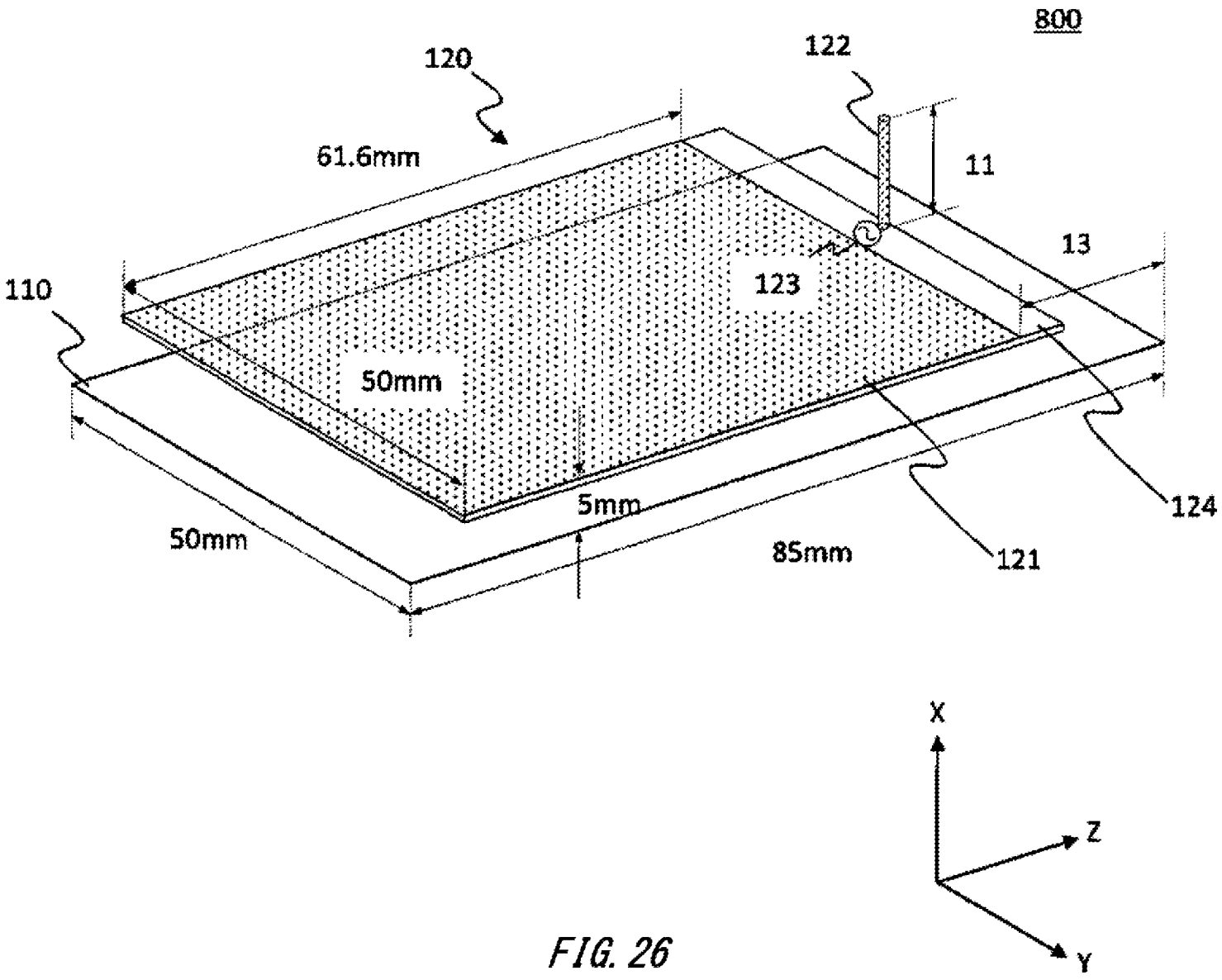
FIG. 26 is a perspective diagram showing an outline of an antenna apparatus 800 according to the fifth example.

FIG. 26 is a perspective diagram showing an outline of an antenna apparatus 800 according to the fifth example. The antenna apparatus 800 differs in the extension direction of the second antenna element 122 from the configuration of any of the antenna apparatuses according to the first to fourth examples. The other structures may be the same as any of the antenna apparatuses according to the first to fourth examples. However, the lengths and the like of the components are adjusted so that the antenna apparatus 800 resonates at the UMTS Band1. As an example, L1=85 mm, L2, =61.5 mm, L3=11 mm, L4=2 mm, L5=13 mm, W1=W2=50 mm, W3=1 mm, D=5 mm, the inductance of the series inductor 131 is 12.2 nH, and the inductance of the parallel inductor 132 is 88 nH.

The second antenna element 122 of the present example has a part extending in the direction perpendicular to the surface opposing the parasitic element 110. In the example shown in FIG. 26, the second antenna element 122 is provided extending in the X direction from the power feeding portion 123. The second antenna element 122 of the present example is a copper wire having a diameter of 1 mm.

Figure 27A:
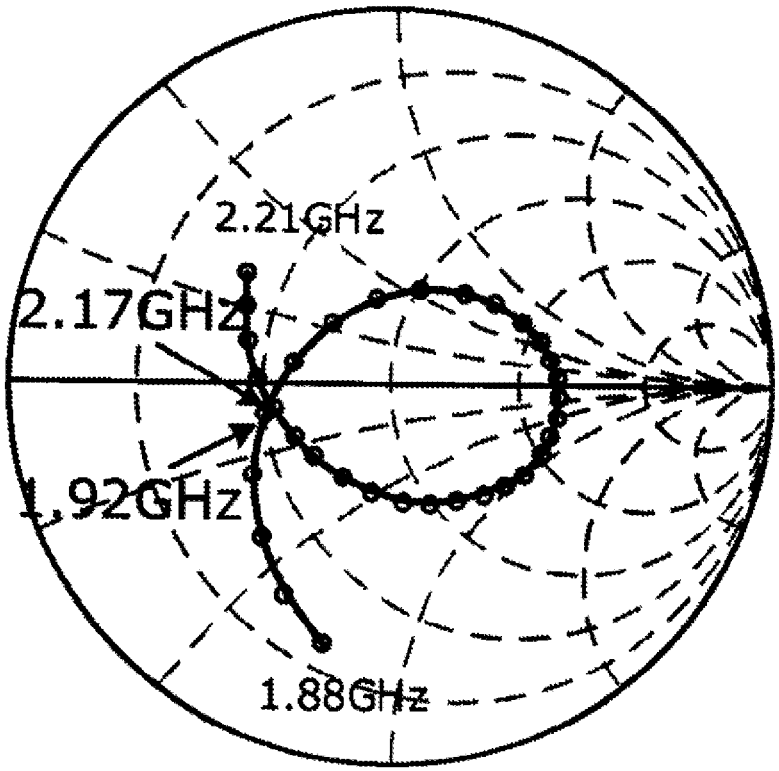
FIG. 27A is a Smith chart showing an input impedance characteristic of the antenna apparatus 800.
Figure 27B:
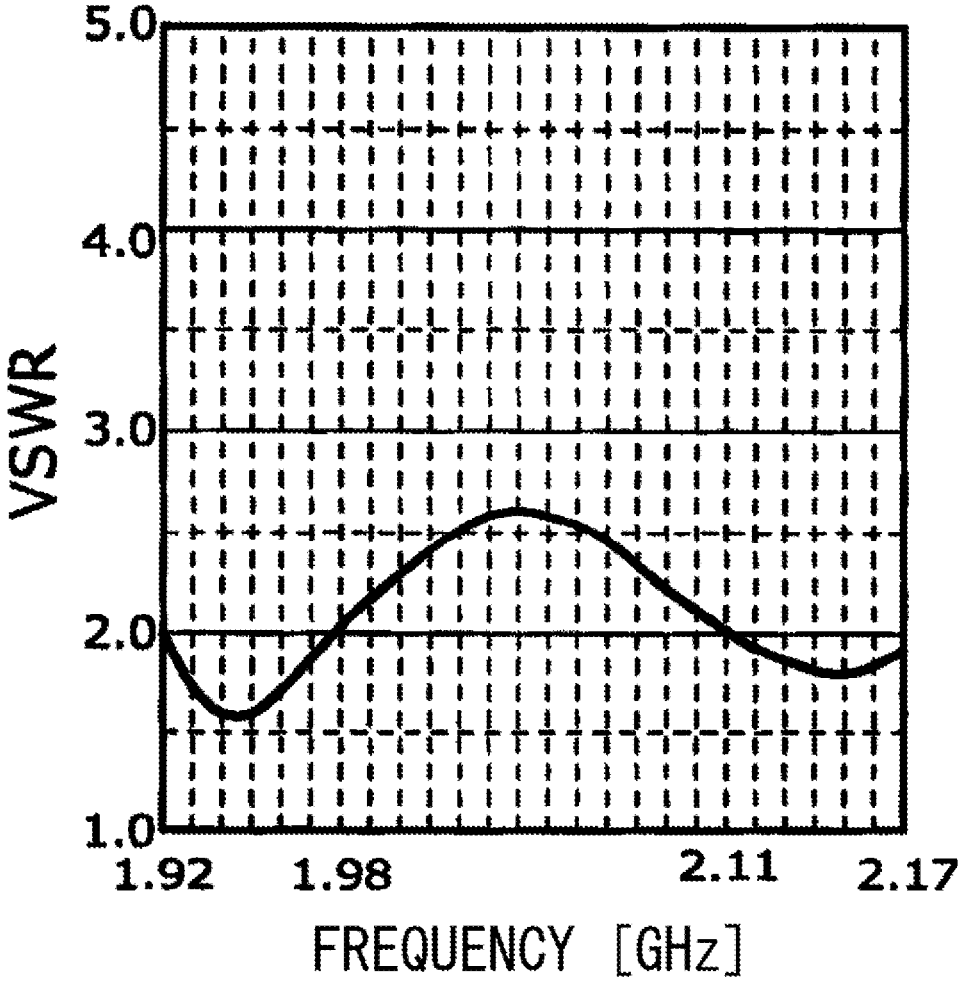
FIG. 27B is a diagram showing a VSWR characteristic of the antenna apparatus 800.
Figure 27C:
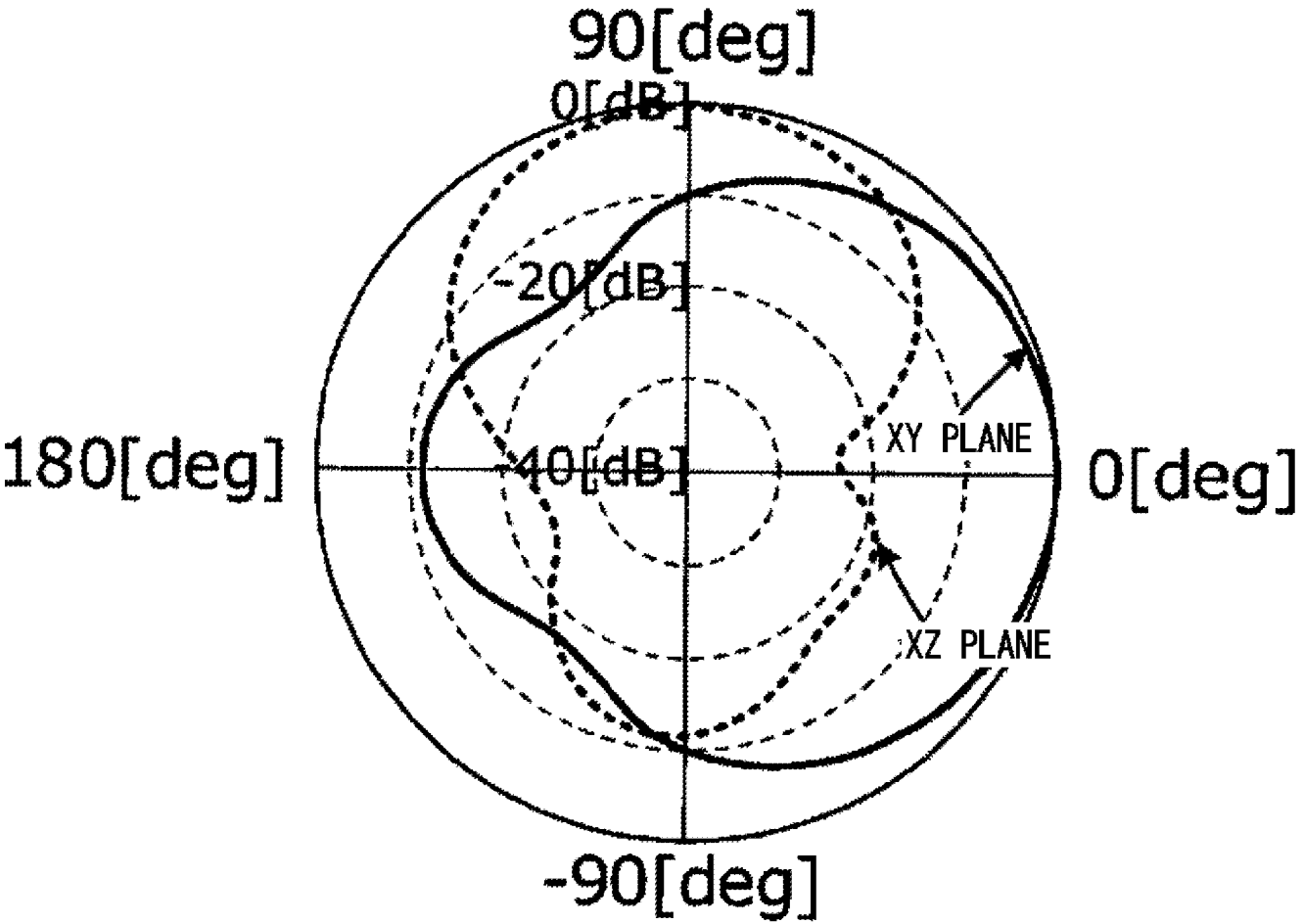
FIG. 27C is a diagram showing radiation patterns on the XY plane and the radiation pattern on the XZ plane of the antenna apparatus 800.

FIG. 27A is a Smith chart showing an input impedance characteristic of the antenna apparatus 800. FIG. 27B is a diagram showing a VSWR characteristic of the antenna apparatus 800. FIG. 27C is a diagram showing radiation patterns on the XY plane and the radiation pattern on the XZ plane of the antenna apparatus 800. However, the solid line shows the radiation pattern on the XY plane, and the dotted line shows the radiation pattern on the XZ plane. The radiation patterns are normalized with the maximum value of the radiation pattern on the XY plane.

As shown in FIG. 27A and FIG. 27B, the antenna apparatus 800 resonates at the UMTS Band1. In addition, as shown in FIG. 27C, the parasitic element 110 functions as a reflector. In addition, the antenna apparatus 800 also has a radiation pattern in the direction perpendicular to the parasitic element 110.

It is noted that the angle of the second antenna element 122 with respect to the first antenna element 121 may be variable. That is, it is possible to move the second antenna element 122 in an arbitrary direction with the point connected with the power feeding portion 123 as the fulcrum. With this configuration, it is possible to generate a polarization component in a desired plane.

It is noted that the second antenna element 122 may have both of a part extending perpendicularly to the surface of the first antenna element 121 and a part extending in the direction parallel to a long side of the first antenna element 121. The second antenna element 122 may extend in the Z direction after extending in the X direction from the power feeding portion 123 and may extend in the X direction after extending in the Z direction from the power feeding portion 123.

Sixth Example

Figure 28:
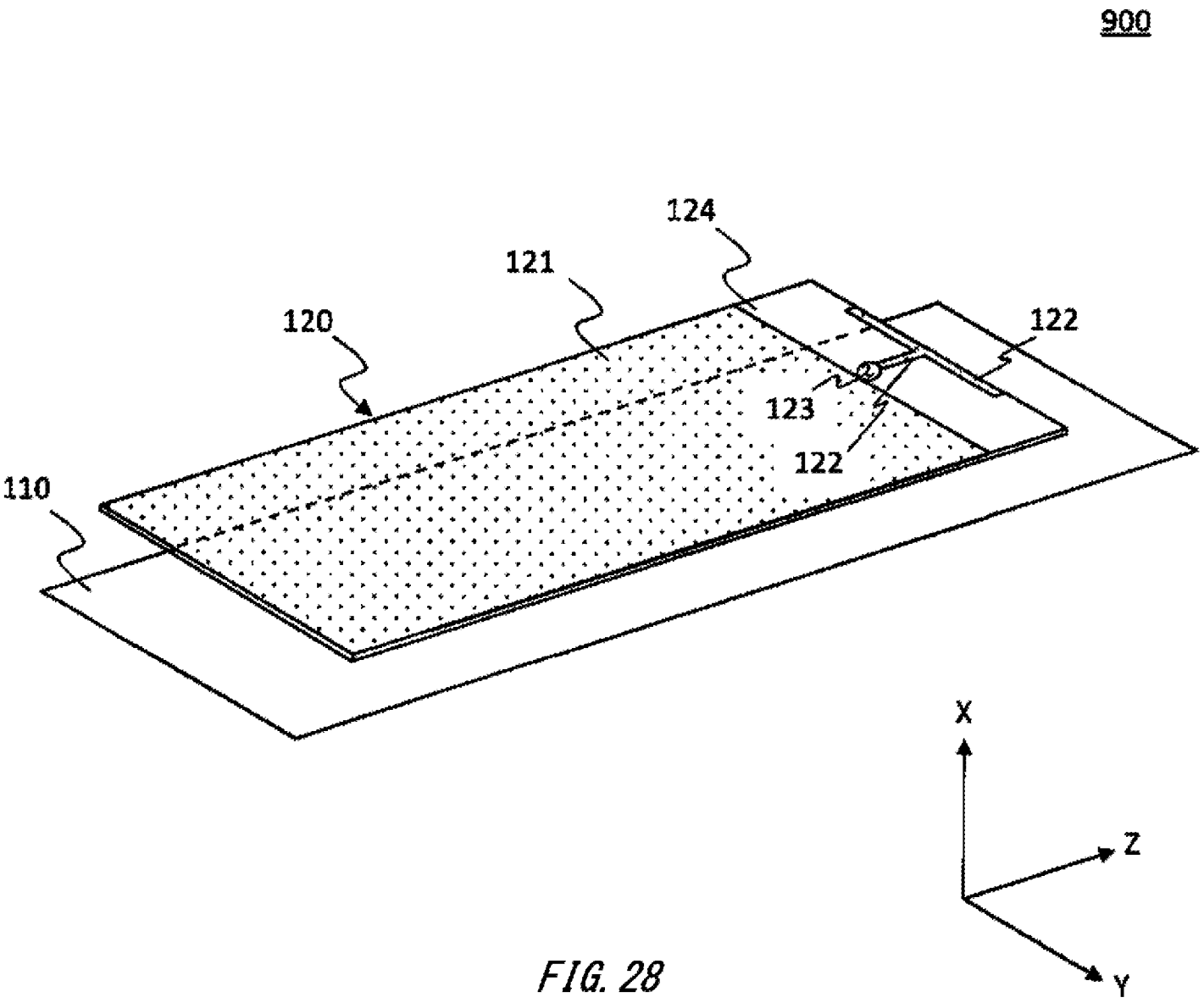
FIG. 28 is a perspective diagram showing an outline of an antenna apparatus 900 according to the sixth example.

FIG. 28 is a perspective diagram showing an outline of an antenna apparatus 900 according to the sixth example. The antenna apparatus 900 differs in the shape of the second antenna element 122 from the configuration of any of the antenna apparatuses according to the first to fifth examples. The other structure may be the same as any of the antenna apparatuses according to the first to fifth examples.

The second antenna element 122 in the antenna apparatuses according to the first to fourth examples has a part extending parallel to a long side of the first antenna element 121 from the point (that is, the power feeding portion 123) connected with the first antenna element 121. The antenna apparatus 900 of the present example has a part further extending, after extending in the direction (Z-axis direction) parallel to a long side of the first antenna element 121, in the direction (Y-axis direction) parallel to a short side of the first antenna element 121. However, the total length of the second antenna element 122 is shorter than $\lambda/4$.

In addition, the second antenna element 122 in the antenna apparatus according to the fifth example has a part extending in the direction perpendicular to a surface of the first antenna element 121. The antenna apparatus 900 of the present example has a part further extending, after extending in the direction (X-axis direction) perpendicular to a surface of the first antenna element 121, in the direction (Y-axis direction) parallel to a short side of the first antenna element 121. In the present example also, the total length of the second antenna element 122 is shorter than $\lambda/4$.

It is noted that the second antenna element 122 has a part extending in the positive Y-axis direction and a part extending in the negative Y-axis direction from the end portion of the part extending in the Z-axis direction. It is preferable that the lengths of the parts extending in the positive Y-axis direction and the part extending in the negative Y-axis direction are the same. With this configuration, it is possible to provide a small antenna apparatus 900 while providing a relatively long second antenna element 122. In addition, the cross polarization component can also be reduced. It is noted that the second antenna element 122 was made to have a branched T-shape, but it also may take a variety of other shapes such as a loop shape, a folded shape, or a bow tie shape.

Figure 29:
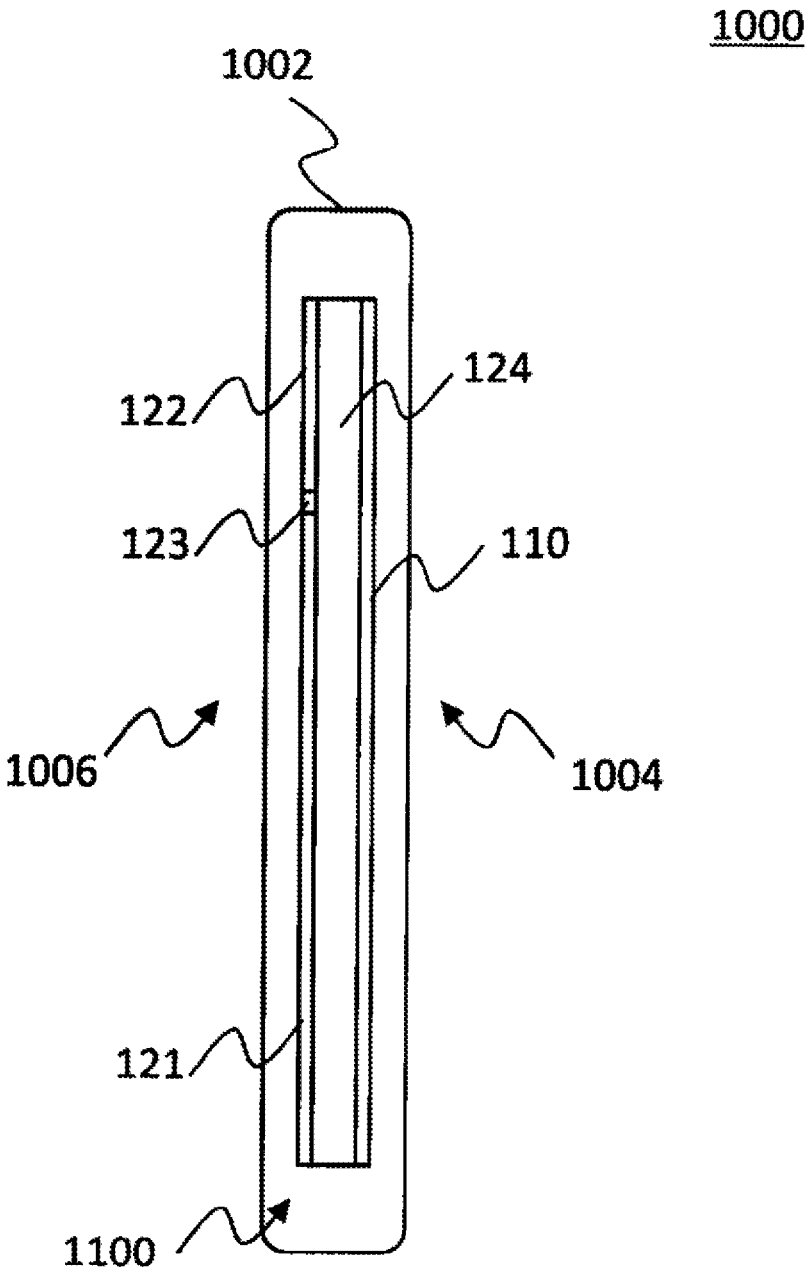
FIG. 29 is cross-sectional diagram showing an outline of a mobile terminal 1000 according to an embodiment of the present invention.

FIG. 29 is cross-sectional diagram showing an outline of a mobile terminal 1000 according to an embodiment of the present invention. The mobile terminal 1000 includes any antenna apparatus 1100 according to the first to eleventh examples and a housing 1002. The housing 1002 stores the antenna apparatus 1100. Inside the housing 1002, the antenna apparatus 1100 is electrically connected to an electrical circuit such as a wireless circuit.

In addition, the housing 1002 has a front surface 1004 and a back surface 1006. The front surface 1004 is a surface that should oppose the user when the mobile terminal 1000 is being used. For example, the front surface 1004 is provided with a speaker for voice calls, a display device for displaying information, or the like.

The antenna apparatus 1100 is disposed so that the parasitic element 110 is on the front surface 1004 side. As a result, when the mobile terminal 1000 is being used, it is possible to reduce the electromagnetic waves radiated to the user side and to improve the SAR.

It is noted that the antenna apparatuses according to the first to tenth examples may be suitably applied to a mobile terminal or a wearable terminal, but the application is not limited to these. Since the present antenna apparatus has directivity with a high FB ratio, it is also effective when it is attached, for example, to a wall or ceiling that does not require backward radiation, or to an automobile, industrial equipment, or the like. In addition, the present antenna apparatus is also effective in an application where the present antenna apparatus is disposed on the floor and radiates electromagnetic waves in the zenith direction or is disposed on a machine body and radiates electromagnetic waves from the sky toward the ground. In addition, the present antenna apparatus may also be mounted with an IC chip and applied as an antenna for RFID (Radio Frequency IDentification). The present antenna apparatus is especially effective when the attachment portion is a metal object. Furthermore, since the present antenna apparatus has a high FB ratio, there is an advantage that there is little misalignment when it is mounted on a human body or the like.

Seventh Example

Figure 30:
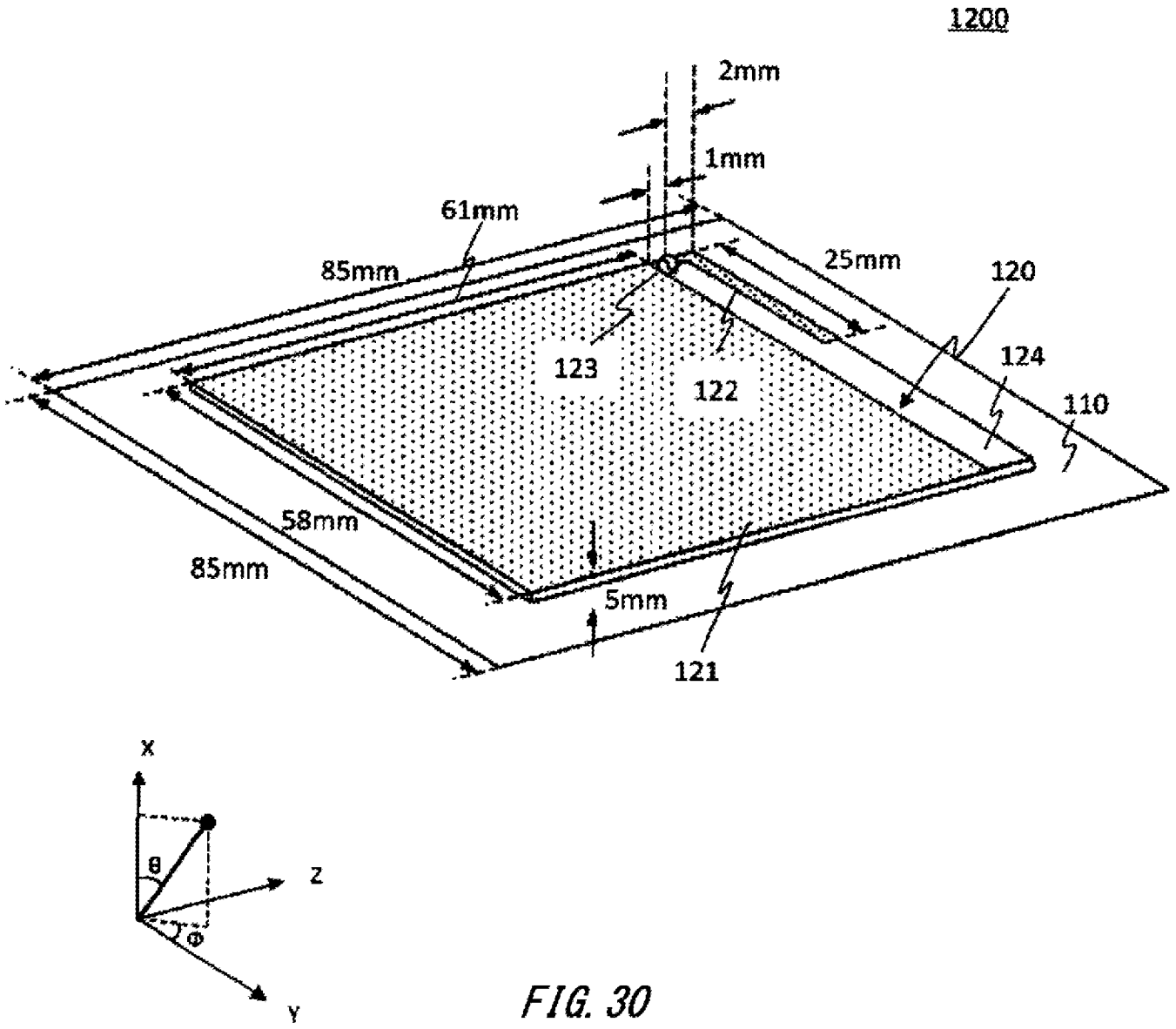
FIG. 30 is a perspective diagram showing an outline of an antenna apparatus 1200 according to the seventh example.

FIG. 30 is a perspective diagram showing an outline of an antenna apparatus 1200 according to the seventh example. While the antenna apparatuses according to the first example to the fifth example are apparatuses corresponding to linearly polarized waves, the antenna apparatus 1200 according to the seventh example is an apparatus corresponding to circularly polarized waves. It is noted that the sixth example may correspond to circularly polarized waves as well as linearly polarized waves. The antenna apparatus 1200 differs from any of the antenna apparatuses according to the first example to the sixth example in the shapes of the parasitic element 110 and the first antenna element 121. The shape of the second antenna element 122 may be the same as the second antenna element 122 according to the first example to the sixth example. In addition, the operating frequency is also the same as that of the antenna apparatuses according to the first example to the sixth example.

The parasitic element 110 according to the present example has a length (Z-axis direction) and width (Y-axis direction) that are both approximately one-half or more of the wavelength $\lambda$ of the operating frequency. As an example, the length and width of the parasitic element 110 are the same, but are not limited to this. When the antenna apparatus is reduced in size, the length may be approximately one-half of the wavelength λ, but may have a longer length. In addition, the shape is not limited and may be a rectangle or a circle.

The first antenna element 121 of the present example is a plate-like conductor and is adjusted to a length such that it resonates in the width direction in addition to the length direction. The length and width of the first antenna element 121 are shorter than the length and width of the parasitic element 110. The length and width of the first antenna element 121 may be greater than one-fourth of the wavelength λ. The shape of the first antenna element 121 may be an approximately circular shape or an approximately regular n-sided polygon (provided that n is an even number of 4 or more). The length and width of a circular shape refers to the diameter. The length and width of a regular n-sided polygon refers to the distance between two sides provided parallel to and opposing one another. The shape of the first antenna element 121 of the present example is an approximately square shape. In addition, as an example, the center position of the first antenna element 121 on the YZ plane is made to coincide with the center position of the parasitic element 110, but it is not limited to this.

An approximately circular shape and an approximately regular n-sided polygon includes, in addition to a strictly circular shape and regular n-sided polygon, those having differences within a specific range in the length in the Z-axis direction and the width in the Y-axis direction. In the present example, the differences are ±10% or less. The first antenna element 121 of the present example has a length in the Z-axis direction that is about 5% longer than the length in the Y-axis direction.

As shown in FIG. 30, when power is fed from an opposite corner of the first antenna element 121 and the length and width of the first antenna element 121 are adjusted, a current I1 and a current I2 that are orthogonal to one another with a phase difference of π/2 flow in the length direction and width direction of the first antenna element 121.

Figure 31:
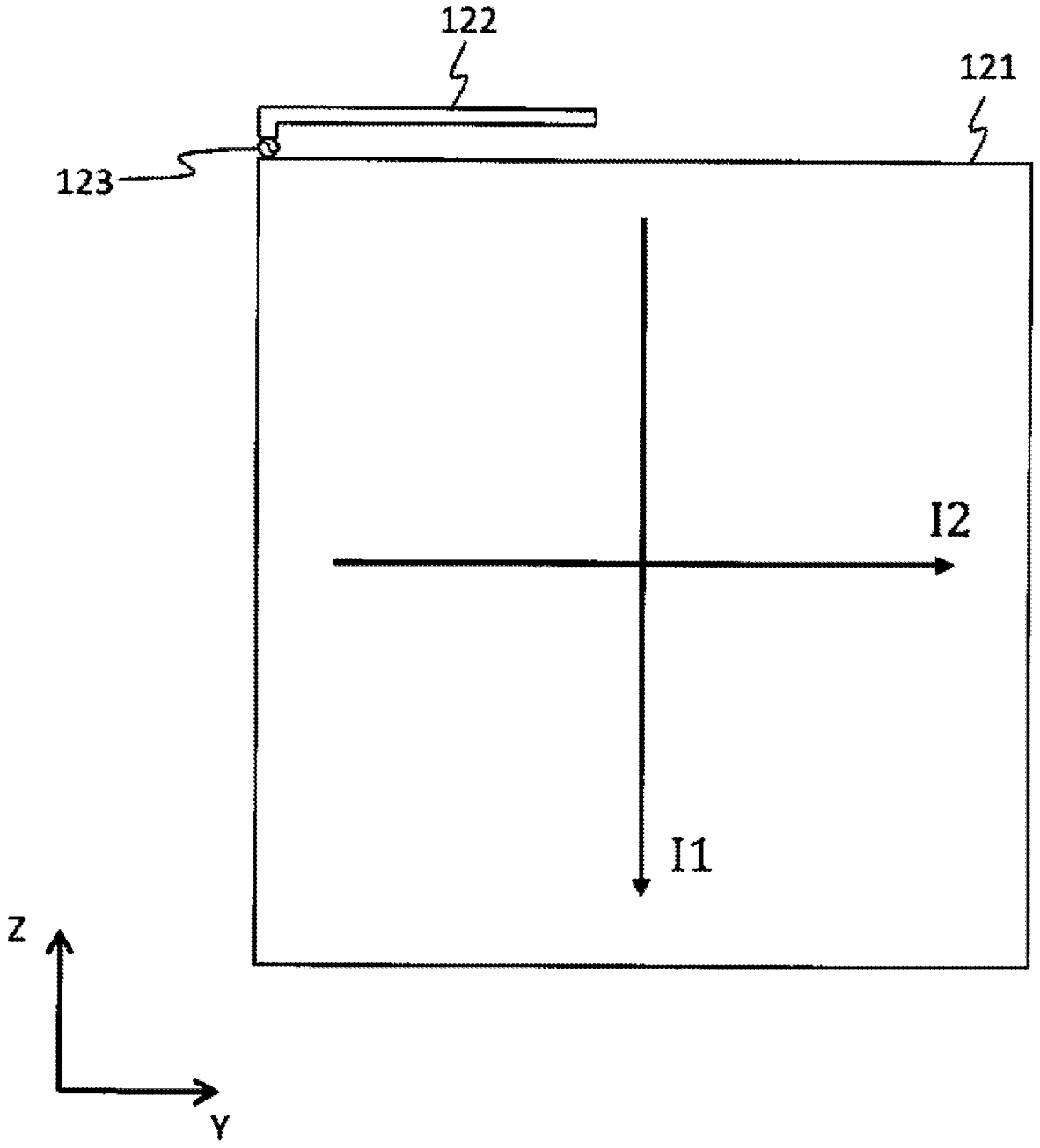
FIG. 31 is a diagram schematically showing the current I1 and the current I2.

FIG. 31 is a diagram schematically showing the current I1 and the current I2. When the resonance frequencies corresponding to the current I1 and the current I2 are a frequency f1 and a frequency f2, circularly polarized waves are radiated around a center frequency f0 of the frequency f1 and the frequency f2. If the frequency f1 and the frequency f2 are close to one another, a good axial ratio is obtained at the center frequency f0. It is noted that it is possible to reverse the turning direction of the circular polarized waves if power is fed from the other opposite corner of the first antenna element 121.

Figure 32A:
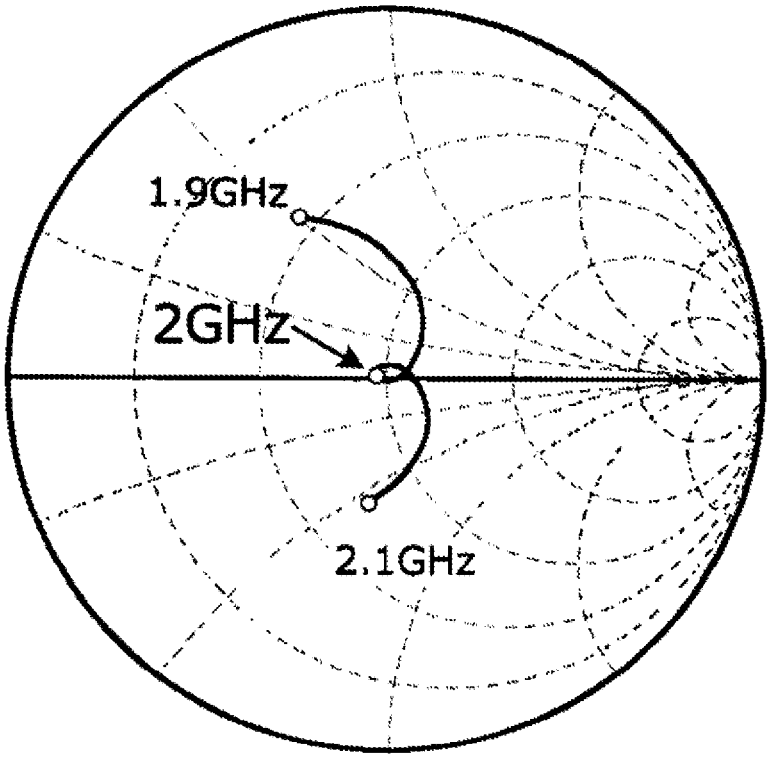
FIG. 32A is a Smith chart showing an input impedance characteristic of the antenna apparatus 1200.
Figure 32B:
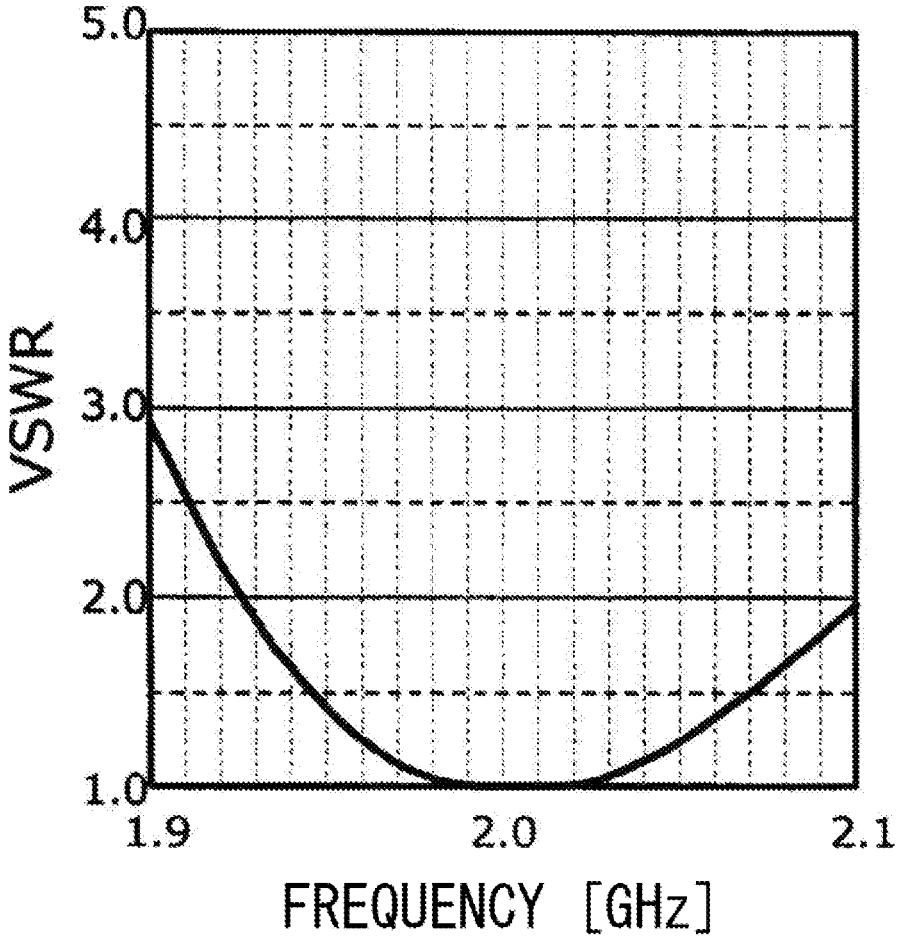
FIG. 32B is a diagram showing a VSWR characteristic of the antenna apparatus 1200.
Figure 33:
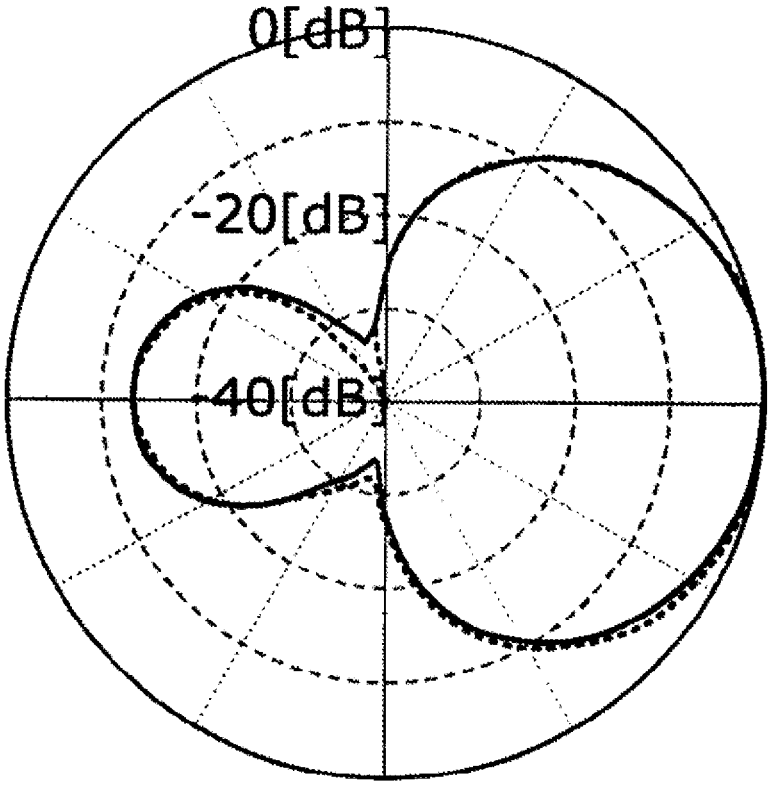
FIG. 33 is a diagram showing radiation patterns on the XY plane and the XZ plane at a frequency of 2 GHz of the antenna apparatus 1200.

FIG. 32A is a Smith chart showing an input impedance characteristic of the antenna apparatus 1200. FIG. 32B is a diagram showing a VSWR characteristic of the antenna apparatus 1200. FIG. 33 is a diagram showing radiation patterns at a frequency of 2 GHz of the antenna apparatus 1200. However, the solid line shows the Eθ component on the XY plane, and the dotted line shows the Eθ component on the XZ plane. The radiation patterns are normalized with the maximum value.

In the example shown in FIG. 30, the parasitic element 110 is a square having a length of 85 mm in both the Z-axis direction and the Y-axis direction. The first antenna element 121 is an approximately square shape having a length of 61 mm in the Z-axis direction and a length of 58 mm in the Y-axis direction. The dielectric substrate 124 is a rectangle having a length of 64 mm in the Z-axis direction and a length of 58 mm in the Y-axis direction. The substrate thickness of the dielectric substrate 124 is 1 mm, and the relative dielectric constant is 4.3.

The distance between the antenna portion 120 formed on the front surface of the dielectric substrate 124 and the parasitic element 110 is 5 mm. The second antenna element 122 of the present example has an inverted L shape that extends 2 mm in the Z-axis direction from the power feeding portion 123 and then extends 25 mm in the Y-axis direction.

With this structure, as shown in FIG. 32A and FIG. 32B, the antenna portion 120 and the parasitic element 110 are electromagnetically coupled and resonate at a center frequency of 2 GHz. In addition, as shown in FIG. 33, it can be seen that the antenna apparatus functions as a circularly polarized wave antenna. Furthermore, since the parasitic element 110 operates as a reflector, it is possible to make the radiation pattern intensity on the parasitic element 110 side, that is, the radiation pattern intensity on the negative X-axis side in FIG. 30, smaller than the radiation pattern intensity on the positive X-axis side. For this reason, it is possible to reduce the SAR.

Figure 34:
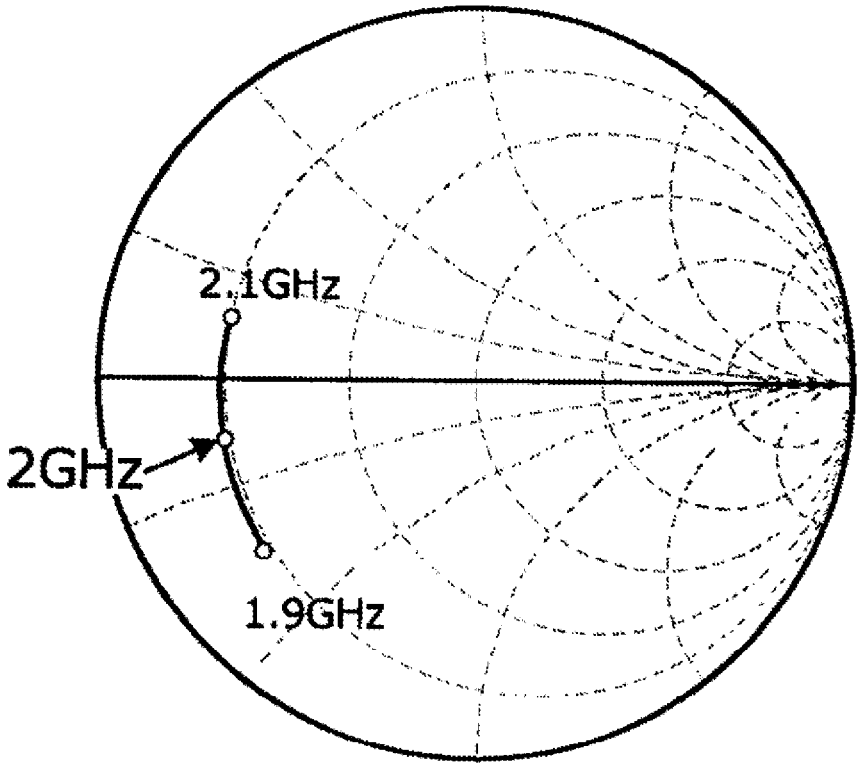
FIG. 34 is a Smith chart showing an input impedance characteristic when the parasitic element 110 is removed from the antenna apparatus 1200 shown in FIG. 30.

FIG. 34 is a Smith chart showing an input impedance characteristic when the parasitic element 110 is removed from the antenna apparatus 1200 shown in FIG. 30. The antenna portion 120 is not electromagnetically coupled with the parasitic element 110, and the input impedance characteristic is distanced from the center of the Smith chart.

Figure 35A:
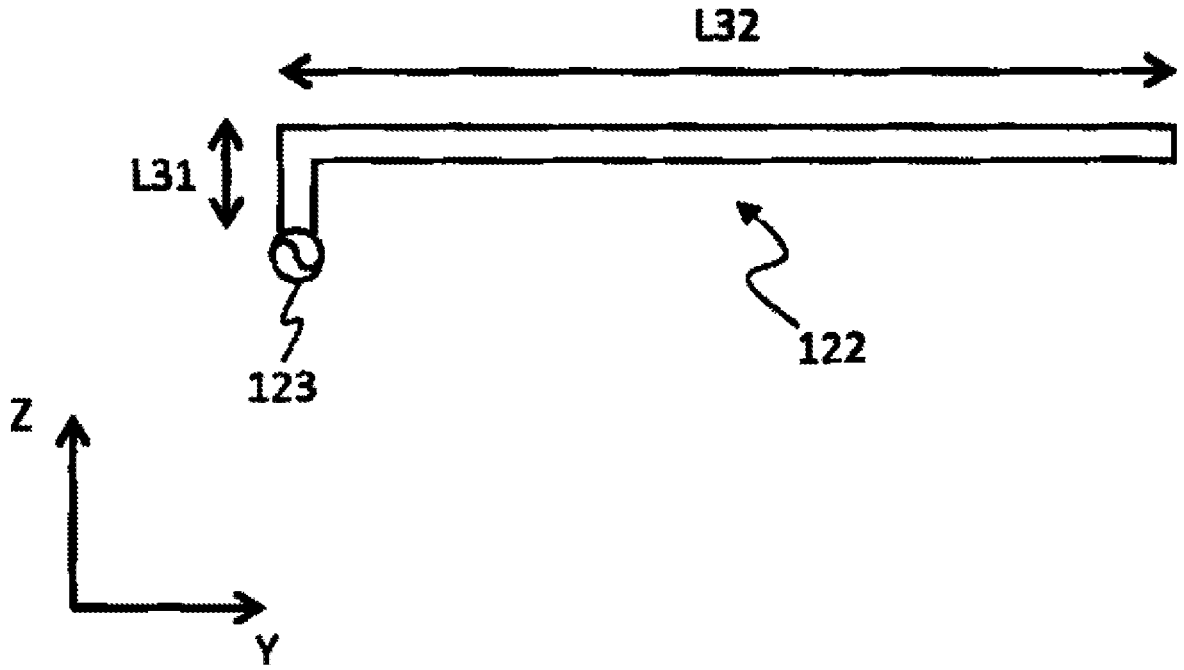
FIG. 35A is a diagram showing an example of the second antenna element 122.

FIG. 35A is a diagram showing an example of the second antenna element 122. The second antenna element 122, similarly to the example shown in FIG. 30, has a part extending in the Z-axis direction and a part extending in the Y-axis direction. The length of the part extending in the Z-axis direction is L31, and the length of the part extending in the Y-axis direction is L32.

Figure 35B:
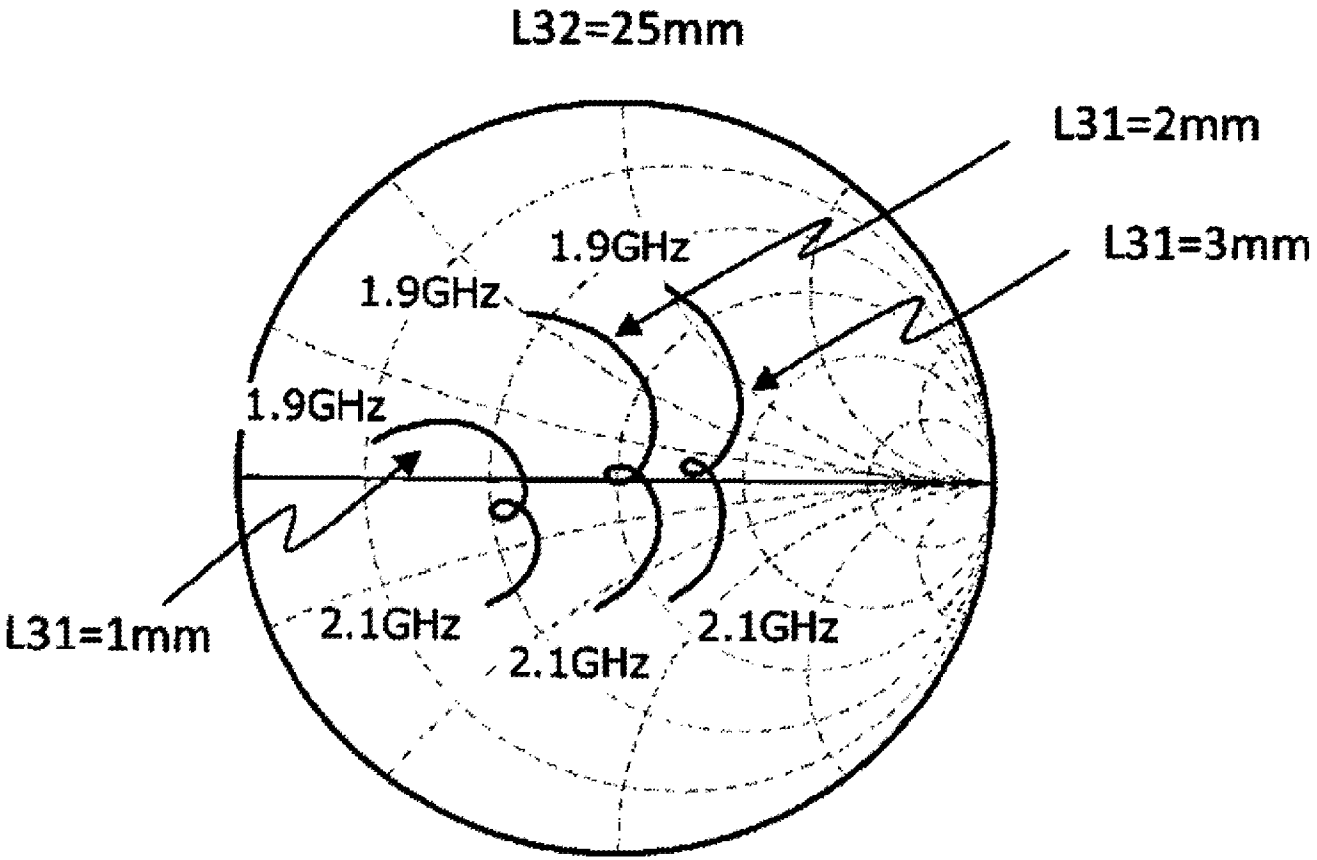
FIG. 35B is a Smith chart showing input impedance characteristics when the length L31 in the Z-axis direction of the second antenna element 122 shown in FIG. 35A is changed.

FIG. 35B is a Smith chart showing input impedance characteristics when the length L31 in the Z-axis direction of the second antenna element 122 shown in FIG. 35A is changed. In the present example, the length L32 in the Y-axis direction is fixed at 25 mm. FIG. 35B shows examples of when L31=1 mm, 2 mm, and 3 mm. As shown in FIG. 25B, it is possible to adjust the resistance of the input impedance by changing the length L31 in the Z-axis direction of the second antenna element 122.

Figure 35C:
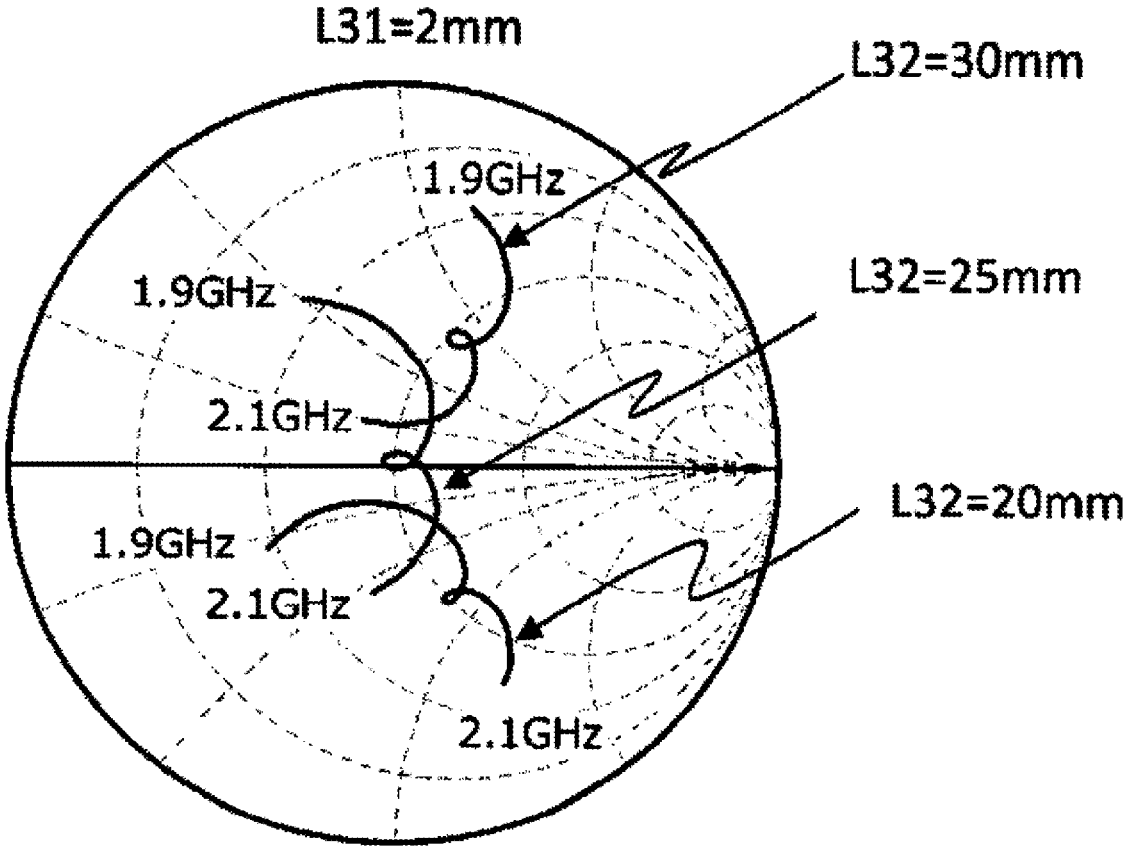
FIG. 35C is a Smith chart showing input impedance characteristics when the length L32 in the Y-axis direction of the second antenna element 122 shown in FIG. 35A is changed.

FIG. 35C is a Smith chart showing input impedance characteristics when the length L32 in the Y-axis direction of the second antenna element 122 shown in FIG. 35A is changed. In the present example, the length L31 in the Z-axis direction is fixed at 2 mm. FIG. 35C shows examples of when L32=30 mm, 25 mm, and 20 mm. As shown in FIG. 35C, it is possible to adjust the reactance of the input impedance by changing the length L32 in the Y-axis direction of the second antenna element 122.

Figure 35D:
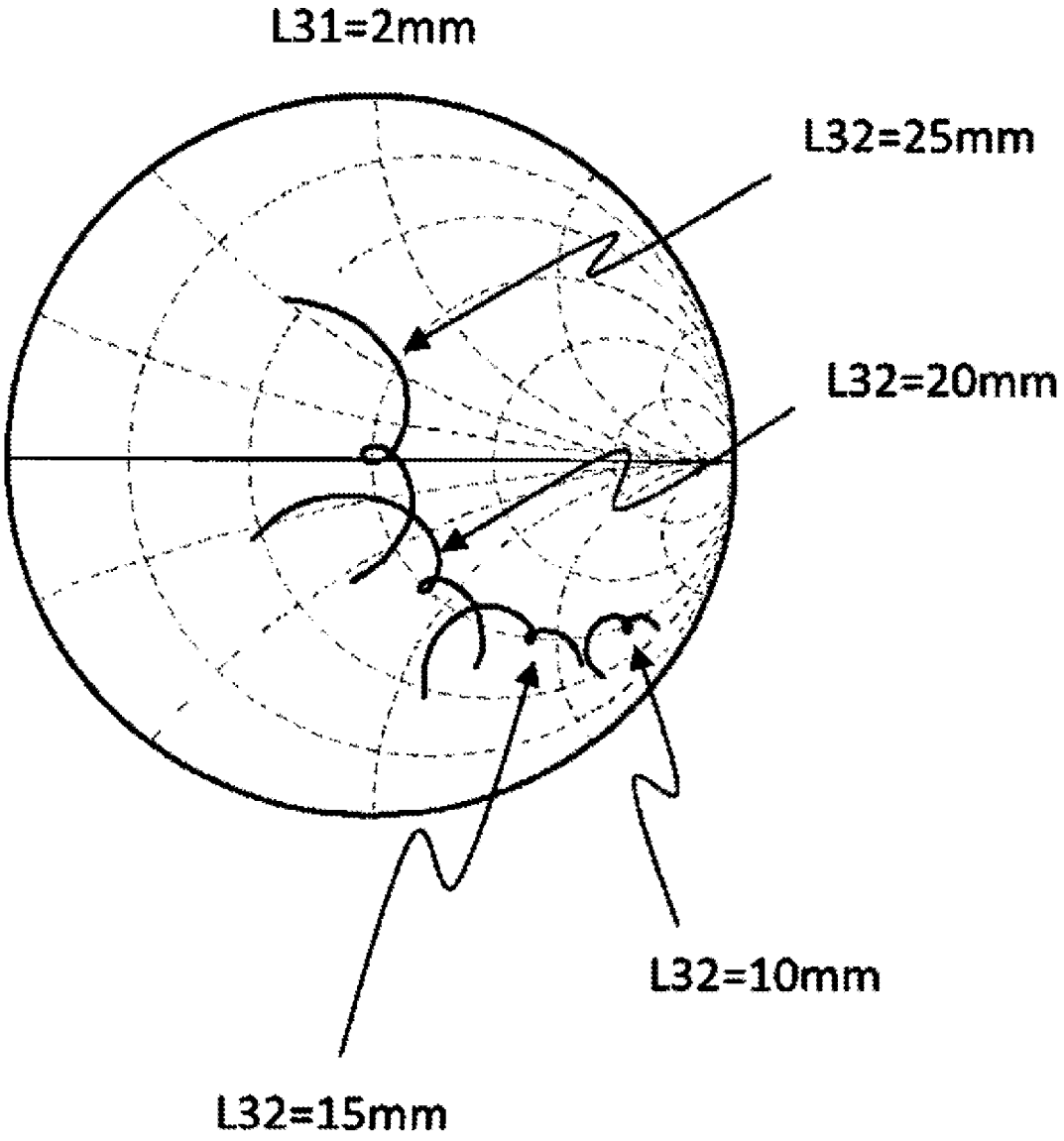
FIG. 35D is a Smith chart showing input impedance characteristics when the length L32 in the Y-axis direction of the second antenna element 122 shown in FIG. 35A is changed.

FIG. 35D is a Smith chart showing input impedance characteristics when the length L32 in the Y-axis direction of the second antenna element 122 shown in FIG. 35A is changed. In the present example, the length L31 in the Z-axis direction is fixed at 2 mm. FIG. 35D shows examples of when L32=25 mm, 20 mm, 15 mm, and 10 mm.

As shown in FIG. 35C and FIG. 35D, as the length L32 of the second antenna element 122 is shortened, the locus of the input impedance characteristics becomes kink-shaped in the bottom-right region of the Smith chart. For this reason, it is possible to widen the bandwidth of the antenna apparatus 1200 by shortening the length L32 of the second antenna element 122.

In addition, as shown in FIG. 35C, in the locus of the input impedance characteristics at the same length L32, the reactance is smaller at higher frequencies. For this reason, it is possible to widen the bandwidth of the antenna apparatus 1200 by loading a series inductor as a matching circuit. It is noted that the inductor may be a chip component, and may be configured by a pattern on a substrate such as a meander or a pattern coil.

Figure 36A:
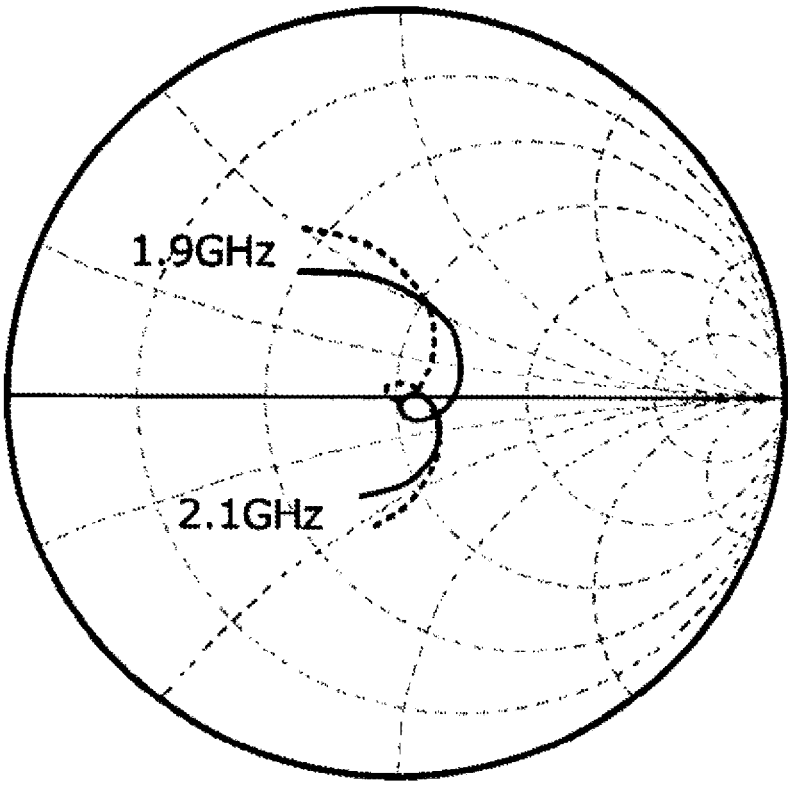
FIG. 36A is a Smith chart showing input impedance characteristics when the length L32 in the Y-axis direction of the second antenna element 122 is 10 mm and a 12 nH inductor is loaded in series as a matching circuit.

FIG. 36A is a Smith chart showing input impedance characteristics when the length L32 in the Y-axis direction of the second antenna element 122 is 10 mm and a 12 nH inductor is loaded in series as a matching circuit. In FIG. 36A, the input impedance characteristic of the antenna apparatus 1200 shown in FIG. 30 is shown as a comparative example.

Figure 36B:
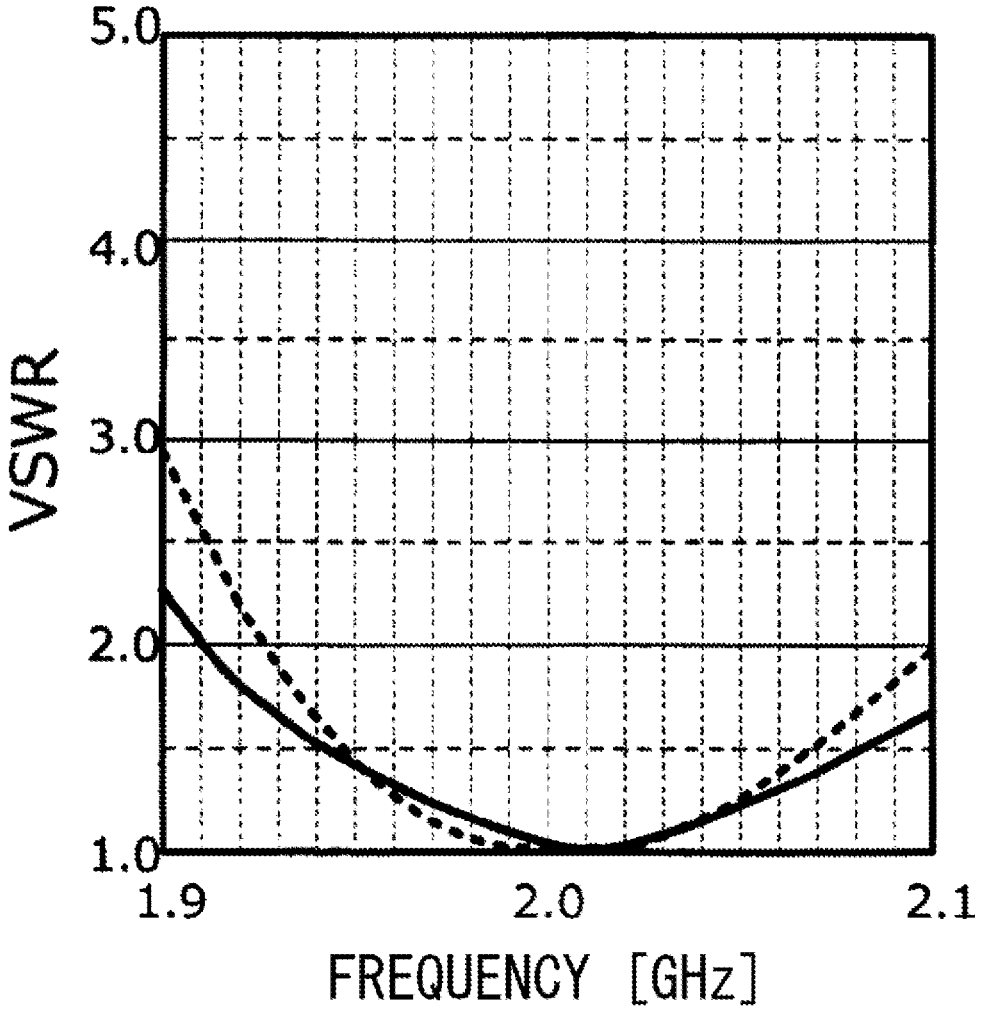
FIG. 36B is a diagram showing VSWR characteristics when the length L32 in the Y-axis direction of the second antenna element 122 is 10 mm and a 12 nH inductor is loaded as a matching circuit.

FIG. 36B is a diagram showing VSWR characteristics when the length L32 in the Y-axis direction of the second antenna element 122 is 10 mm and a 12 nH inductor is loaded as a matching circuit. In FIG. 36B, the input impedance characteristic of the antenna apparatus 1200 shown in FIG. 30 is shown as a comparative example. As shown in FIG. 36A and FIG. 36B, the bandwidth of the antenna apparatus 1200 can be further widened by adjusting the length of the second antenna element 122 and loading an appropriate matching circuit.

Figure 37:
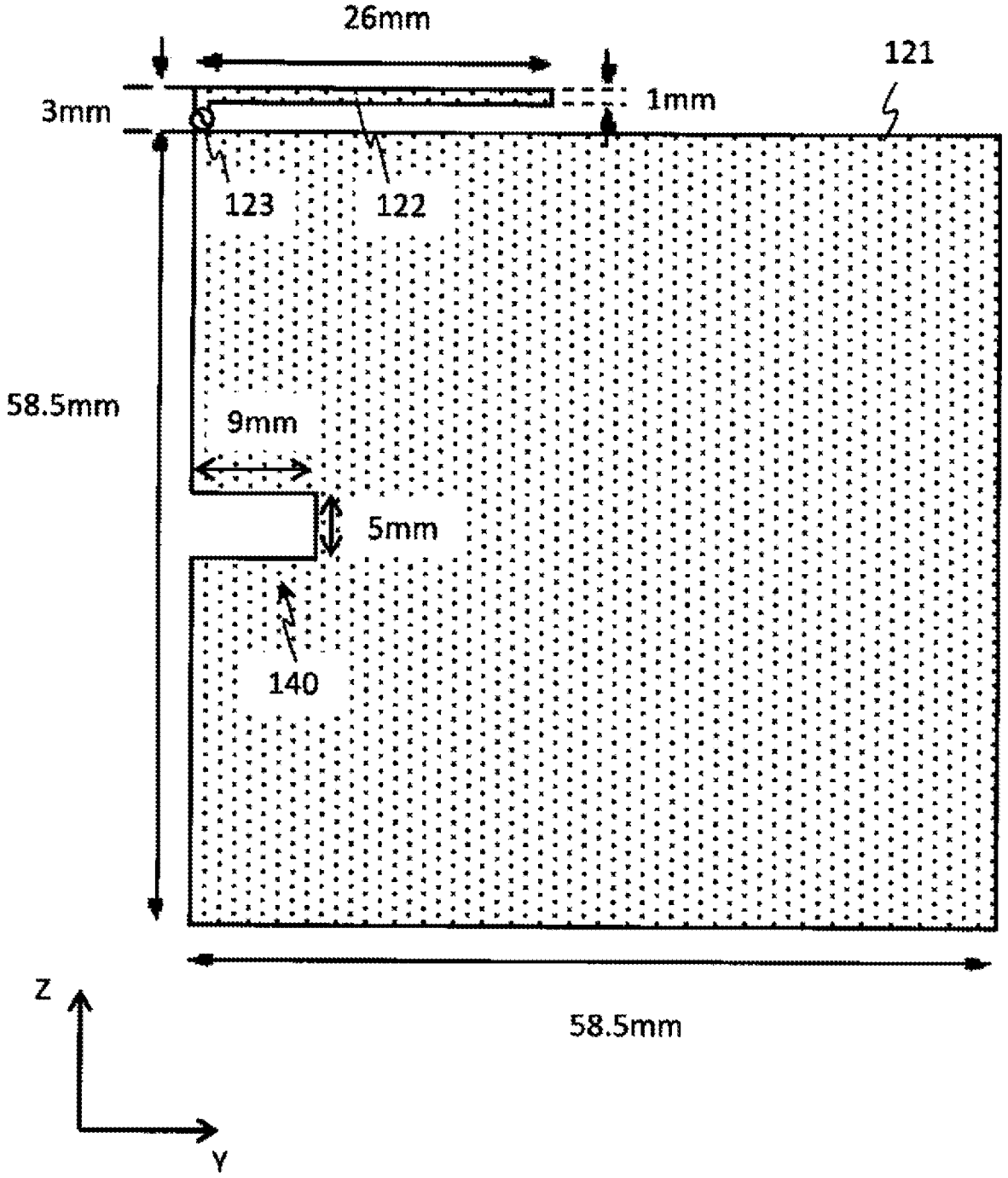
FIG. 37 is a diagram showing an example of a shape on the YZ plane of the first antenna element 121.

FIG. 37 is a diagram showing an example of a shape on the YZ plane of the first antenna element 121. The shape is the same as the antenna apparatus 1200 shown in FIG. 30, except for the shape of the first antenna element 121. However, along with the change of the shape of the first antenna element 121, the length L31 in the Z-axis direction and the length L32 in the Y-axis direction of the second antenna element 122 are adjusted by the method described above. It is noted that it is possible to reverse the turning direction of the circular polarized waves if power is fed from the other opposite corner of the first antenna element 121.

The first antenna element 121 of the present example has a notch 140 on any side of its main surface (YZ plane in this example). The notch 140 may be rectangular, triangular, elliptical, or another shape.

The notch 140 has a size that generates two excitation modes orthogonal to one another with a phase difference of $\pi/2$ in the first antenna element 121. The notch 140 may be provided at the center of any side of the first antenna element 121. The size of the notch 140 in the Y-axis direction and the Z-axis direction may be one-fifth or less of the size of the first antenna element 121 in the Y-axis direction and the Z-axis direction, and may be one-tenth or less.

The length of the first antenna element 121 of the present example is 58.5 mm in both the Y-axis direction and the Z-axis direction. The notch 140 of the present example is provided in the center of a side parallel to the Z-axis direction of the first antenna element 121, has a length of 9 mm in the Y-axis direction, and has a length of 5 mm in the Z-axis direction. It is noted that, as an example, the lengths in the Y-axis direction and the Z-axis direction of the first antenna element 121 are the same, but they are not limited to this. If the size of the notch 140 is adjusted, it is possible to generate two excitation modes orthogonal to one another.

Figure 38A:
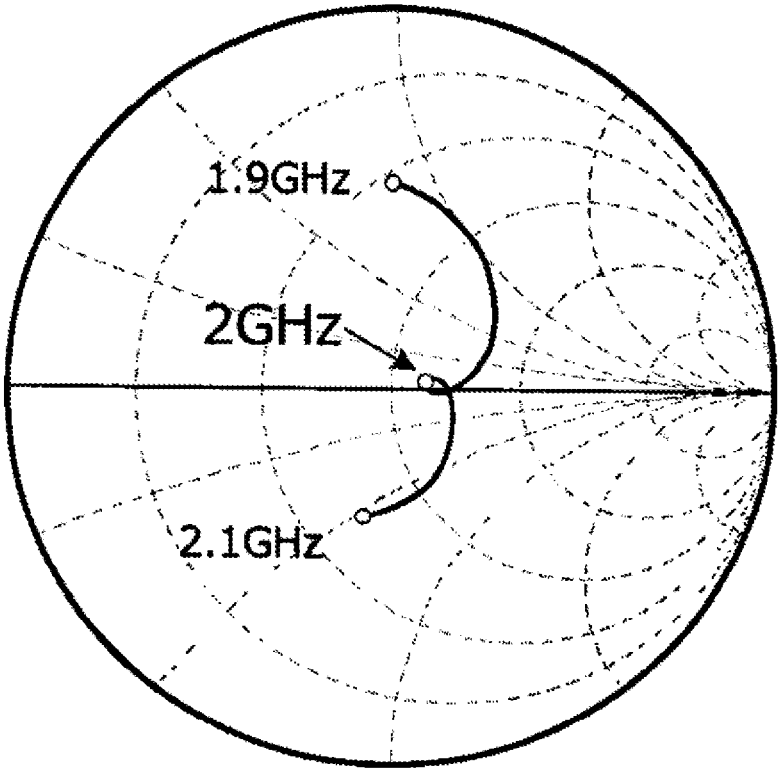
FIG. 38A is a Smith chart showing an input impedance characteristic when the antenna portion 120 shown in FIG. 37 is used in the antenna apparatus 1200.
Figure 38B:
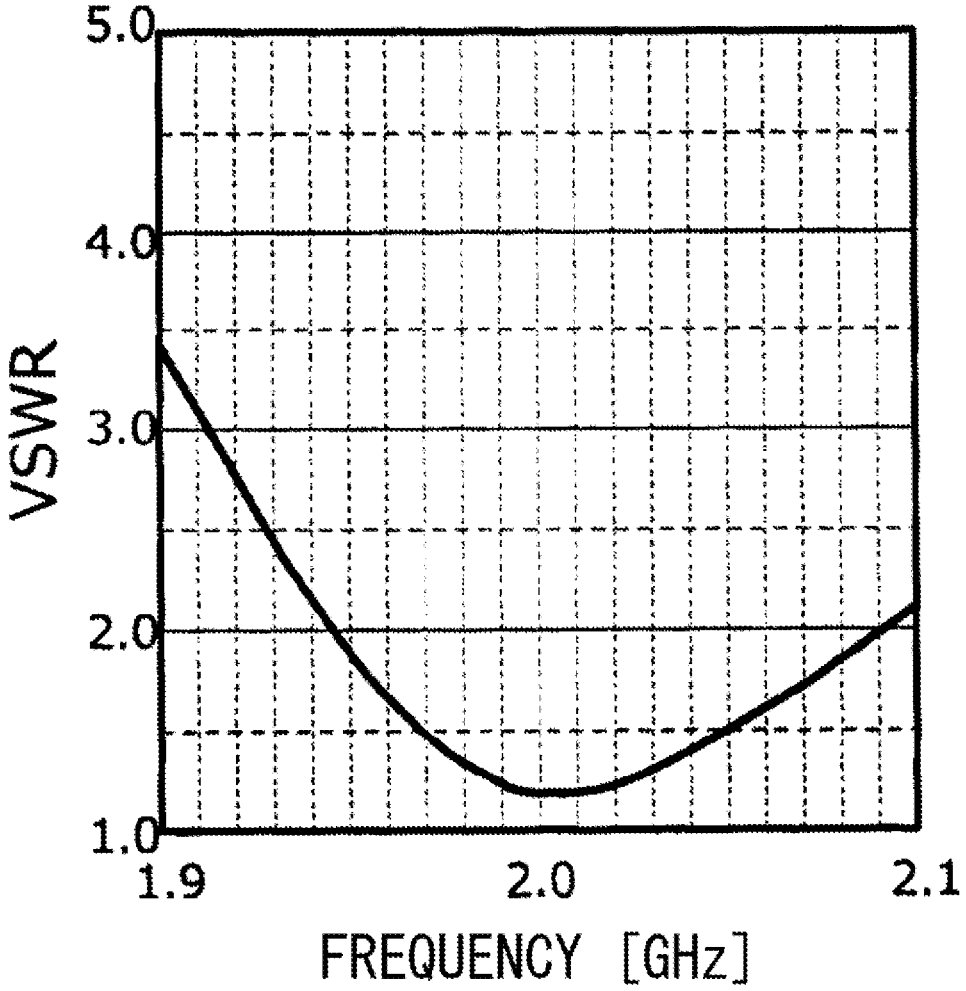
FIG. 38B is a diagram showing a VSWR characteristic of the antenna apparatus.
Figure 38C:
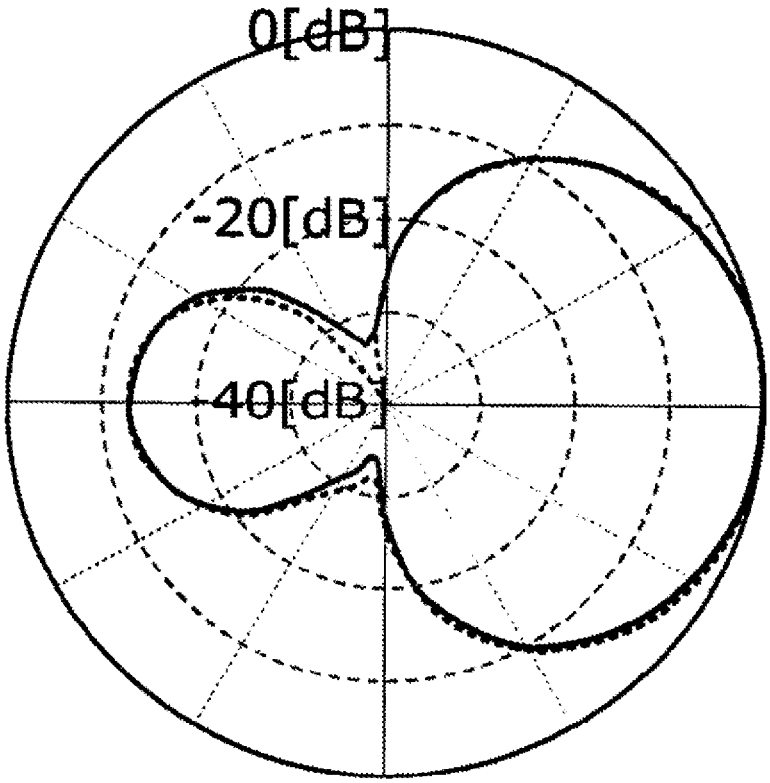
FIG. 38C is a diagram showing radiation patterns on the XY plane and the XZ plane at a frequency of 2 GHz of the antenna apparatus.

FIG. 38A is a Smith chart showing an input impedance characteristic when the antenna portion 120 shown in FIG. 37 is used in the antenna apparatus 1200. FIG. 38B is a diagram showing a VSWR characteristic of the antenna apparatus. FIG. 38C is a diagram showing radiation patterns at a frequency of 2 GHz of the antenna apparatus. However, the solid line shows the Eθ component on the XY plane, and the dotted line shows the EΦ component on the XZ plane. The radiation patterns are normalized with the maximum value.

As shown in FIG. 38A and FIG. 38B, even if the notch 140 is provided in the first antenna element 121, resonance can be seen at 2 GHz. In addition, as shown in FIG. 38C, the antenna apparatus functions as a circularly polarized antenna. Furthermore, since the parasitic element 110 operates as a reflector, it is possible to make the radiation pattern intensity on the parasitic element 110 side, that is, the radiation pattern intensity on the negative X-axis side of FIG. 30, smaller than the radiation pattern intensity on the positive X-axis side. For this reason, it is possible to reduce the SAR.

Figure 39:
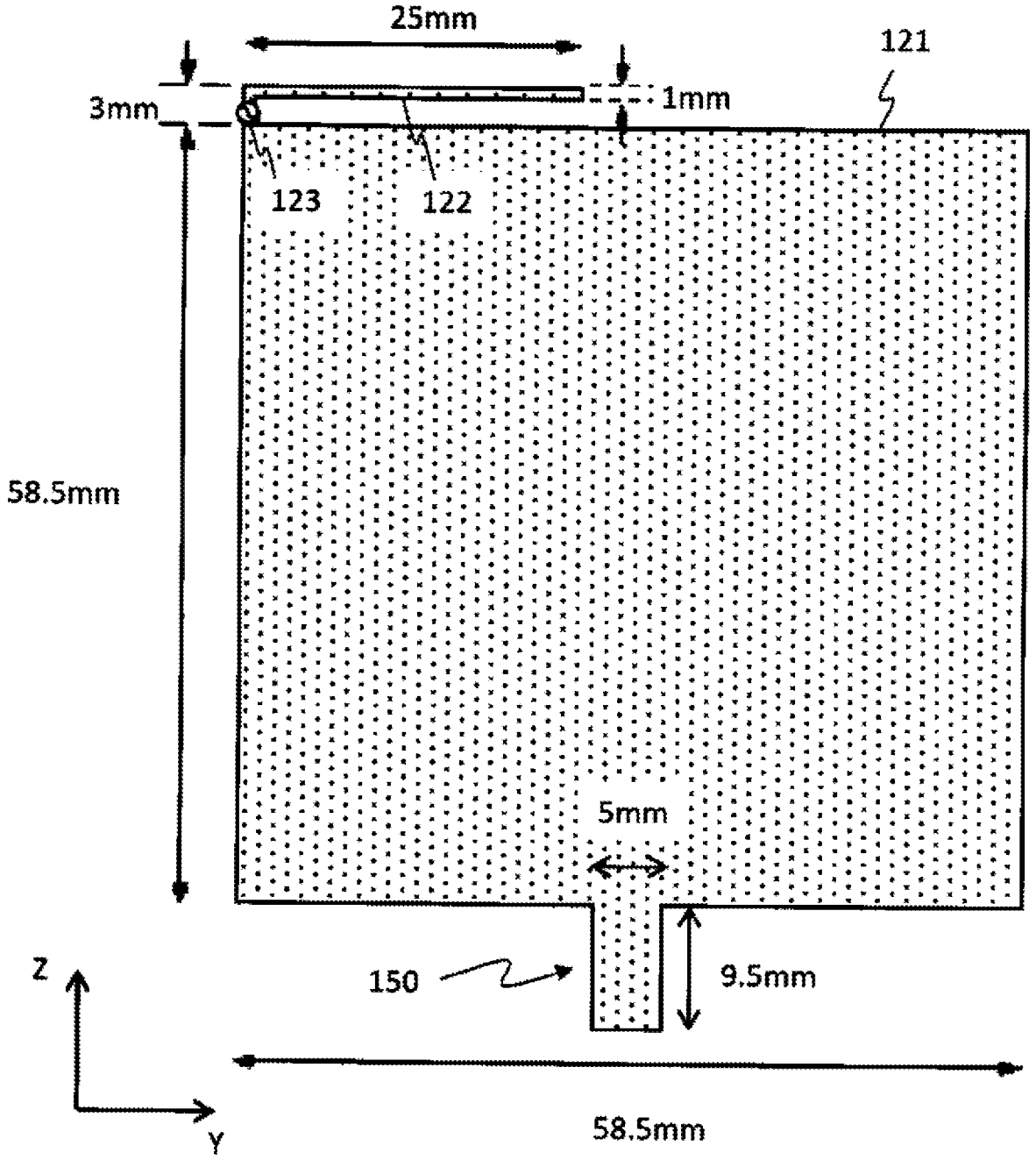
FIG. 39 is a diagram showing an example of a shape on the YZ plane of the first antenna element 121.

FIG. 39 is a diagram showing an example of a shape on the YZ plane of the first antenna element 121. The shape is the same as the antenna apparatus 1200 shown in FIG. 30, except for the shape of the first antenna element 121. However, along with the change of the shape of the first antenna element 121, the length L31 in the Z-axis direction and the length L32 in the Y-axis direction of the second antenna element 122 are adjusted by the method described above. It is noted that it is possible to reverse the turning direction of the circular polarized waves if power is fed from the other opposite corner of the first antenna element 121.

The first antenna element 121 of the present example has a projection 150 on any side of its main surface (YZ plane in this example). The projection 150 may be rectangular, triangular, elliptical, or another shape.

The projection 150 has a size that generates two excitation modes orthogonal to one another with a phase difference of $\pi/2$ in the first antenna element 121. The projection 150 may be provided at the center of any side of the first antenna element 121. The size of the projection 150 in the Y-axis direction and the Z-axis direction may be one-fifth or less of the size of the first antenna element 121 in the Y-axis direction and the Z-axis direction, and may be one-tenth or less.

The length of the first antenna element 121 of the present example is 58.5 mm in both the Y-axis direction and the Z-axis direction. The projection 150 of the present example is provided in the center of a side parallel to the Z-axis direction of the first antenna element 121, has a length of 5 mm in the Y-axis direction, and has a length of 9.5 mm in the Z-axis direction. It is noted that, as an example, the lengths in the Y-axis direction and the Z-axis direction of the first antenna element 121 are the same, but they are not limited to this. If the size of the projection 150 is adjusted, it is possible to generate two excitation modes orthogonal to one another.

Figure 40A:
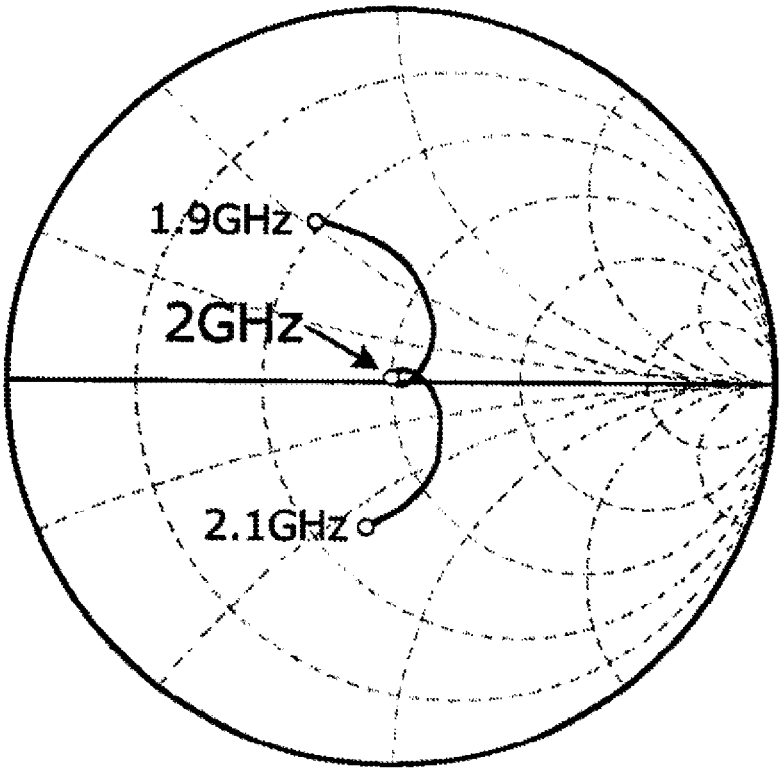
FIG. 40A is a Smith chart showing an input impedance characteristic when the antenna portion 120 shown in FIG. 39 is used in the antenna apparatus 1200.
Figure 40B:
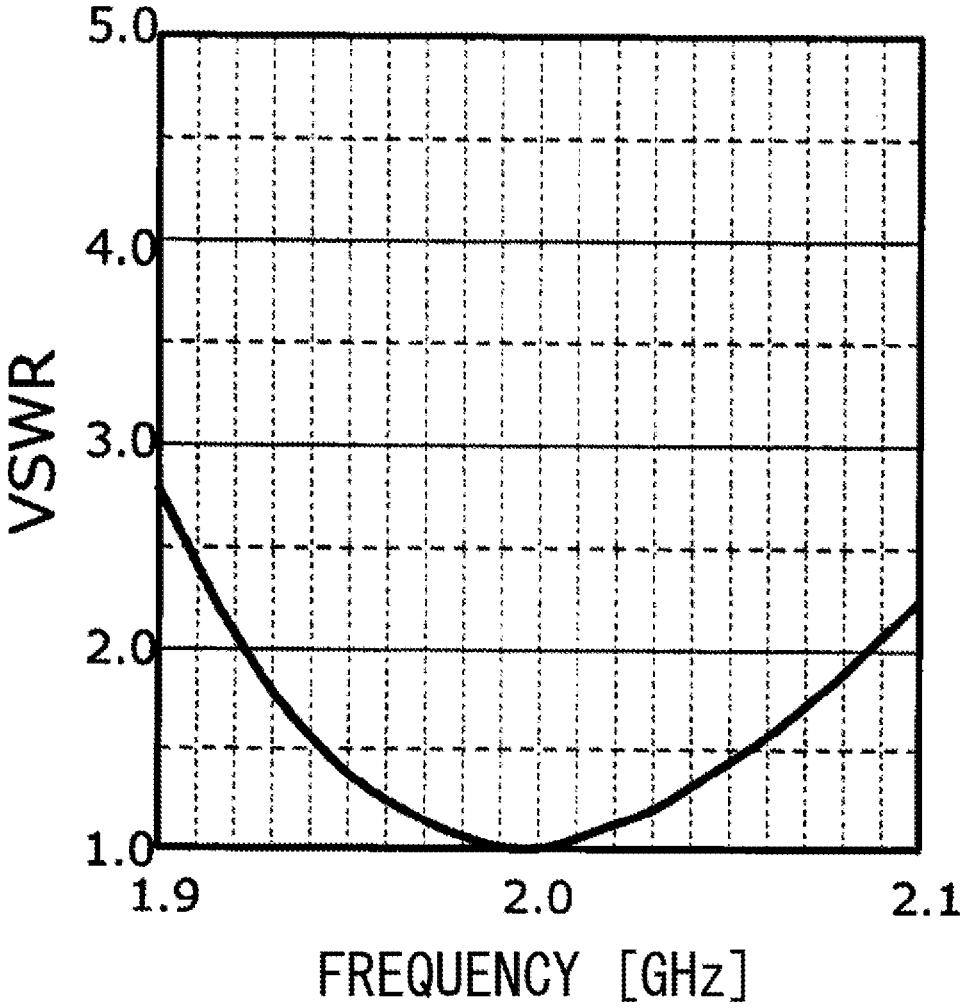
FIG. 40B is a diagram showing a VSWR characteristic of the antenna apparatus.
Figure 40C:
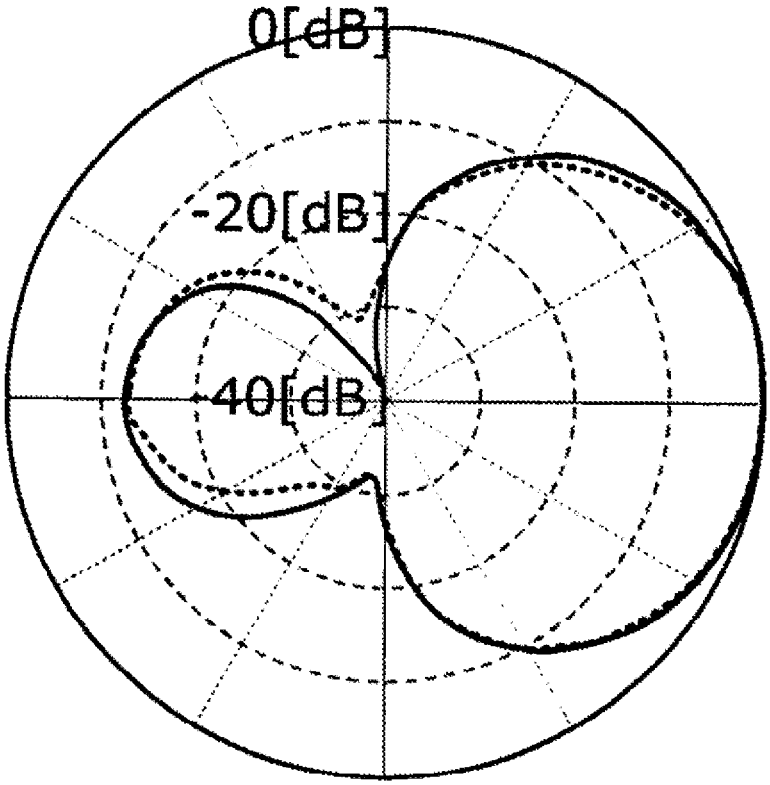
FIG. 40C is a diagram showing radiation patterns on the XY plane and the XZ plane at a frequency of 2 GHz of the antenna apparatus.

FIG. 40A is a Smith chart showing an input impedance characteristic when the antenna portion 120 shown in FIG. 39 is used in the antenna apparatus 1200. FIG. 40B is a diagram showing a VSWR characteristic of the antenna apparatus. FIG. 40C is a diagram showing radiation patterns at a frequency of 2 GHz of the antenna apparatus. However, the solid line shows the Eθ component on the XY plane, and the dotted line shows the EΦ component on the XZ plane. The radiation patterns are normalized with the maximum value.

As shown in FIG. 40A and FIG. 40B, even if the projection 150 is provided in the first antenna element 121, resonance can be seen at 2 GHz. In addition, as shown in FIG. 40C, the antenna apparatus functions as a circularly polarized antenna. Furthermore, since the parasitic element 110 operates as a reflector, it is possible to make the radiation pattern intensity on the parasitic element 110 side, that is, the radiation pattern intensity on the negative X-axis side of FIG. 30, smaller than the radiation pattern intensity on the positive X-axis side. For this reason, it is possible to reduce the SAR.

Figure 41A:
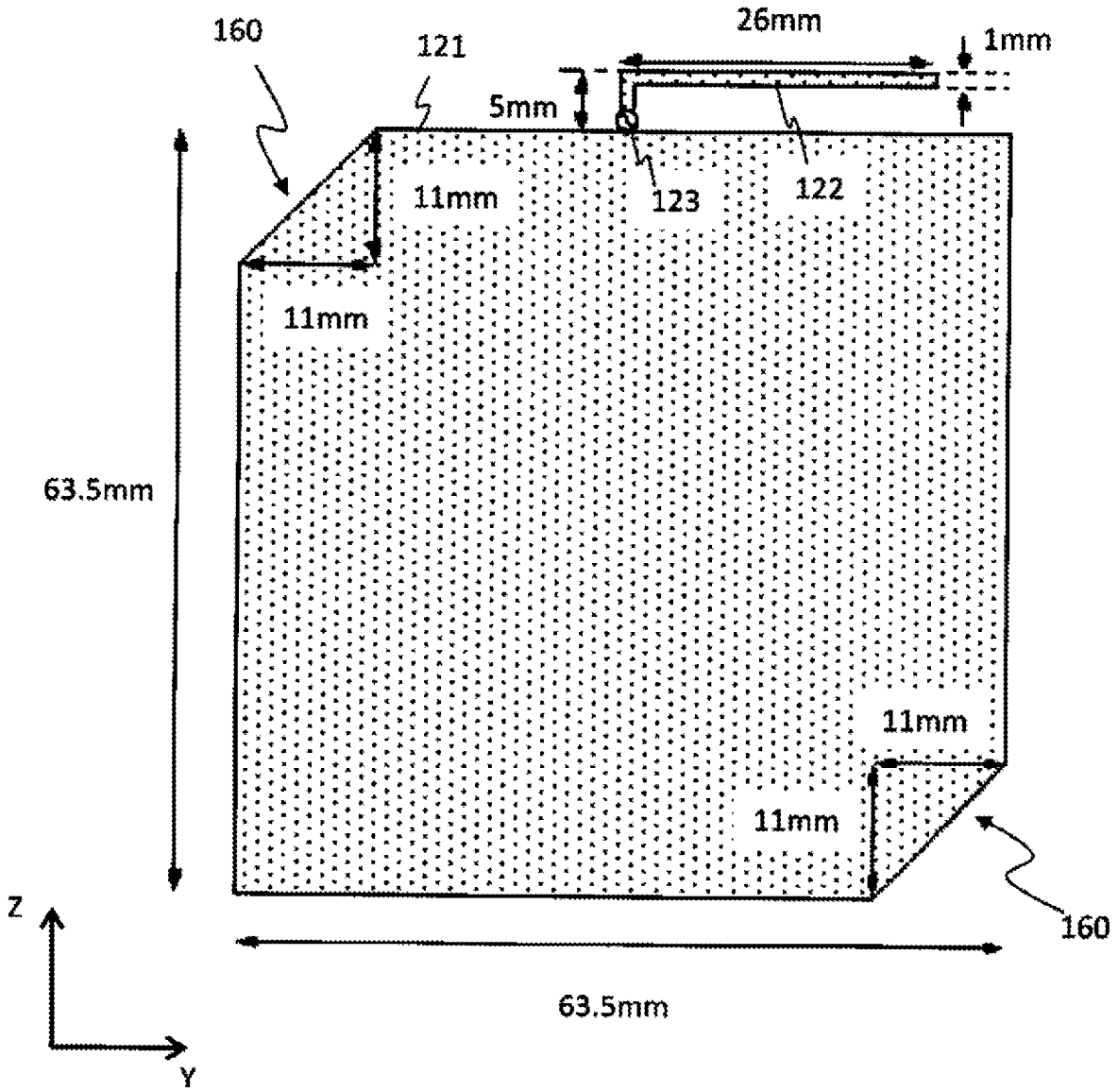
FIG. 41A is a diagram showing an example of a shape on the YZ plane of the first antenna element 121.

FIG. 41A is a diagram showing an example of a shape on the YZ plane of the first antenna element 121. The shape is the same as the antenna apparatus 1200 shown in FIG. 30, except for the shape of the first antenna element 121. However, along with the change of the shape of the first antenna element 121, the length L31 in the Z-axis direction and the length L32 in the Y-axis direction of the second antenna element 122 are adjusted by the method described above. In addition, the position of the power feeding portion 123 is adjusted.

The first antenna element 121 of the present example has a plurality of notches 160 on any sides of its main surface (YZ plane in this example). The number of the notches 160 may be an even number. One set of the notches 160 is provided at opposite positions on the main surface of the first antenna element 121. The notches 160 of the present example are provided at two opposite vertices of the first antenna element 121. The notches 160 may be rectangular, triangular, elliptical, or another shape. It is noted that it is possible to reverse the turning direction of the circular polarized waves if the notches 160 are provided on the other two opposite vertices of the first antenna element 121.

In the present example, the power feeding portion 123 is disposed at the center of any side of the first antenna element 121. By feeding power from the center of the first antenna element 121 and adjusting the length, width, and notch size of the first antenna element 121, it is possible to generate two excitation modes orthogonal to one another.

The size of the notches 160 in the Y-axis direction and the Z-axis direction may be one-fifth or less of the size of the first antenna element 121 in the Y-axis direction and the Z-axis direction, and may be one-tenth or less.

The length of the first antenna element 121 of the present example is 63.5 mm in both the Y-axis direction and the Z-axis direction. The notches 160 of the present example are right triangles having a length of 11 mm in both the Y-axis direction and the Z-axis direction. It is noted that, as an example, the lengths in the Y-axis direction and the Z-axis direction of the first antenna element 121 are the same, but they are not limited to this. If the size of the notches 160 is adjusted, it is possible to generate two excitation modes orthogonal to one another.

It is noted that the second antenna element 122 of the present example has an inverted L-shape having a length of 5 mm in the Z-axis direction and a length of 26 mm in the Y-axis direction. The second antenna element 122 in another example may have a T-shape similarly to the second antenna element 122 shown in FIG. 28. Even in this case, the length of the part extending in the Z-axis direction and the length of the part extending in the Y-axis direction may be adjusted by the same method as the inverted L-shape described above. When the power feeding portion 123 is provided at the midpoint of the side of the second antenna element 122, the T-shape of the second antenna element 122 makes it possible for the left-right symmetry of the antenna portion 120 to be improved. It is noted that the present method can also be applied to the antenna apparatuses according to the first example to the sixth example when the second antenna element 122 has an inverted L-shape or a T-shape.

Figure 41B:
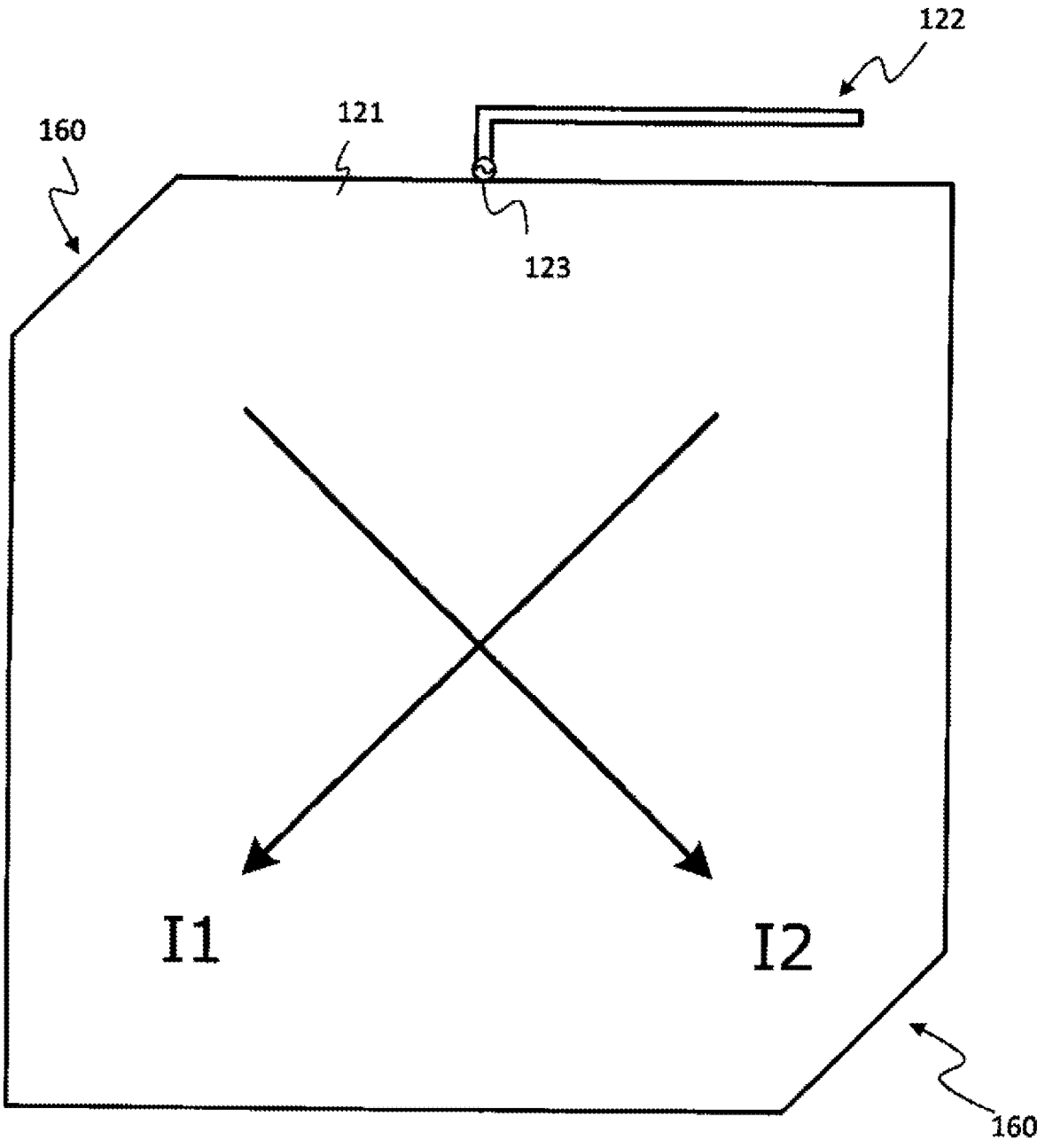
FIG. 41B is a diagram schematically showing the current I1 and the current I2 of the first antenna element 121 shown in FIG. 41A.

FIG. 41B is a diagram schematically showing the current I1 and the current I2 of the first antenna element 121 shown in FIG. 41A. In the present example, the current I1 and the current I2 flow along diagonals of the first antenna element 121.

Figure 42A:
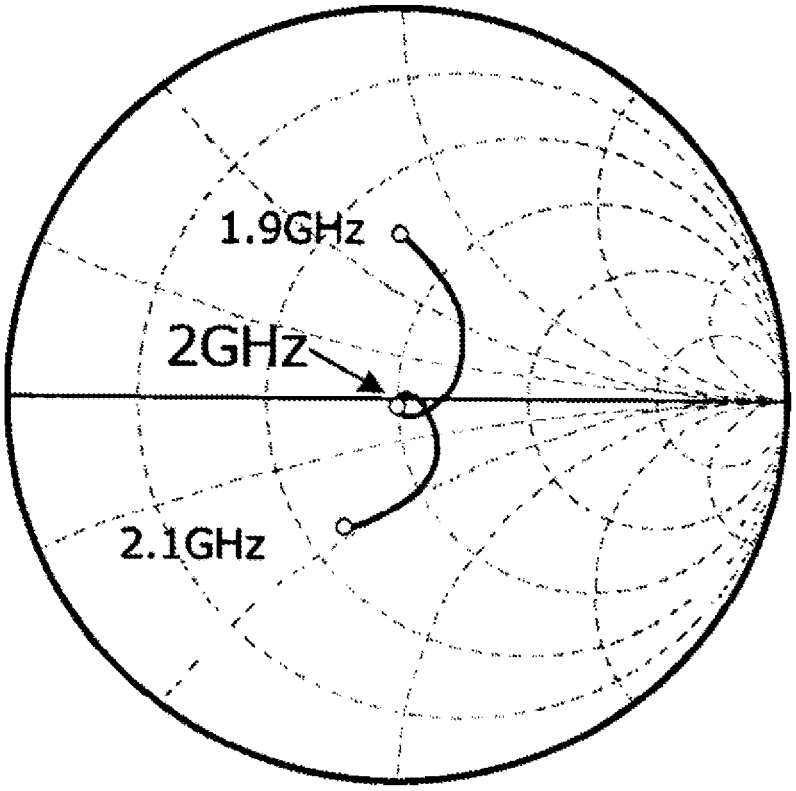
FIG. 42A is a Smith chart showing an input impedance characteristic when the antenna portion 120 shown in FIG. 41A is used in the antenna apparatus 1200.
Figure 42B:
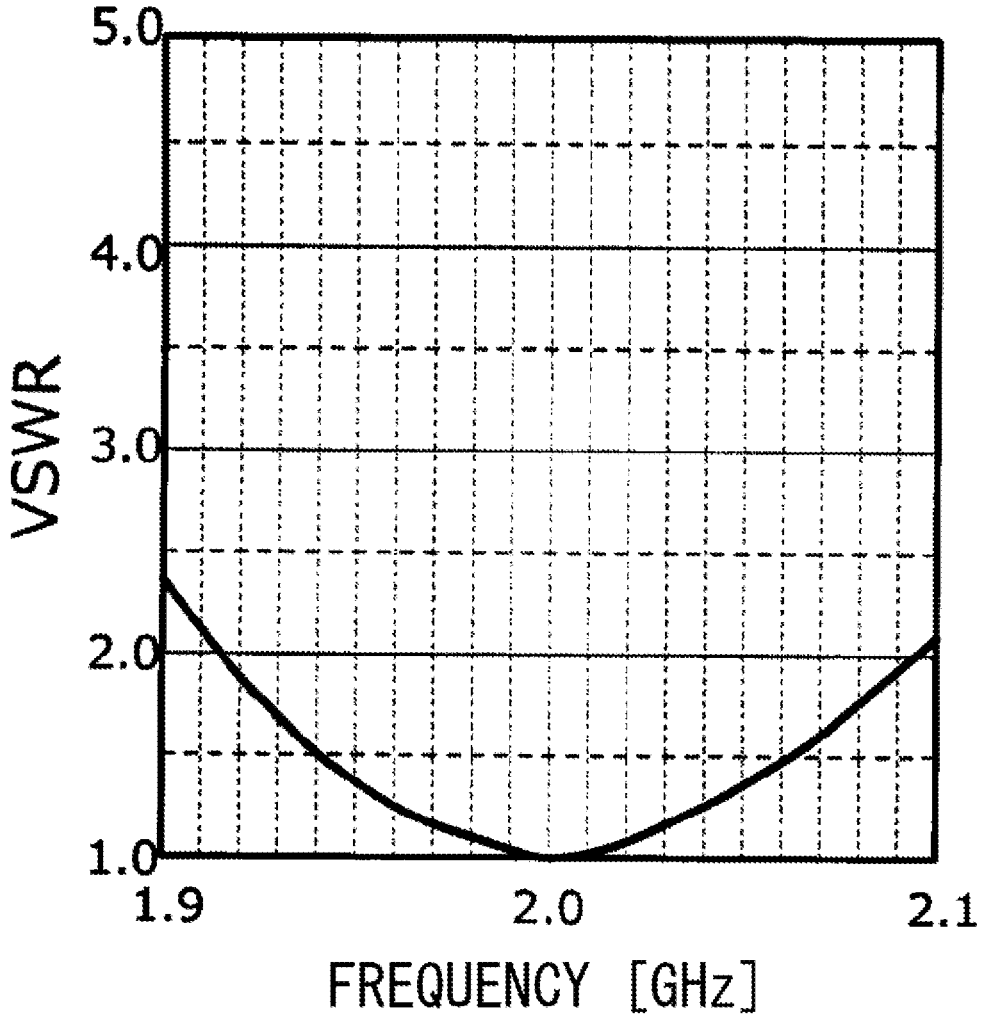
FIG. 42B is a diagram showing a VSWR characteristic of the antenna apparatus.
Figure 42C:
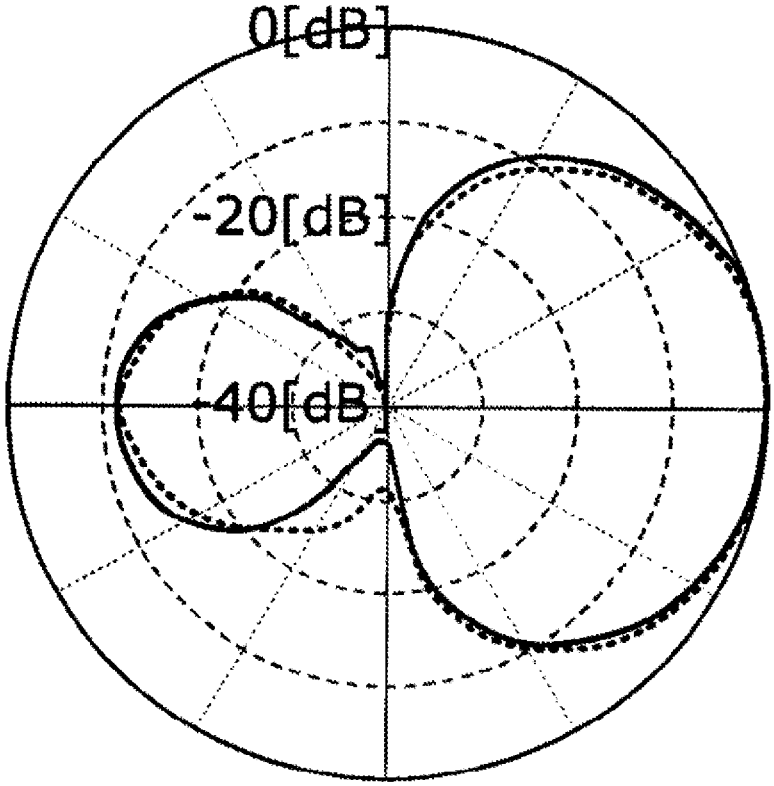
FIG. 42C is a diagram showing radiation patterns on the XY plane and the XZ plane at a frequency of 2 GHz of the antenna apparatus.

FIG. 42A is a Smith chart showing an input impedance characteristic when the antenna portion 120 shown in FIG. 41A is used in the antenna apparatus 1200. FIG. 42B is a diagram showing a VSWR characteristic of the antenna apparatus. FIG. 42C is a diagram showing radiation patterns at a frequency of 2 GHz of the antenna apparatus. However, the solid line shows the Eθ component on the XY plane, and the dotted line shows the Eθ component on the XZ plane. The radiation patterns are normalized with the maximum value.

As shown in FIG. 42A and FIG. 42B, even if the notches 160 are provided in the first antenna element 121, resonance can be seen at 2 GHz. In addition, as shown in FIG. 42C, the antenna apparatus functions as a circularly polarized antenna. Furthermore, since the parasitic element 110 operates as a reflector, it is possible to make the radiation pattern intensity on the parasitic element 110 side, that is, the radiation pattern intensity on the negative X-axis side of FIG. 30, smaller than the radiation pattern intensity on the positive X-axis side. For this reason, it is possible to reduce the SAR.

Figure 43:
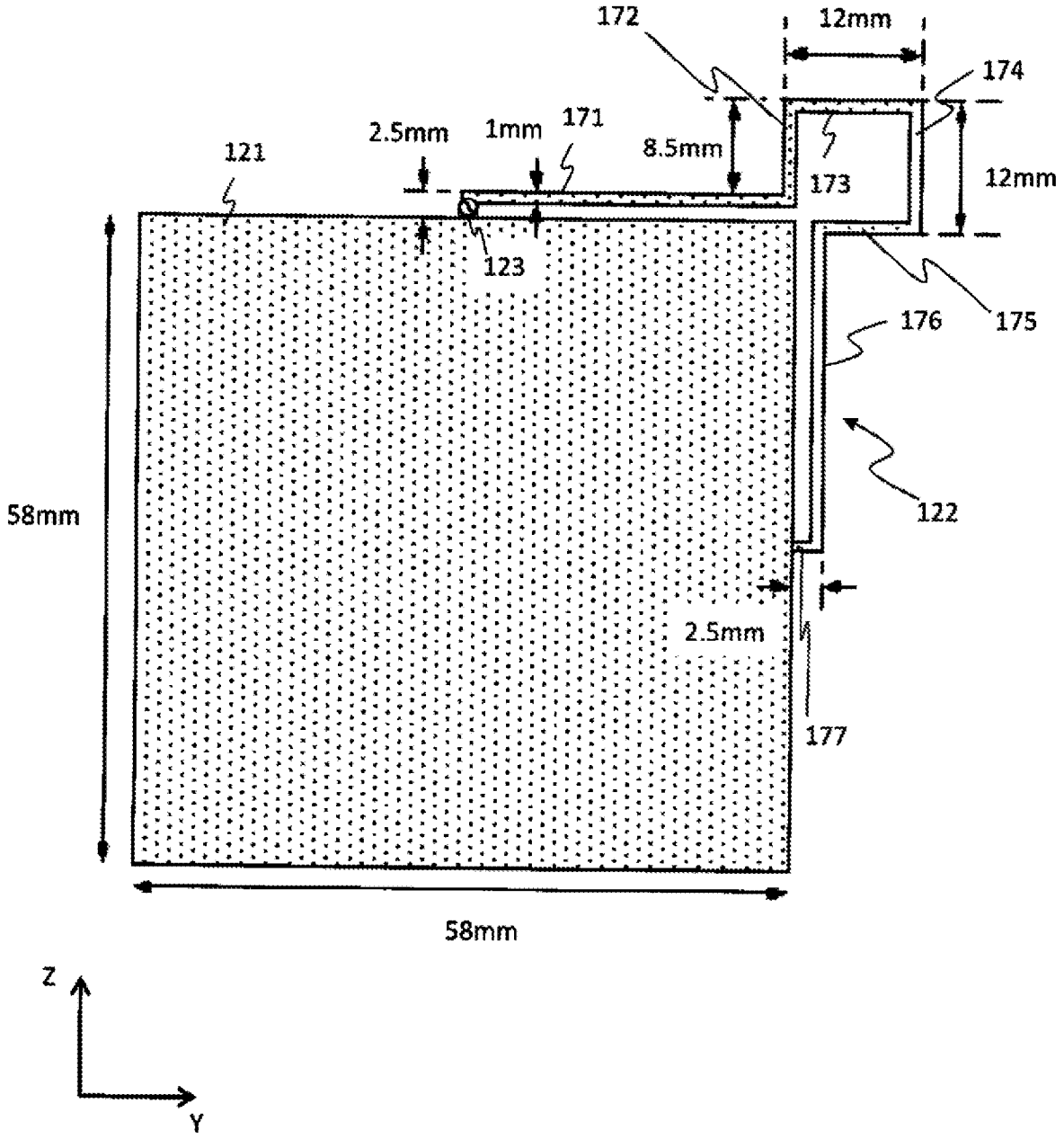
FIG. 43 is a diagram showing an example of a shape on the YZ plane of the second antenna element 122.

FIG. 43 is a diagram showing an example of a shape on the YZ plane of the second antenna element 122. The shape is the same as the antenna apparatus 1200 shown in FIG. 30, except for the shape of the second antenna element 122.

One end of the second antenna element 122 is connected to the power feeding portion 123, and the other end is connected to a side of the main surface of the first antenna element 121 on which the power feeding portion 123 is not provided. The other end of the second antenna element 122 may be connected to a side perpendicular to the side of the main surface of the first antenna element 121 on which the power feeding portion 123 is provided. The power feeding portion 123 of the present example is disposed in the center of a side parallel to the Y-axis direction of the main surface of the first antenna element 121, and the other end of the second antenna element 122 is connected to the center of the side parallel to the Z-axis direction of the main surface of the first antenna element 121.

The second antenna element 122 delays a phase of a signal transmitted in the section from the one end connected to the power feeding portion 123 and the other end connected to the first antenna element 121 by $3\pi/2$.

The second antenna element 122 may have a line-symmetric shape with respect to a specific axis. The second antenna element 122 of the present example has a line-symmetric shape with respect to the axis of symmetry between the Z-axis and the Y-axis. A part 177 of the second antenna element 122 of the present example is provided at a position symmetrical to that of the power feeding portion 123.

A part 171 extends in the Y-axis direction from the power feeding portion 123. A part 176 extends in the Z-axis direction from the part 177. The part 171 and the part 176 are provided at symmetrical positions and have the same length.

A part 172 extends in the Z-axis direction from an end portion of the part 171. A part 175 extends in the Y-axis direction from an end portion of the part 176. The part 172 and the part 175 are provided at symmetrical positions and have the same length.

A part 173 extends in the Y-axis direction from an end portion of the part 172. A part 174 extends in the Z-axis direction from an end portion of the part 175. The part 173 and the part 174 are provided at symmetrical positions and have the same length. End portions of the part 173 and the part 174 are connected to one another. As a result, the second antenna element 122 is formed.

Figure 44:
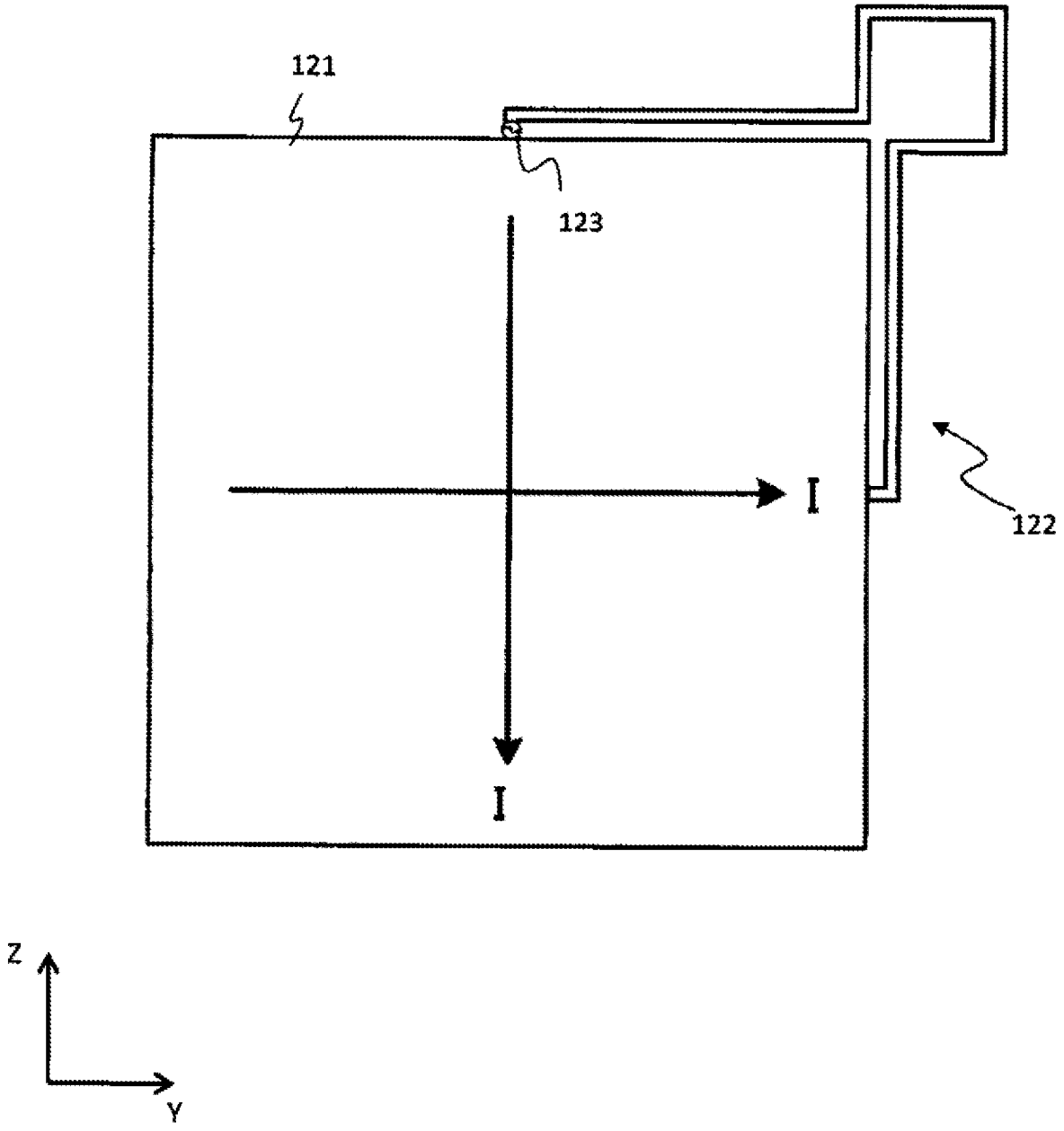
FIG. 44 is a diagram schematically showing currents I in the antenna portion 120 shown in FIG. 43.

FIG. 44 is a diagram schematically showing currents I having a phase difference of $\pi/2$ and orthogonal to one another in the antenna portion 120 shown in FIG. 43. If the resonance frequency corresponding to the currents I is a frequency f, circularly polarized waves are radiated at the frequency f.

Figure 45A:
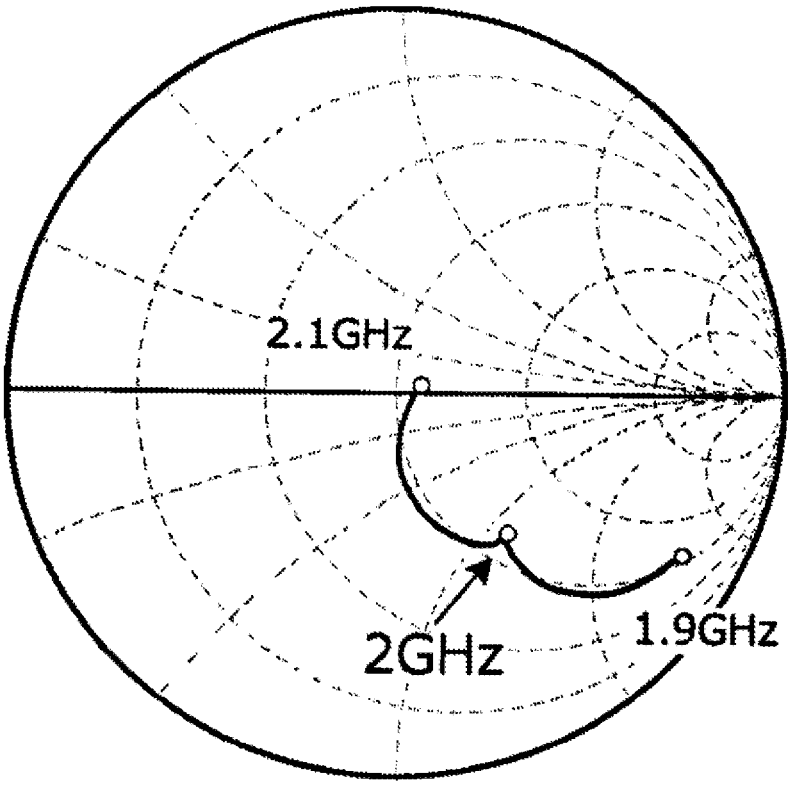
FIG. 45A is a Smith chart showing an input impedance characteristic of the antenna apparatus 1200 using the antenna portion 120 shown in FIG. 43.
Figure 45B:
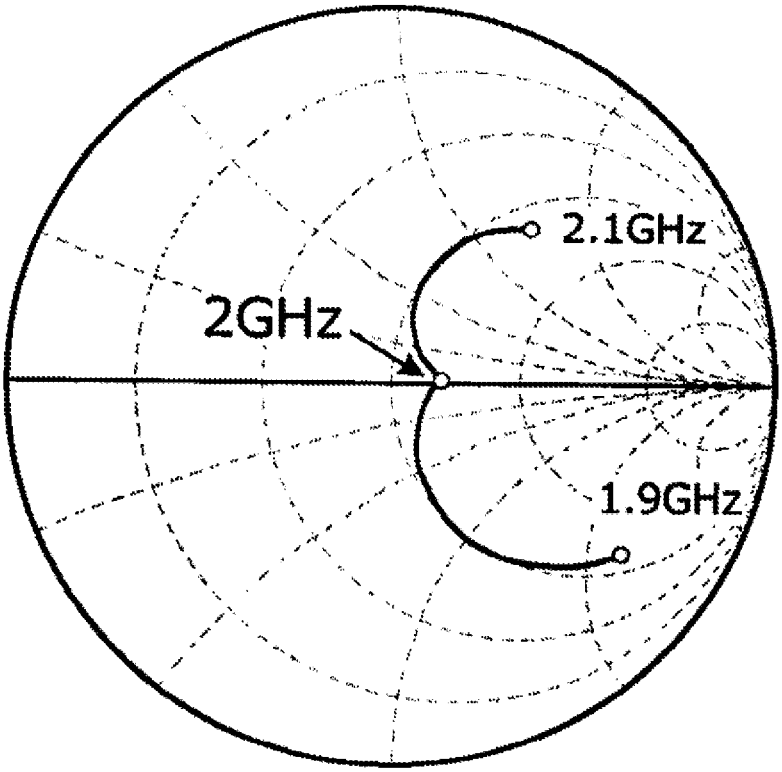
FIG. 45B is a Smith chart showing an input impedance characteristic of the antenna apparatus 1200 using the antenna portion 120 shown in FIG. 43 when a 4.5 nH inductor is loaded in series as a matching circuit.

FIG. 45A is a Smith chart showing an input impedance characteristic of the antenna apparatus 1200 using the antenna portion 120 shown in FIG. 43. FIG. 45B is a Smith chart showing an input impedance characteristic of the antenna apparatus 1200 using the antenna portion 120 shown in FIG. 43 when a 4.5 nH inductor is loaded in series as a matching circuit. As shown in FIG. 45A and FIG. 45B, it is possible in the antenna apparatus also to adjust the input impedance characteristics using a matching circuit. It is noted that the inductor may be a chip component, and may be configured by a pattern on a substrate such as a meander or a pattern coil.

Figure 45C:
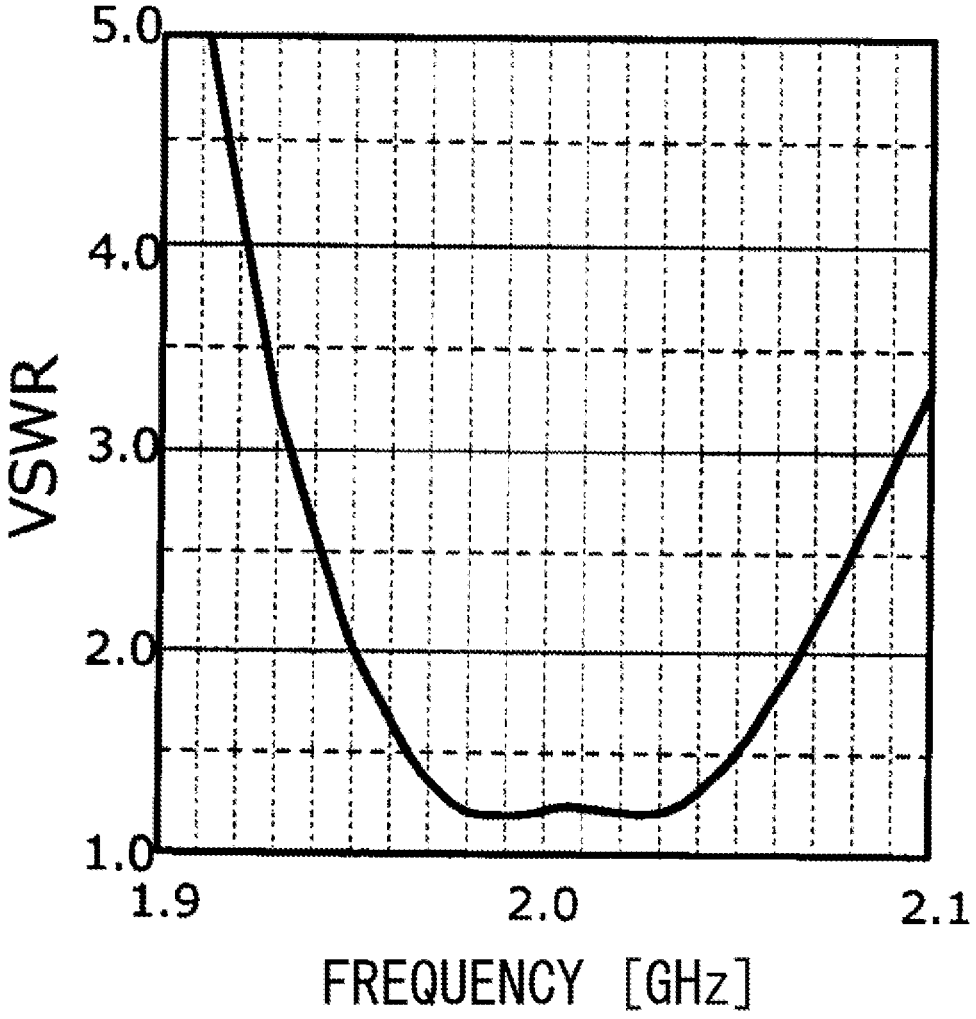
FIG. 45C is a diagram showing a VSWR characteristic of the antenna apparatus 1200 shown in FIG. 45B.
Figure 45D:
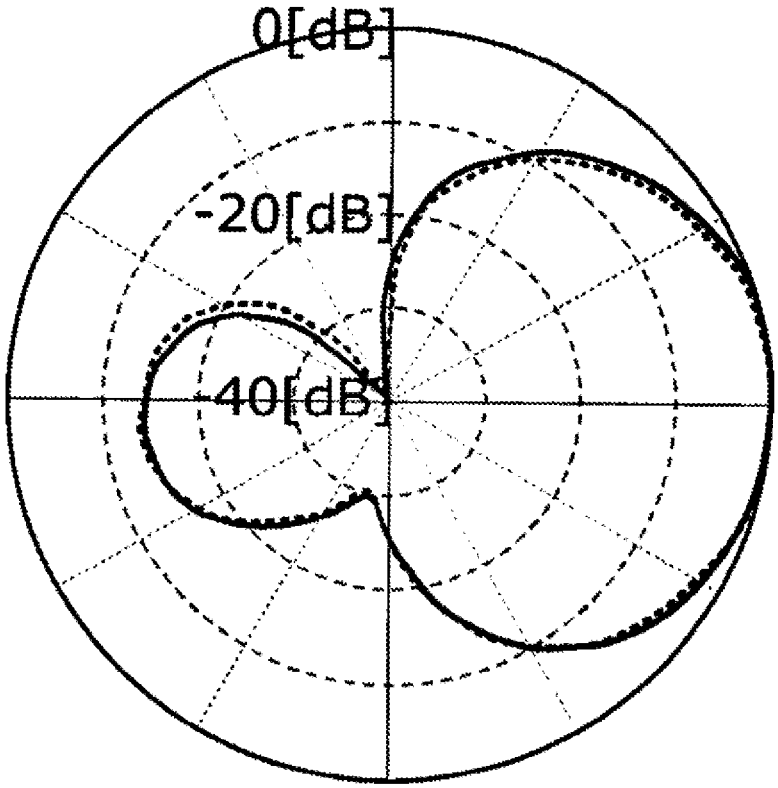
FIG. 45D is a diagram showing radiation patterns on the XY plane and the XZ plane at a frequency of 2 GHz of the antenna apparatus 1200.

FIG. 45C is a diagram showing a VSWR characteristic of the antenna apparatus 1200 shown in FIG. 45B. FIG. 45D is a diagram showing radiation patterns at a frequency of 2 GHz of the antenna apparatus 1200. However, the solid line shows the Eθ component on the XY plane, and the dotted line shows the EΦ component on the XZ plane. The radiation patterns are normalized with the maximum value.

As shown in FIG. 45B and FIG. 45C, even if the second antenna element 122 is shaped such that the signal transmitted therein is delayed by $3\pi/2$, resonance can be seen at 2 GHz. In addition, as shown in FIG. 45D, it can be seen that the antenna apparatus functions as a circularly polarized antenna. Furthermore, since the parasitic element 110 operates as a reflector, it is possible to make the radiation pattern intensity on the parasitic element 110 side, that is, the radiation pattern intensity on the negative X-axis side of FIG. 30, smaller than the radiation pattern intensity on the positive X-axis side. For this reason, it is possible to reduce the SAR. It is noted that the second antenna element 122 of the example of FIG. 43 is provided from the side of the first antenna element 121 on which the power feeding portion 123 is disposed to the side adjacent in the clockwise direction, but in another example, it may be provided from the side of the first antenna element 121 on which the power feeding portion 123 is disposed to the side adjacent in the counterclockwise direction. In this case, the direction of the current I flowing in the Y-axis direction shown in FIG. 44 is reversed. For this reason, it is possible to reverse the turning direction of the circular polarized waves.

Figure 46:
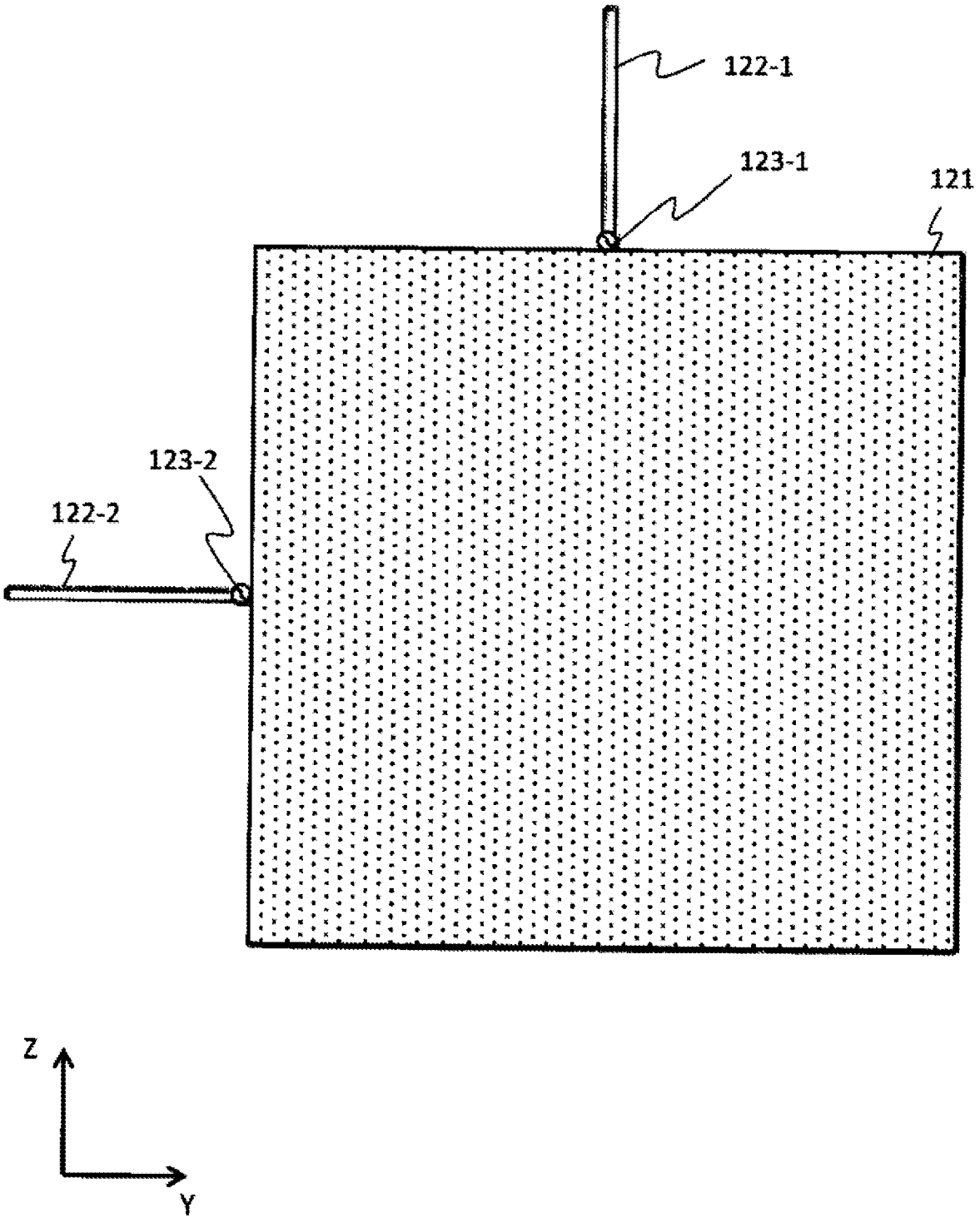
FIG. 46 is a diagram showing another configuration example of the antenna portion 120.

FIG. 46 is a diagram showing another configuration example of the antenna portion 120. The first antenna element 121 of the present example has the same shape as the first antenna element 121 of the example in FIG. 43. The antenna portion 120 of the present example has two power feeding portions 123-1 and 123-2 and two second antenna elements 122-1 and 122-2.

The power feeding portion 123-1 is provided at the midpoint of any side of the first antenna element 121. The second antenna element 122-1 is connected to the power feeding portion 123-1. The second antenna element 122-1 may be linear as shown in FIG. 46, inverted L-shaped, or T-shaped, and its shape is not limited.

The power feeding portion 123-2 is provided at the midpoint of a side orthogonal to the side on which the power feeding portion 123-1 is provided, among the sides of the first antenna element 121. The signal applied by the power feeding portion 123-2 is advanced in phase by $\pi/2$ with respect to the signal applied by the power feeding portion 123-1. The second antenna element 122-2 is connected to the power feeding portion 123-2. The second antenna element 122-2 has the same shape and size as the second antenna element 122-1.

With this configuration also, as shown in FIG. 44, it is possible to generate two orthogonal excitation modes. It is noted that the power feeding portion 123-2 and the second antenna element 122-2 of the example in FIG. 46 are provided on the side of the first antenna element 121 adjacent in the counterclockwise direction to the side on which the power feeding portion 123-1 and the second antenna element 122-1 are disposed, but in another example, they may be provided on the side of the first antenna element 121 adjacent in the clockwise direction to the side on which the power feeding portion 123-1 and the second antenna element 122-1 are disposed. Alternatively, the signal applied by the power feeding portion 123-2 may be delayed by $\pi/2$ in phase with respect to the signal applied by the power feeding portion 123-1. In this case, the directions of the currents I shown in FIG. 44 are reversed. For this reason, the turning direction of the circularly polarized waves can be reversed.

Eighth Example

Figure 47:
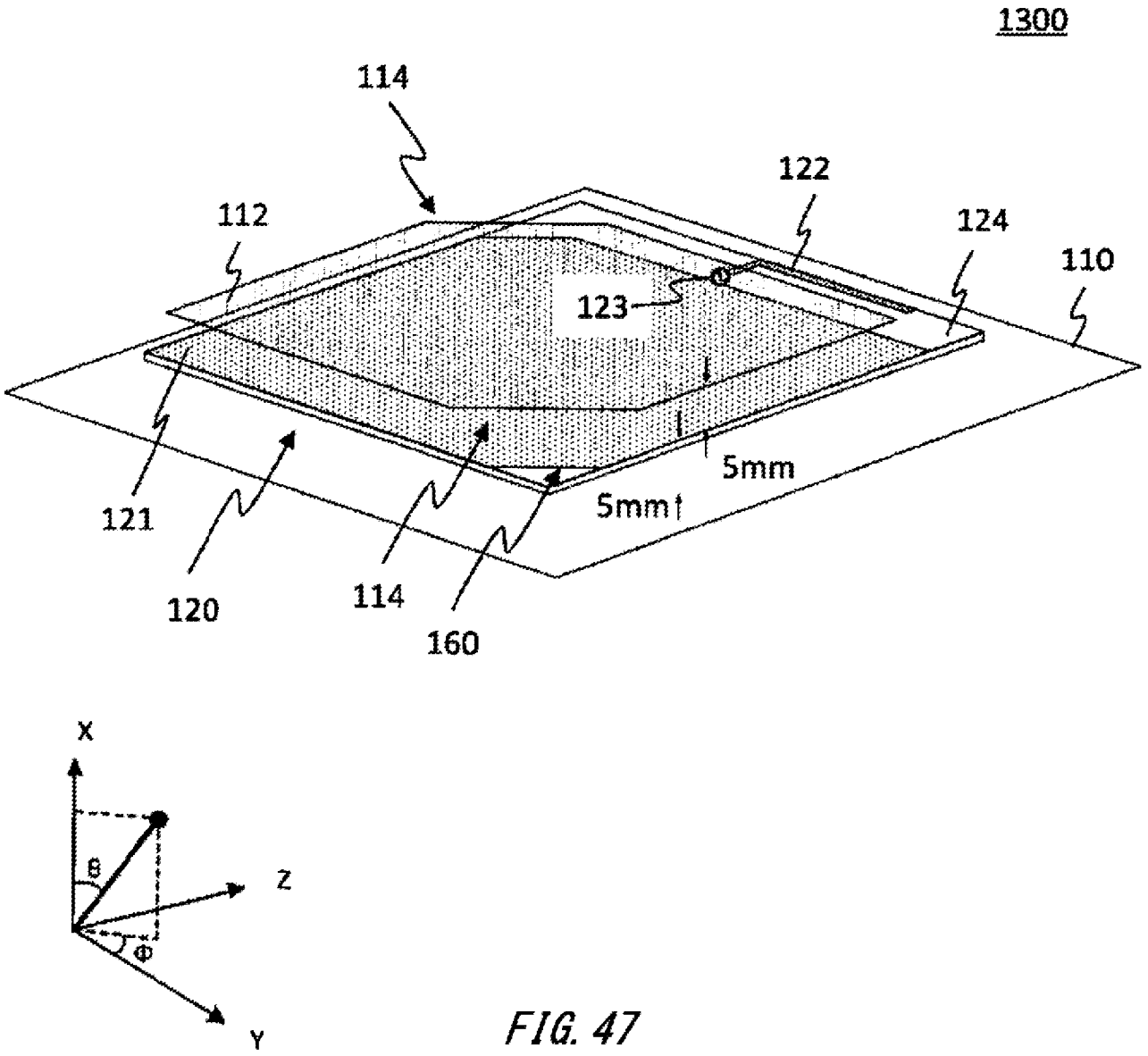
FIG. 47 is a perspective diagram showing an outline of an antenna apparatus 1300 according to the eighth example.

FIG. 47 is a perspective diagram showing an outline of an antenna apparatus 1300 according to the eighth example. The antenna apparatus 1300 according to the eighth example is an apparatus corresponding to circularly polarized waves. The antenna apparatus 1300, with respect to the antenna apparatus 1200 according to the seventh example, further includes a parasitic element 112. In the present example, the parasitic element 110 is a first parasitic element disposed opposing one main surface of the first antenna element 121, and the parasitic element 112 is a second parasitic element opposing the other main surface of the first antenna element 121.

On the YZ plane, the parasitic element 112 may be smaller than the parasitic element 110, and may be smaller than the first antenna element 121. In addition, on the YZ plane, the gravity center position of the parasitic element 112 and the gravity center position of the first antenna element 121 may coincide.

The parasitic element 112 on the YZ plane may have a similar shape to the first antenna element 121. That is, the parasitic element 112 may be an approximately circular shape or an approximately regular n-sided polygon. When the first antenna element 121 has a projection or a notch, the second antenna element 122 may also have a projection or a notch. The first antenna element 121 of the present example has the same notches 160 as the example shown in FIG. 41A. The parasitic element 112 has notches 114 at positions opposing the notches 160. The notches 114 may be similar in shape to the notches 160. The parasitic element 112 may not have a projection or a notch.

The distance between the parasitic element 112 and the first antenna element 121 may be the same as the distance between the first antenna element 121 and the parasitic element 110. The distance in the present example is 5 mm.

Figure 48:
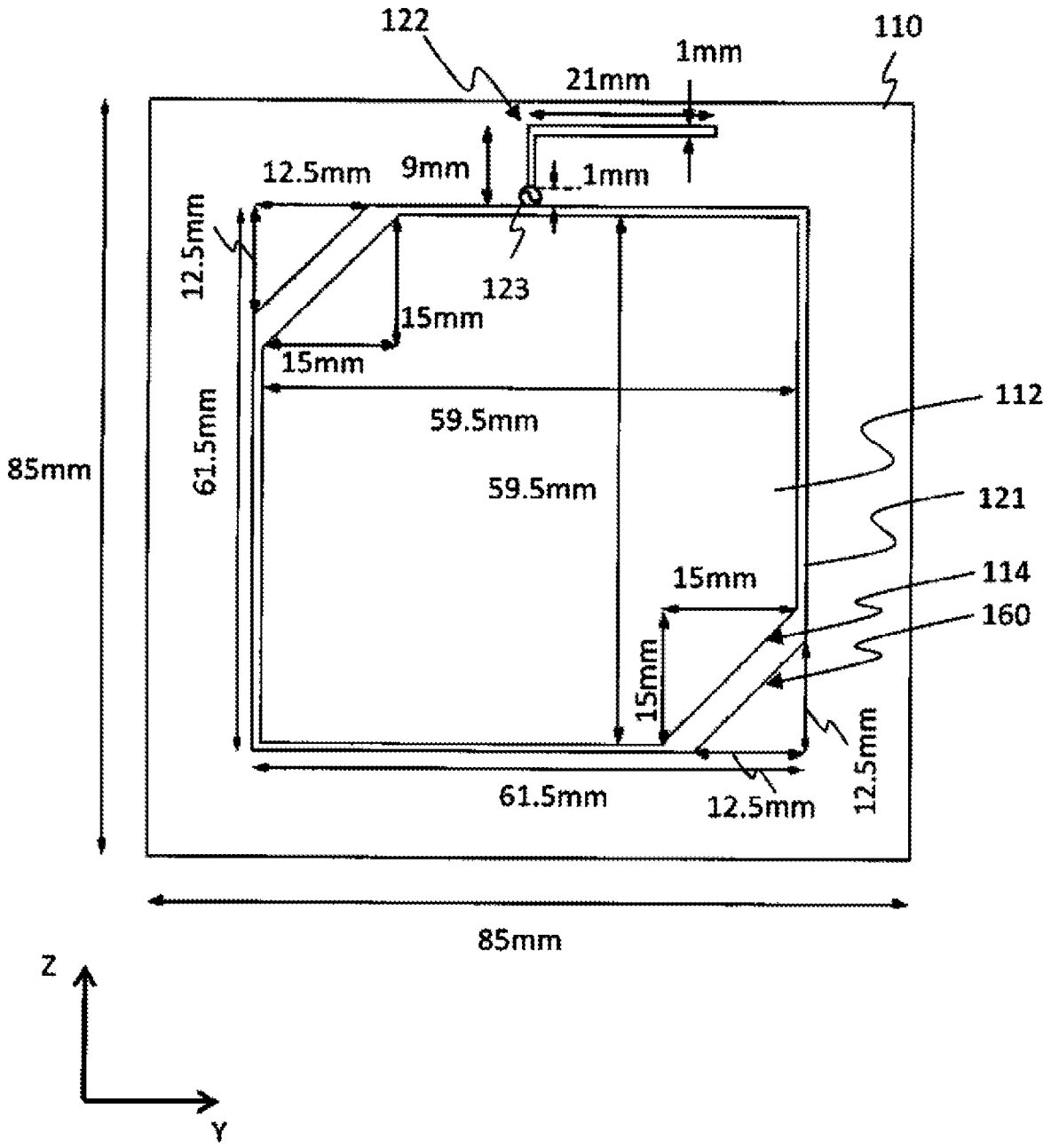
FIG. 48 is a top view showing the sizes of the parts of the antenna portion 120 shown in FIG. 47.

FIG. 48 is a top view showing the sizes of the parts of the antenna portion 120 shown in FIG. 47. The dielectric substrate 124 is omitted in FIG. 48. By the sizes shown in FIG. 48, it was possible to electrically couple the parasitic element 110, the first antenna element 121, and the parasitic element 112 and to further widen the bandwidth.

Figure 49A:
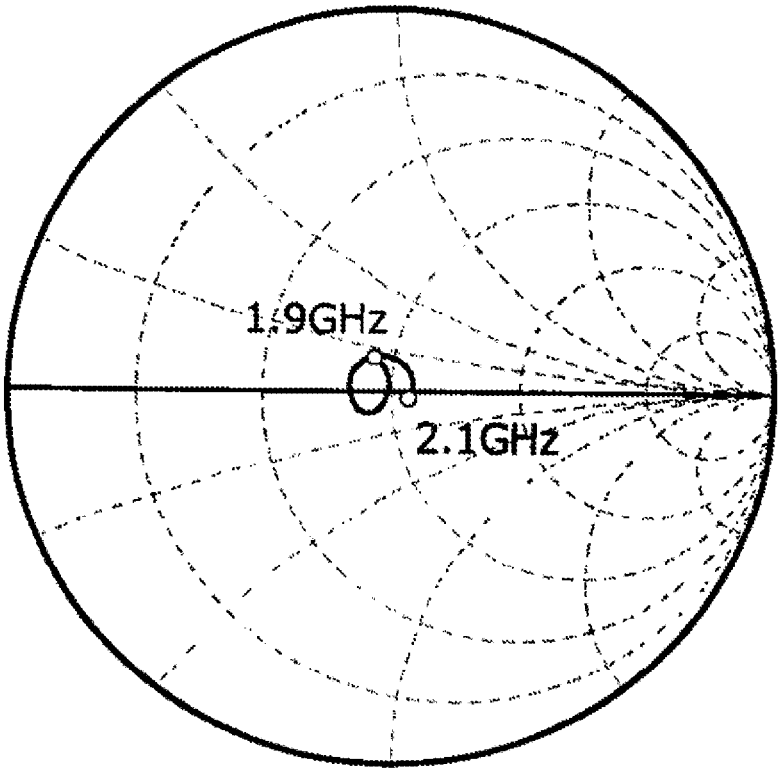
FIG. 49A is a Smith chart showing an input impedance characteristic of the antenna apparatus 1300 of the example in FIG. 48.
Figure 49B:
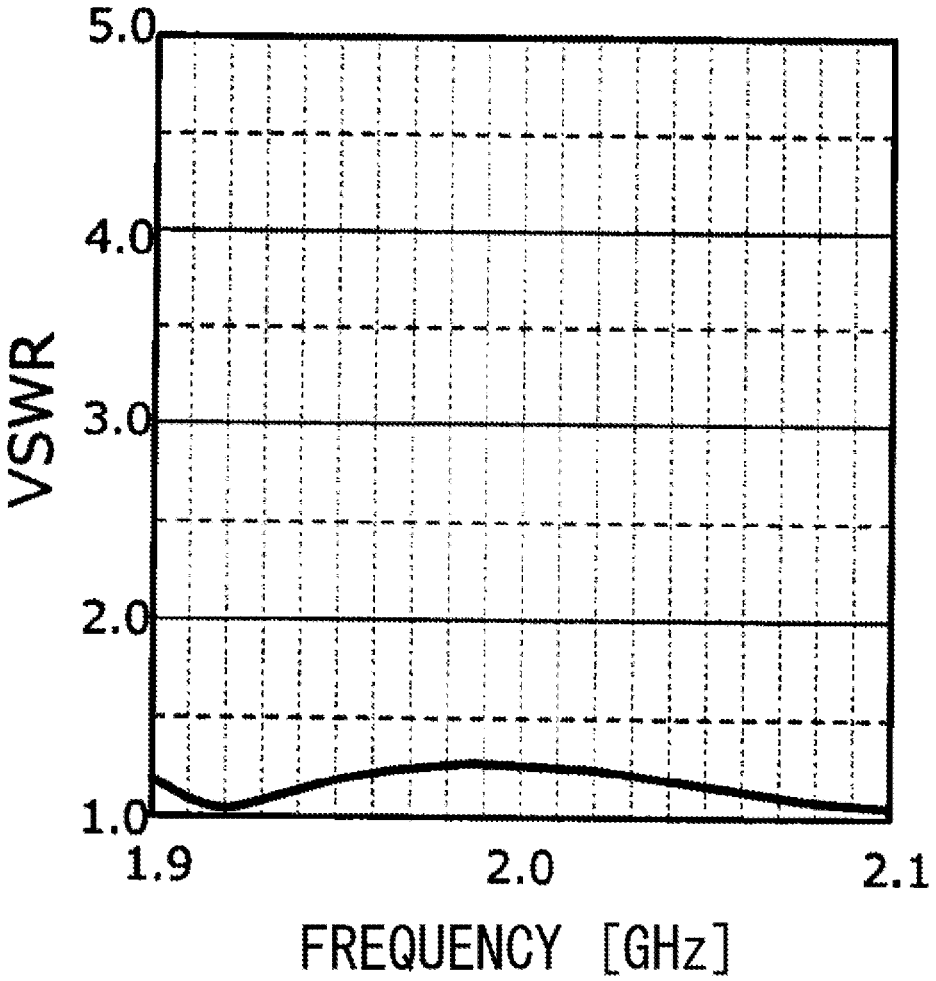
FIG. 49B is a diagram showing a VSWR characteristic of the antenna apparatus 1300 of the example in FIG. 48.
Figure 49C:
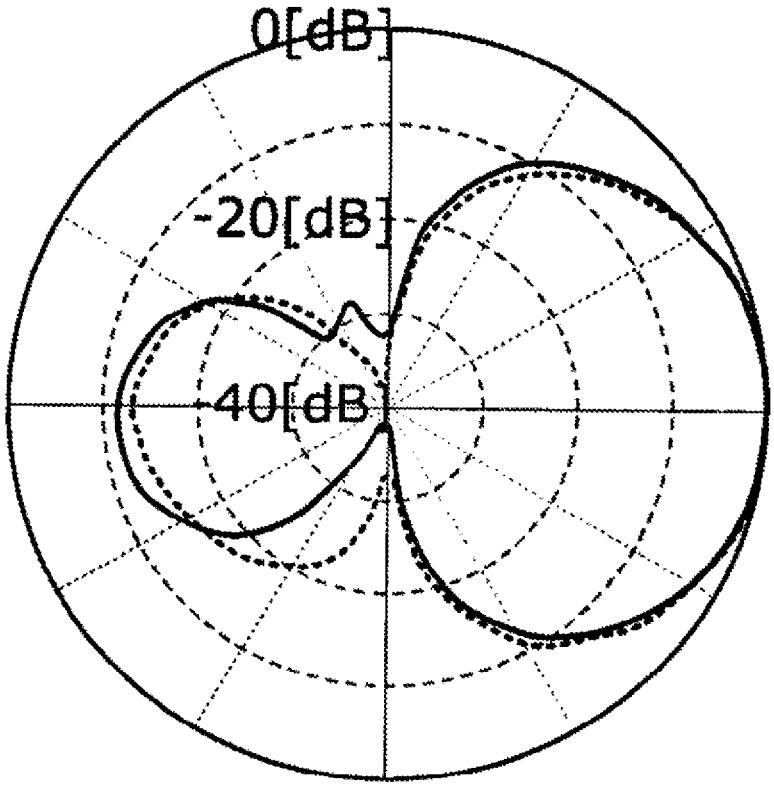
FIG. 49C is a diagram showing radiation patterns on the XY plane and the XZ plane at a frequency of 2 GHz of the antenna apparatus 1300 of the example in FIG. 48.

FIG. 49A is a Smith chart showing an input impedance characteristic of the antenna apparatus 1300 of the example in FIG. 48. FIG. 49B is a diagram showing a VSWR characteristic of the antenna apparatus 1300 of the example in FIG. 48. FIG. 49C is a diagram showing radiation patterns at a frequency of 2 GHz of the antenna apparatus 1300 of the example in FIG. 48. However, the solid line shows the Eθ component on the XY plane, and the dotted line shows the EΦ component on the XZ plane. The radiation patterns are normalized with the maximum value.

As shown in FIG. 49A and FIG. 49B, it can be seen that the bandwidth of the antenna apparatus is widened more than in the example shown in FIG. 42A and FIG. 42B by providing the parasitic element 112. In addition, as shown in FIG. 49C, it can be seen that the antenna apparatus functions as a circularly polarized antenna.

Ninth Example

Figure 50:
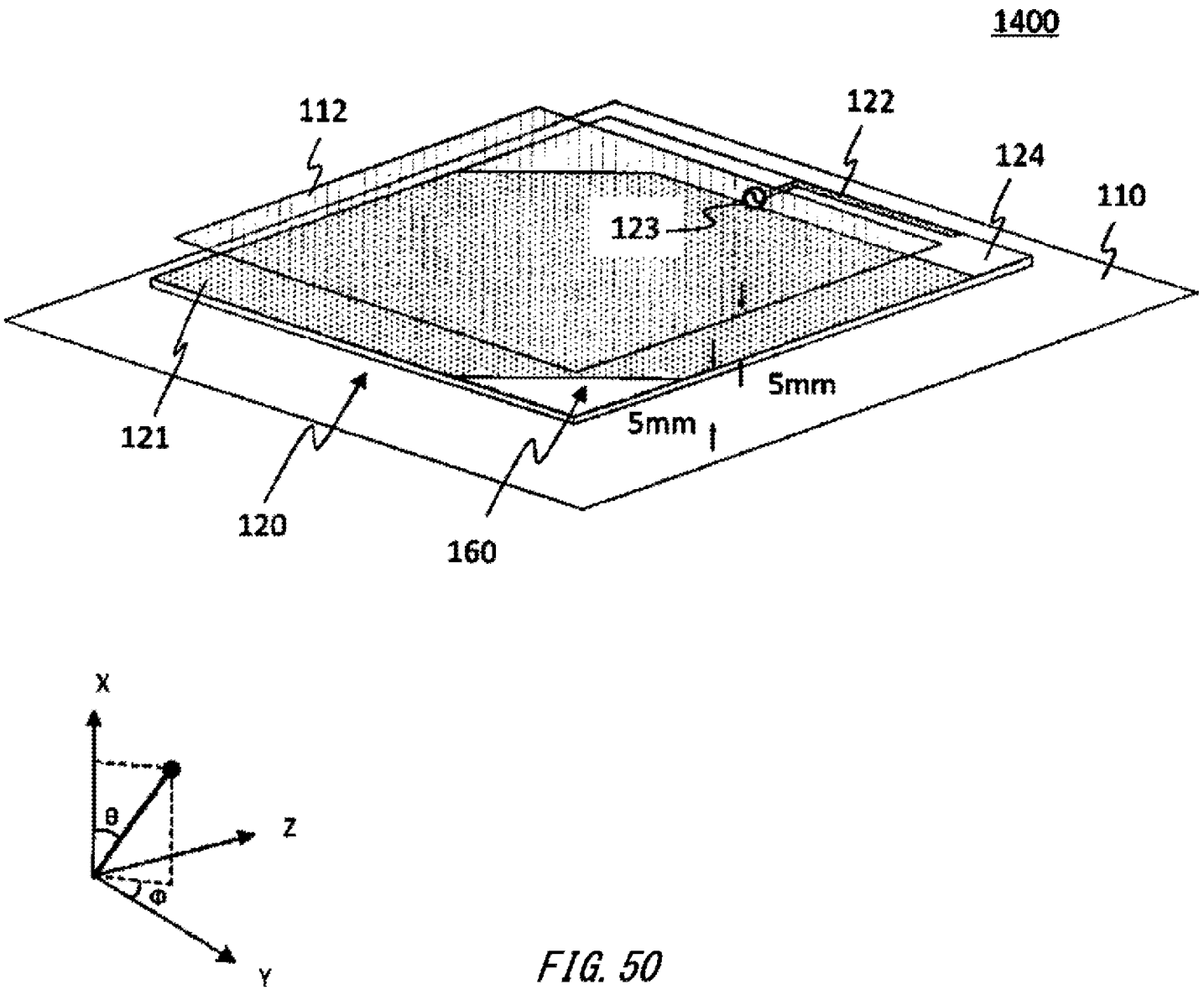
FIG. 50 is a perspective diagram showing an outline of an antenna apparatus 1400 according to the ninth example.

FIG. 50 is a perspective diagram showing an outline of an antenna apparatus 1400 according to the ninth example. The antenna apparatus 1400 according to the ninth example is an apparatus corresponding to circularly polarized waves. The antenna apparatus 1400 differs from the antenna apparatus 1300 according to the eighth example in the shape of the parasitic element 112. In the present example, the first antenna element 121 is provided with the notches 160, but the parasitic element 112 is not provided with corresponding notches.

Figure 51:
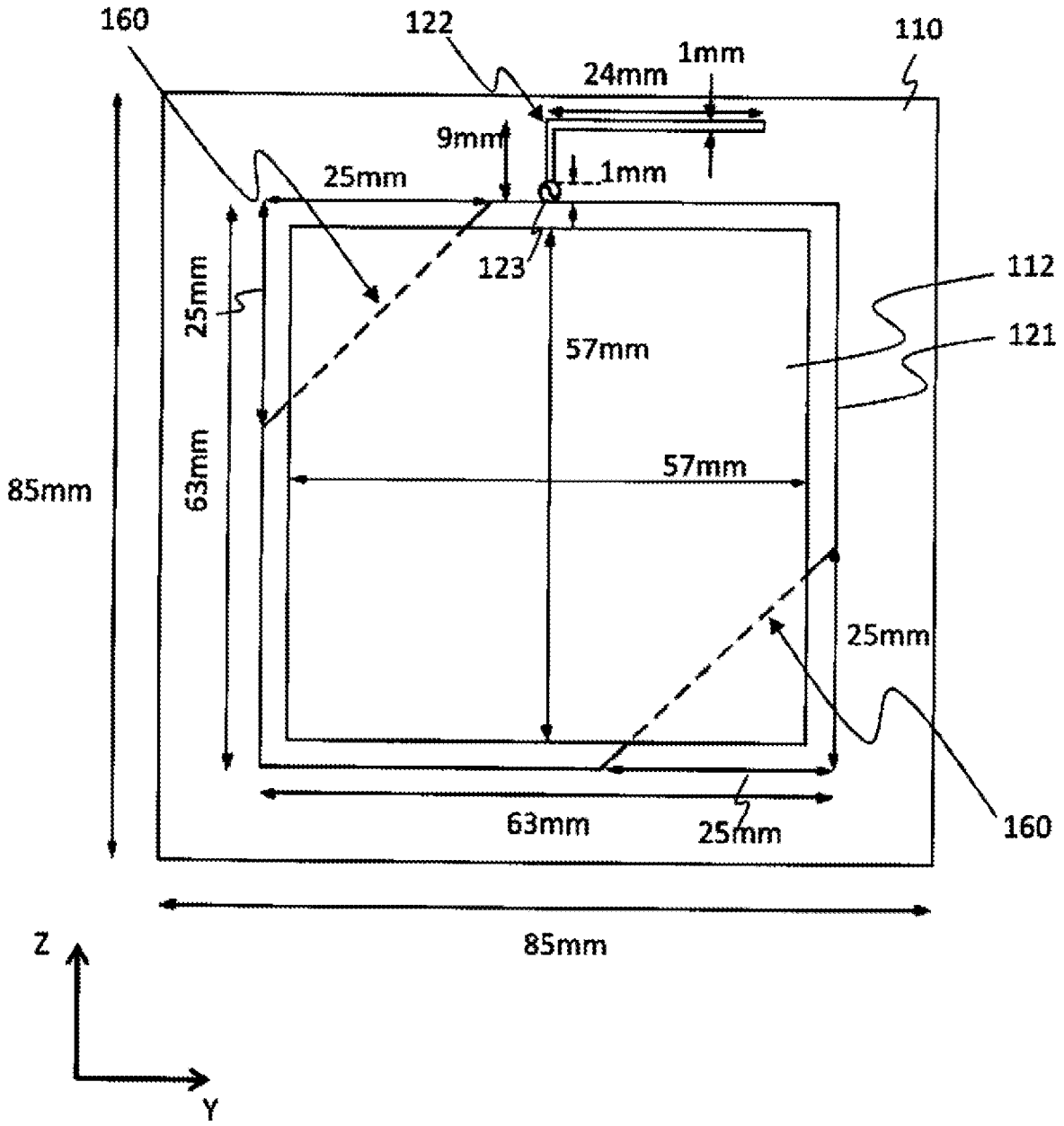
FIG. 51 is a top view showing the sizes of the parts of the antenna portion 120 shown in FIG. 50.

FIG. 51 is a top view showing the sizes of the parts of the antenna portion 120 shown in FIG. 50. The dielectric substrate 124 is omitted in FIG. 51. By the sizes shown in FIG. 51, it was possible to electrically couple the parasitic element 110, the first antenna element 121, and the parasitic element 112 and to further widen the bandwidth.

Figure 52A:
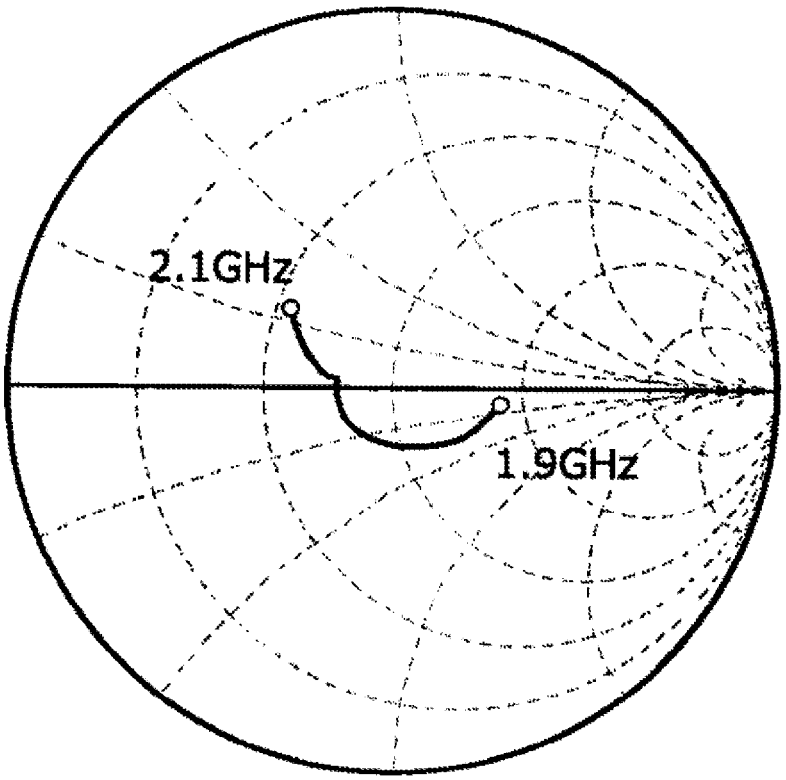
FIG. 52A is a Smith chart showing an input impedance characteristic of the antenna apparatus 1400 of the example in FIG. 51.
Figure 52B:
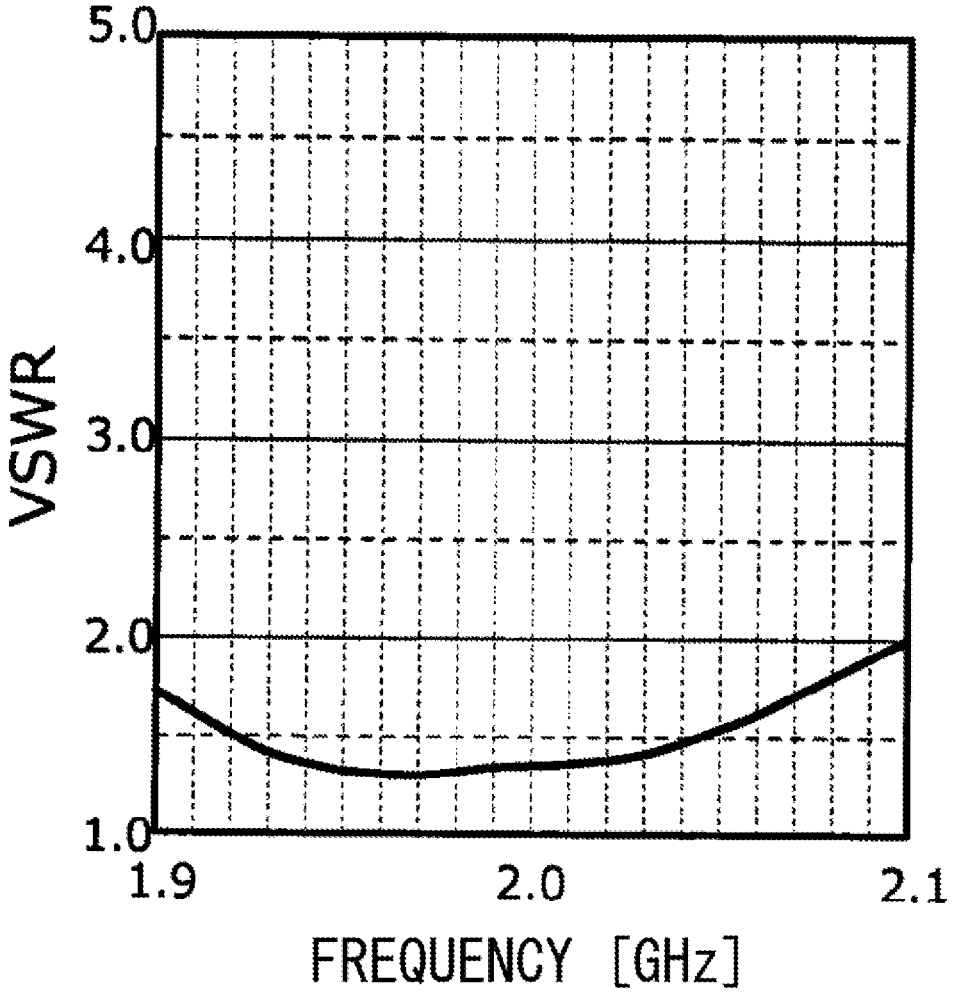
FIG. 52B is a diagram showing a VSWR characteristic of the antenna apparatus 1400 of the example in FIG. 51.
Figure 52C:
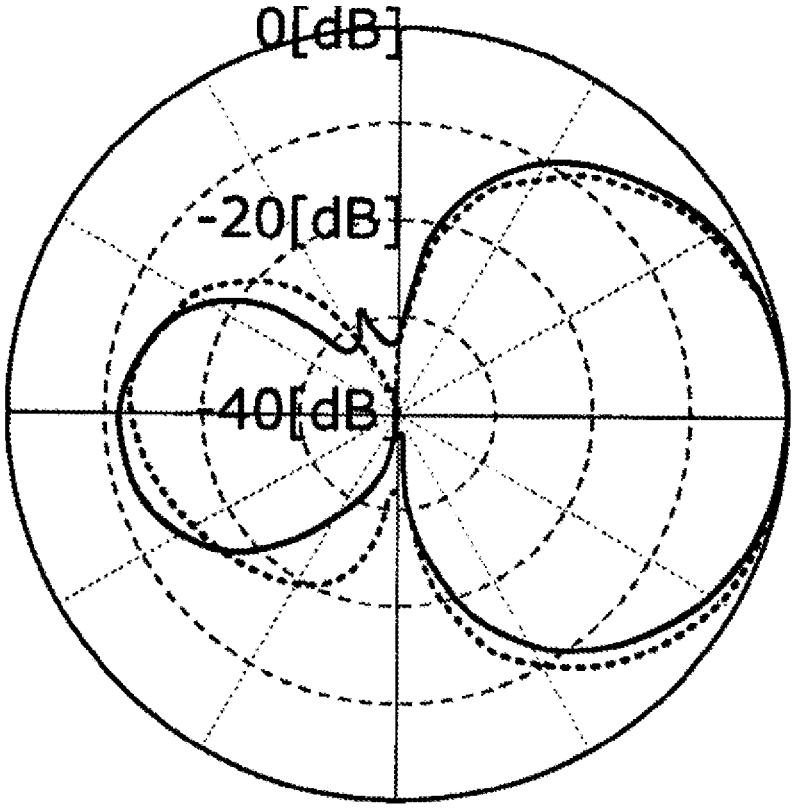
FIG. 52C is a diagram showing radiation patterns on the XY plane and the XZ plane at a frequency of 2 GHz of the antenna apparatus 1400 of the example in FIG. 51.

FIG. 52A is a Smith chart showing an input impedance characteristic of the antenna apparatus 1400 of the example in FIG. 51. FIG. 52B is a diagram showing a VSWR characteristic of the antenna apparatus 1400 of the example in FIG. 51. FIG. 52C is a diagram showing radiation patterns at a frequency of 2 GHz of the antenna apparatus 1400 of the example in FIG. 51. However, the solid line shows the Eθ component on the XY plane, and the dotted line shows the EΦ component on the XZ plane. The radiation patterns are normalized with the maximum value.

As shown in FIG. 52A and FIG. 52B, it can be seen that the bandwidth of the antenna apparatus is widened more than in the example shown in FIG. 42A and FIG. 42B by providing the parasitic element 112. In addition, as shown in FIG. 52C, it can be seen that the antenna apparatus functions as a circularly polarized antenna. It is noted that the parasitic element 112 may be applied to an example other than the ninth example.

Tenth Example

Figure 53:
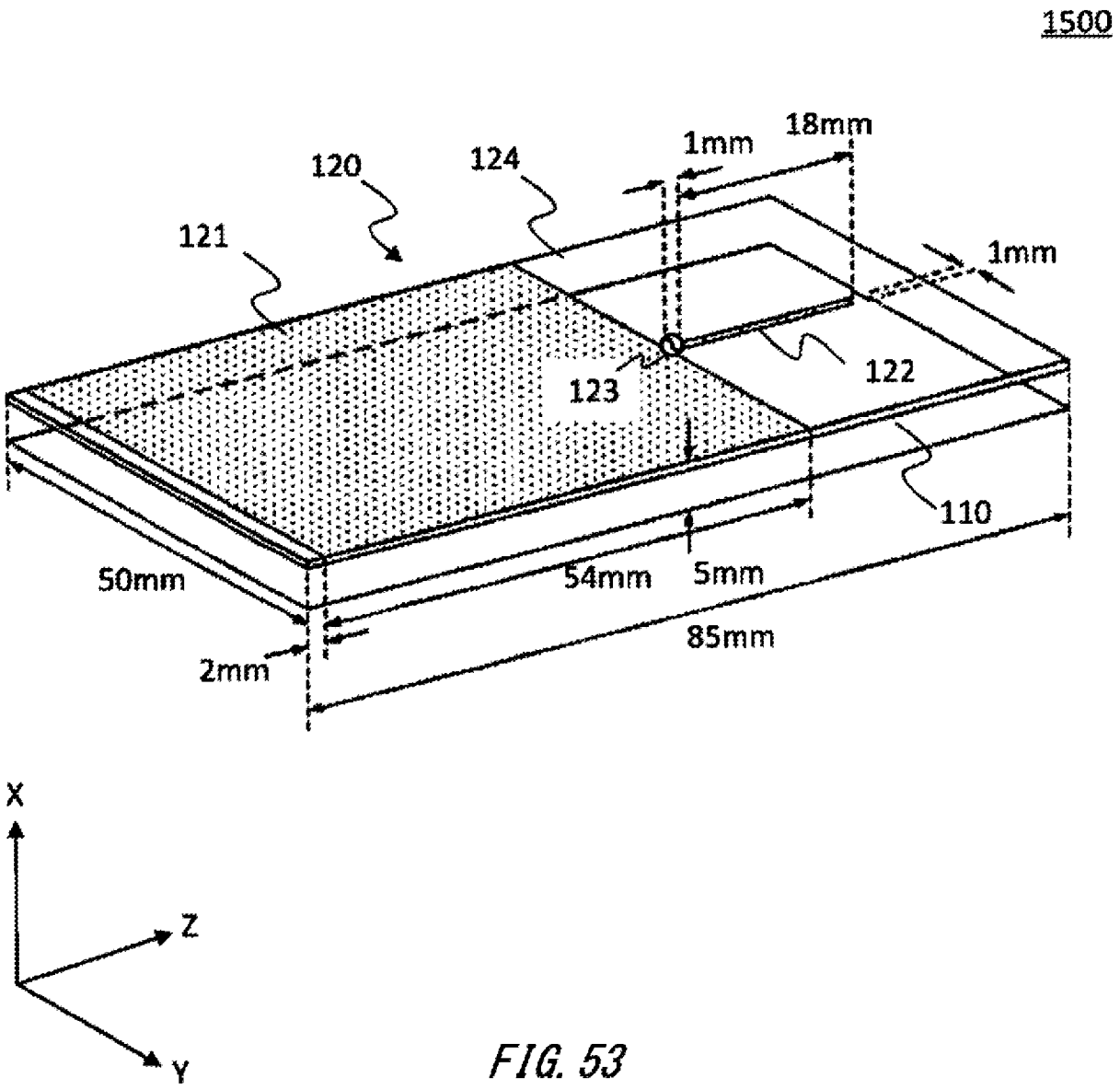
FIG. 53 is a perspective diagram showing an outline of an antenna apparatus 1500 according to the tenth example.

FIG. 53 is a perspective diagram showing an outline of an antenna apparatus 1500 according to the tenth example. The antenna apparatus 1500 according to the tenth example is an apparatus corresponding to linearly polarized waves. In the antenna apparatus 1500, the dielectric substrate 124 has a thickness of 1 mm and a relative dielectric constant of 4.3. Using the method shown in FIG. 8 to FIG. 11, The antenna apparatus 1500 was tuned at a frequency of 2 GHz.

Figure 54A:
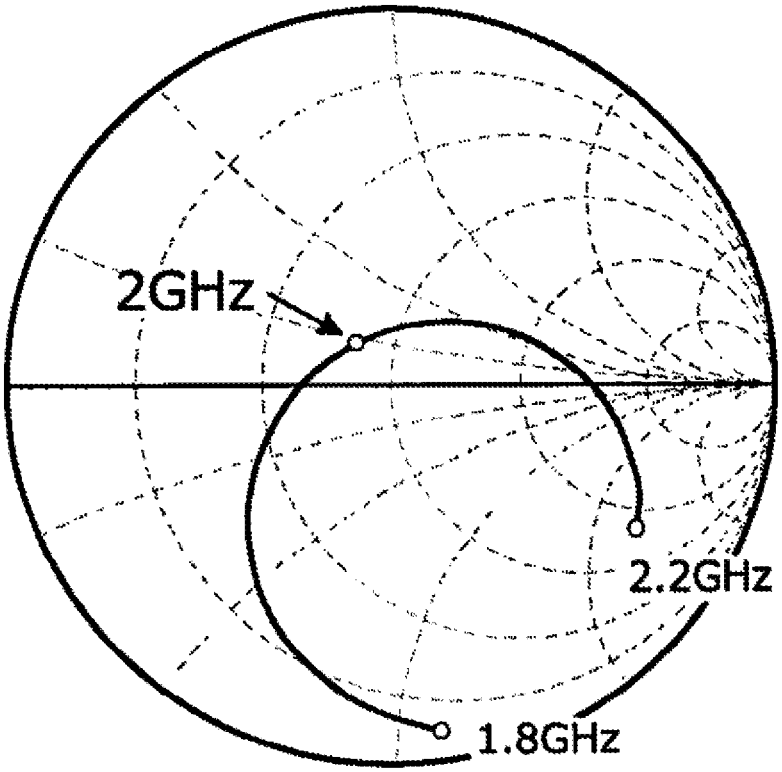
FIG. 54A is a Smith chart showing an input impedance characteristic of the antenna apparatus 1500 of the example in FIG. 53.
Figure 54B:
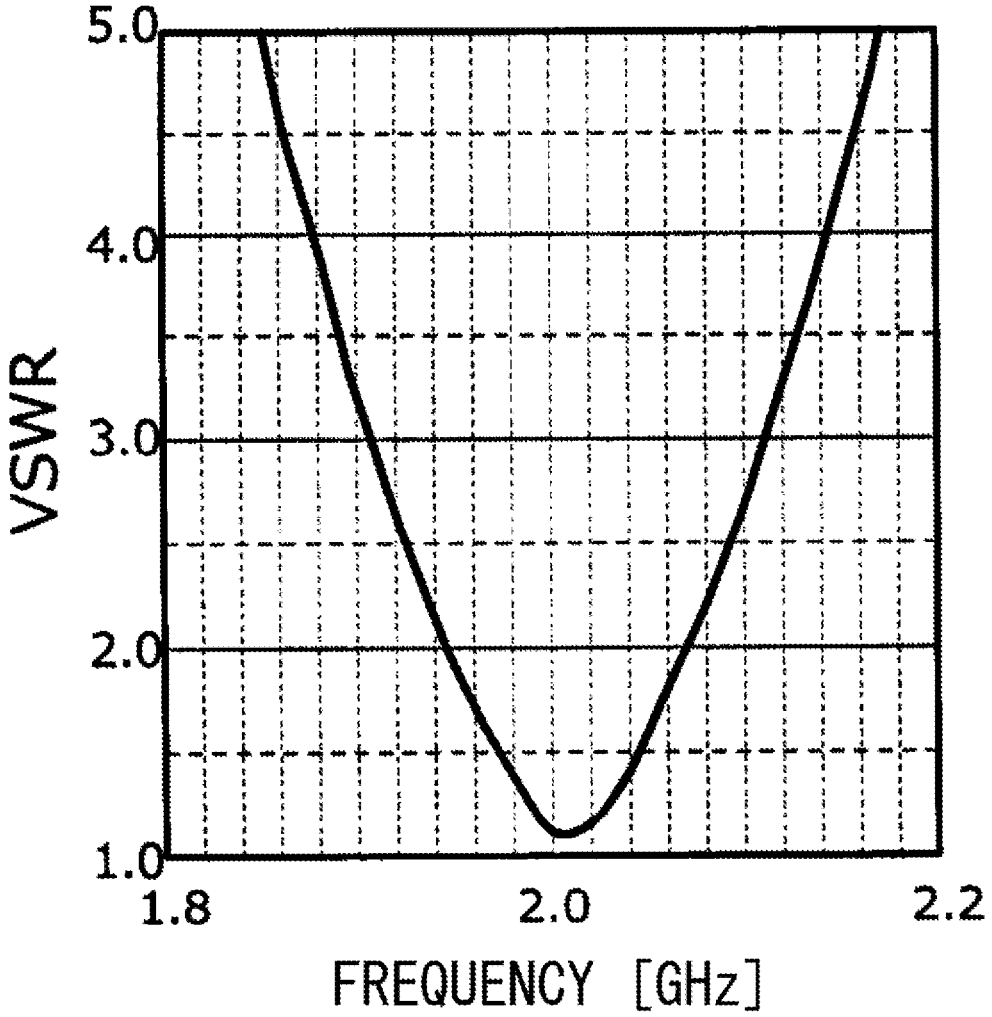
FIG. 54B is a diagram showing a VSWR characteristic of the antenna apparatus 1500 of the example in FIG. 53.
Figure 54C:
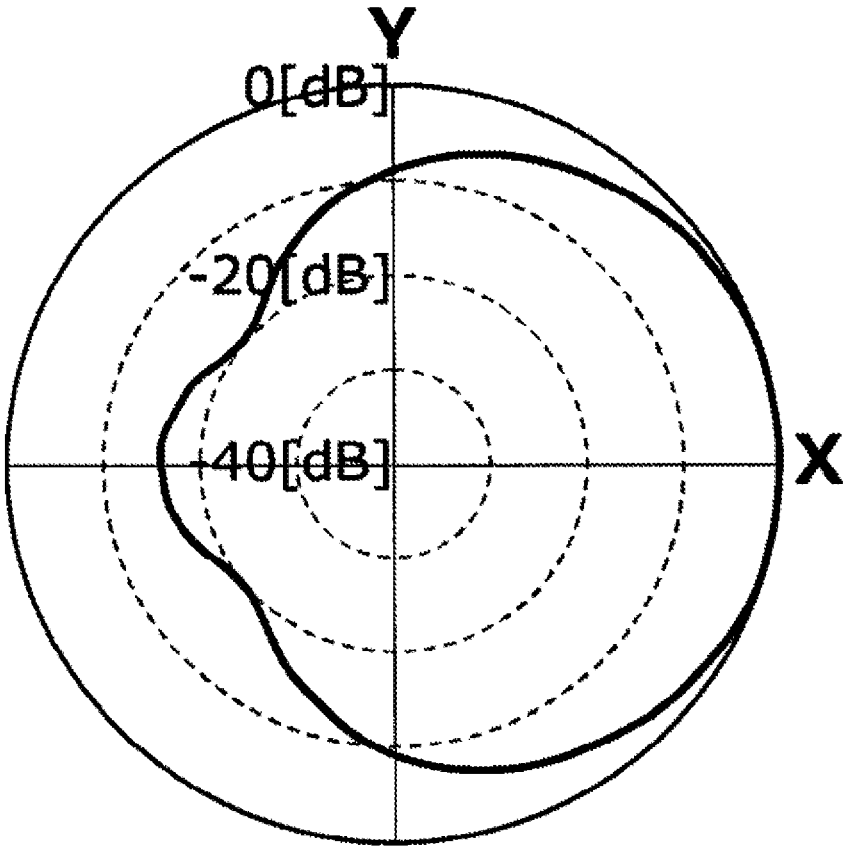
FIG. 54C is a diagram showing a radiation pattern on the XY plane at a frequency of 2 GHz of the antenna apparatus 1500 of the example in FIG. 53.

FIG. 54A is a Smith chart showing an input impedance characteristic of the antenna apparatus 1500 of the example in FIG. 53. FIG. 54B is a diagram showing a VSWR characteristic of the antenna apparatus 1500 of the example in FIG. 53. FIG. 54C is a diagram showing a radiation pattern on the XY plane at a frequency of 2 GHz of the antenna apparatus 1500 of the example in FIG. 53. However, the radiation pattern is normalized with the maximum value.

Figure 55:
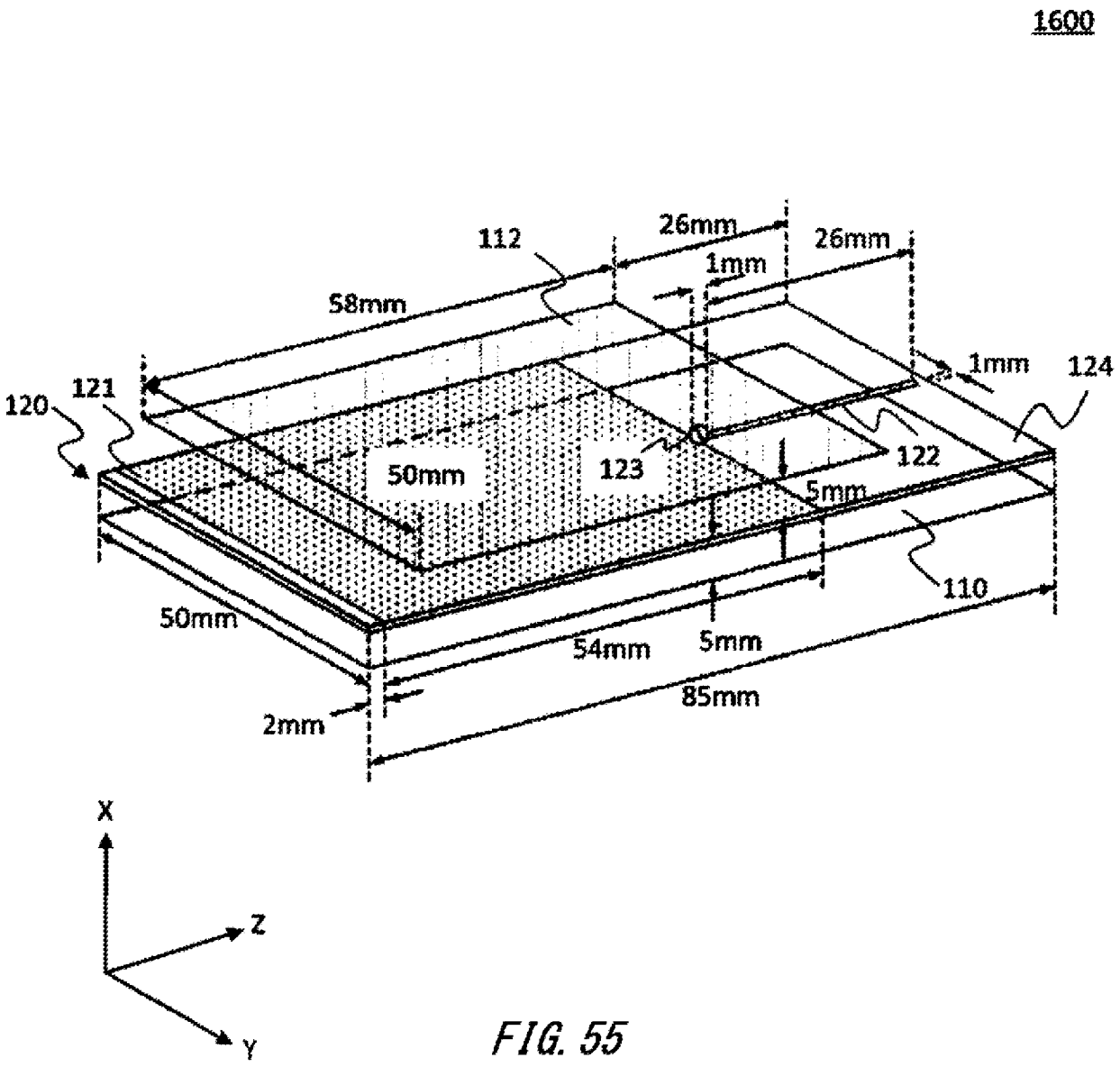
FIG. 55 is a perspective diagram showing an outline of an antenna apparatus 1600 according to the eleventh example.

FIG. 55 is a perspective diagram showing an outline of an antenna apparatus 1600 according to the eleventh example. The antenna apparatus 1600 according to the eleventh example is an apparatus corresponding to linearly polarized waves. The antenna apparatus 1600, with respect to the configuration of the antenna apparatus 1500, further includes the parasitic element 112. In addition, in the present example, matching is obtained by adjusting the size of the parts without using a matching circuit. The parasitic element 112 may be smaller than the antenna portion 120.

Figure 56A:
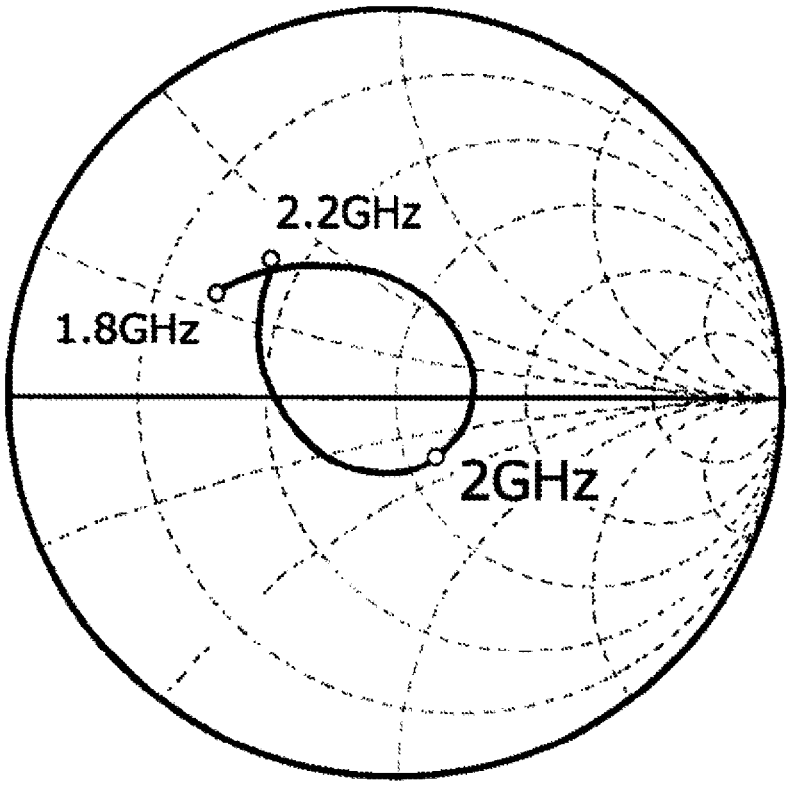
FIG. 56A is a Smith chart showing an input impedance characteristic of the antenna apparatus 1600 of the example in FIG. 55.
Figure 56B:
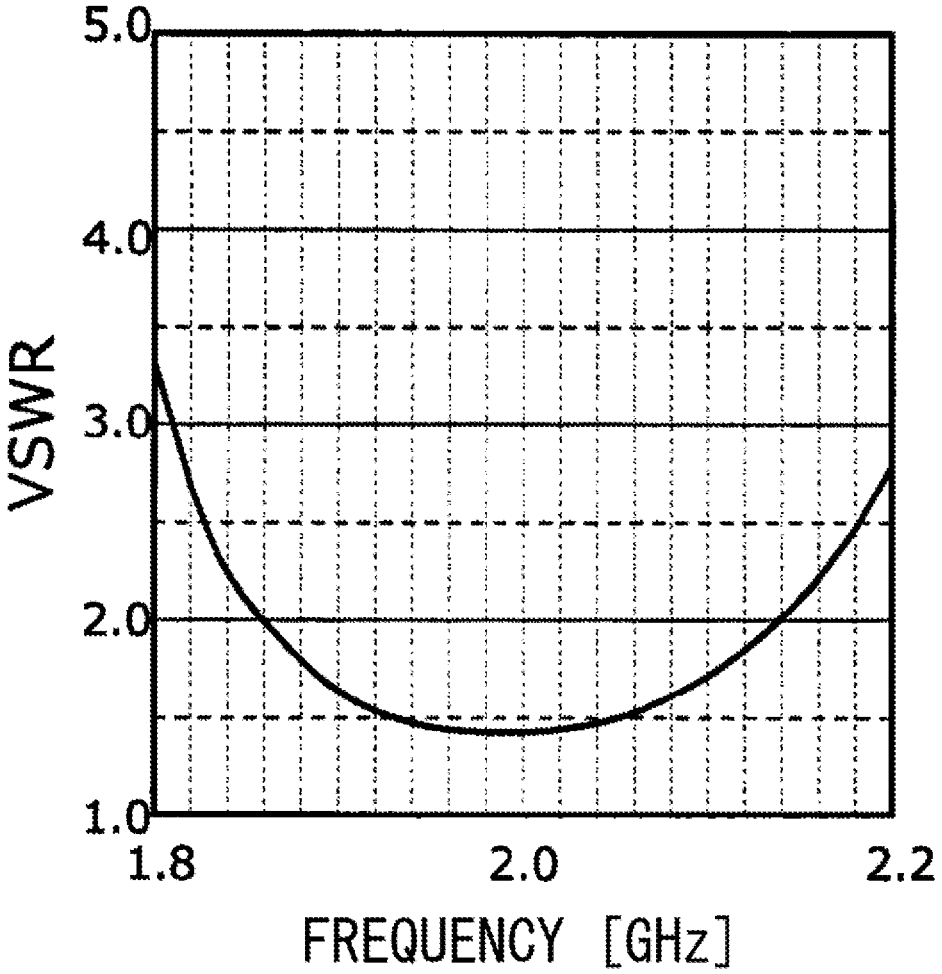
FIG. 56B is a diagram showing a VSWR characteristic of the antenna apparatus 1600 of the example in FIG. 55.
Figure 56C:
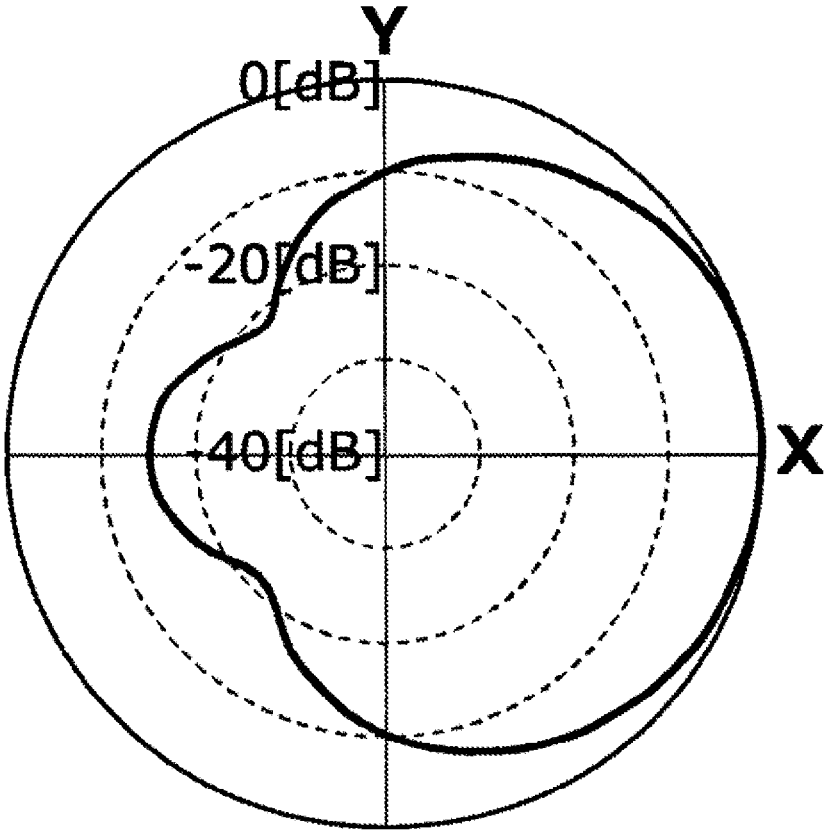
FIG. 56C is a diagram showing a radiation pattern on the XY plane at a frequency of 2 GHz of the antenna apparatus 1600 of the example in FIG. 55.

FIG. 56A is a Smith chart showing an input impedance characteristic of the antenna apparatus 1600 of the example in FIG. 55. FIG. 56B is a diagram showing a VSWR characteristic of the antenna apparatus 1600 of the example in FIG. 55. FIG. 56C is a diagram showing a radiation pattern on the XY plane at a frequency of 2 GHz of the antenna apparatus 1600 of the example in FIG. 55. However, the radiation pattern is normalized with the maximum value. As shown in FIG. 56A and FIG. 56B, it can be seen that the bandwidth of the antenna apparatus is widened more than in the example shown in FIG. 54A and FIG. 54B by providing the parasitic element 112.

While the embodiments of the present invention have been described, the technical scope of the invention is not limited to the above described embodiments. It is apparent to persons skilled in the art that various alterations and improvements can be added to the above-described embodiments. It is also apparent from the scope of the claims that the embodiments added with such alterations or improvements can be included in the technical scope of the invention.

What is claimed is:

1. An antenna apparatus having directivity, comprising:

an antenna portion having a power feeding portion, a plate-like first antenna element, and a second antenna element connected to a side of the first antenna element through the power feeding portion, the second antenna element consists of a single, filament-like substantially linear conductor, the second antenna element having a width smaller than that of the first antenna element, and the second antenna element having a total length extending in an extension direction; and a plate-like parasitic element disposed opposite to the antenna portion, wherein the parasitic element has a length that is approximately one-half or more of a wavelength of an operating frequency, the total length of the second antenna element is shorter than one-fourth of the wavelength of the operating frequency, the antenna portion and the parasitic element have a distance capable of being connected electromagnetically to each other, the first antenna element has a predetermined length and/or the width so as to control a resonance frequency of the antenna apparatus, and the second antenna element has a predetermined length so as to control an input impedance by adjusting the length of the second antenna element.

2. The antenna apparatus according to claim 1, wherein the first antenna element has an approximately rectangular shape, and the second antenna element is connected at an approximately center position of the side of the first antenna element, to the side of the first antenna element through the power feeding portion.

3. The antenna apparatus according to claim 1, wherein the second antenna element has a part extending in a direction intersecting with a surface of the parasitic element, the surface being arranged opposite to the antenna portion.

4. The antenna apparatus according to claim 1, wherein the second antenna element is extended in a direction intersecting with an extending direction of the side of the first antenna element with a predetermined angle with respect to the first antenna element, and the angle between the first antenna element and the second antenna element is variable.

5. The antenna apparatus according to claim 1, wherein the first antenna element includes a principal surface having a plurality of sides, and the first antenna element has a projection or a notch on at least one of the sides of the principal surface of the first antenna element.

6. The antenna apparatus according to claim 1, wherein the antenna portion includes a plurality of the second antenna elements and a plurality of the power feeding portions, the first antenna element has two sides orthogonal to each other, each of the sides of the first antenna element is connected to one of the second antenna elements, and each of the power feeding portions is provided between each second antenna element and the first antenna element.

7. The antenna apparatus according to claim 1, comprising the parasitic element disposed opposite to a first principal surface of the first antenna element, and a second parasitic element disposed opposite to a second principal surface of the first antenna element.

8. The antenna apparatus according to claim 1, wherein the first antenna element has a principal surface having an approximately circular shape or an approximately regular n-sided polygon (provided that n is an even number).

9. The antenna apparatus according to claim 1, wherein the second antenna element is directly connected to the power feeding portion.

10. The antenna apparatus according to claim 1, wherein the second antenna element is made of a conductor foil.

11. The antenna apparatus according to claim 1, wherein the first antenna element has the predetermined length, which is measured in a longitudinal direction, selected so as to control a resonance frequency of the antenna apparatus.

12. An antenna apparatus comprising:

an antenna portion having a power feeding portion, a plate-like first antenna element, and a second antenna element connected to a first side of a principal surface of the first antenna element through the power feeding portion, the second antenna element having a width smaller than that of the first antenna element; and a plate-like parasitic element disposed opposite to the antenna portion, wherein the parasitic element has a length and a width that are approximately one-half or more of a wavelength of an operating frequency, the antenna portion and the parasitic element have a distance capable of being connected electromagnetically to each other, the first antenna element has a predetermined length and/or the width so as to control a resonance frequency of the antenna apparatus, the second antenna element has a first end connected to the power feeding portion and a second end connected to a second side of the principal surface of the first antenna element that is adjacent to the first side of the principal surface of the first antenna element so as to receive or radiate a circularly polarized wave, the second side of the principal surface of the first antenna element connected to the second antenna element is not provided with the power feeding portion, and the second antenna element is formed so as to delay a phase of a signal transmitted through the second antenna element from the first end to the second end by $3\pi/2$.

13. The antenna apparatus according to claim 12, comprising the parasitic element disposed opposite to a first principal surface of the first antenna element, and a second parasitic element disposed opposite to a second principal surface of the first antenna element.

14. The antenna apparatus according to claim 12, wherein the principal surface of the first antenna element has an approximately circular shape or an approximately regular n-sided polygon, wherein n is an even number.

15. The antenna apparatus according to claim 12, wherein the second antenna element is made of a conductor foil.

16. The antenna apparatus according to claim 12, wherein the first antenna element has the predetermined length, which is measured in a longitudinal direction, selected so as to control a resonance frequency of the antenna apparatus.

17. The antenna apparatus according to claim 12, wherein the first side of the principal surface of the first antenna element is a side of the principal surface of the first antenna element that is in closest proximity to the power feeding portion.

18. An antenna apparatus having directivity, comprising:

an antenna portion having a power feeding portion, a plate-like first antenna element including a principal surface having a plurality of sides and a plurality of vertices, and a second antenna element connected to one of the sides of the principal surface of the first antenna element through the power feeding portion, the second antenna element having a width smaller than that of the first antenna element, the second antenna element consisting of a single, filament-like conductor; and a plate-like parasitic element disposed opposite to the antenna portion, wherein the parasitic element has a length that is approximately one-half or more of a wavelength of an operating frequency, wherein the first antenna element has one or more features selected from the group consisting of a projection projecting from at least one of the sides of the principal surface of the first antenna element, a notch on at least one of the sides of the principal surface of the first antenna element, and a notch on at least one of the vertices of the principal surface of the first antenna element, wherein the second antenna element has a length that is shorter than one-fourth of the wavelength of the operating frequency, wherein the antenna portion and the parasitic element have a distance capable of being connected electromagnetically to each other, wherein the first antenna element has a predetermined length and/or the width so as to control a resonance frequency of the antenna apparatus, and wherein the second antenna element has a predetermined length so as to control an input impedance by adjusting the length of the second antenna element.

* * * * *